United States Patent [19]

Kurematsu et al.

[11] Patent Number: 5,032,494

[45] Date of Patent: Jul. 16, 1991

[54] METHOD OF PROCESSING LIGHT-SENSITIVE SILVER HALIDE COLOR PHOTOGRAPHIC MATERIAL HAVING HTREE MOLE % SILVER IODINE CORE/SHELL OR TABULAR HALIDE GRAINS

[75] Inventors: Masayuki Kurematsu; Shigeharu Koboshi; Syozo Aoki; Masahiko Kon, all of Tokyo, Japan

[73] Assignee: Konishiroku Photo Industry Co., Ltd., Tokyo, Japan

[21] Appl. No.: 569,233

[22] Filed: Aug. 17, 1990

Related U.S. Application Data

[63] Continuation of Ser. No. 233,841, Aug. 17, 1988, abandoned, which is a continuation of Ser. No. 945,014, Dec. 22, 1986, abandoned.

[30] Foreign Application Priority Data

| | | | |
|---|---|---|---|
| Dec. 28, 1985 | [JP] | Japan | 60-298233 |
| Jan. 23, 1986 | [JP] | Japan | 61-12781 |
| Feb. 19, 1986 | [JP] | Japan | 61-35758 |

[51] Int. Cl.[5] ..... G03C 7/16

[52] U.S. Cl. ..... 430/375; 430/380; 430/393; 430/484; 430/486; 430/957

[58] Field of Search ..... 430/372, 375, 376, 380, 430/384, 385, 393, 460, 467, 470, 473, 484, 486, 490, 505, 552, 553, 567, 569, 957

[56] References Cited

U.S. PATENT DOCUMENTS

| | | | |
|---|---|---|---|
| 3,706,562 | 12/1972 | Herz et al. | 96/66.3 |
| 4,692,400 | 9/1987 | Kumashiro et al. | 430/567 |
| 4,695,529 | 9/1987 | Abe et al. | 430/567 |
| 4,705,743 | 11/1987 | Mihayashi et al. | 430/385 |
| 4,713,318 | 12/1987 | Sugimoto et al. | 430/567 |
| 4,728,602 | 3/1988 | Shibahara et al. | 430/569 |
| 4,748,105 | 5/1988 | Kadota et al. | 430/393 |
| 4,762,778 | 8/1988 | Yamazaki et al. | 430/567 |

FOREIGN PATENT DOCUMENTS

| | | |
|---|---|---|
| 0110633 | 6/1984 | European Pat. Off. . |
| 0111919 | 6/1984 | European Pat. Off. . |
| 0112162 | 6/1984 | European Pat. Off. . |
| 0121435 | 10/1984 | European Pat. Off. . |
| 0151305 | 8/1985 | European Pat. Off. . |
| 3209995 | 9/1982 | Fed. Rep. of Germany . |
| 3426656 | 2/1985 | Fed. Rep. of Germany . |
| 3518257 | 11/1985 | Fed. Rep. of Germany . |
| 2376437 | 7/1978 | France . |

OTHER PUBLICATIONS

Patent Abstracts of Japan, vol. 10, No. 250 (p-491) [2306], Aug. 28, 1986, p. 55 P 491; & JP-A-61 77 847 (Konishiroku Photo Ind Co Ltd) 21-04-1986—*Abstract*.

Research Disclosure, vol. 183, Jul. 1979, p. 392, disclosure No. 18359; Industrial Opportunities Ltd, Havant, Hampshire, GB; "Processing method for silver halide color photosensitive material" Formulae (II),(III).

Patent Abstracts of Japan, vol. 5, No. 84 (p-64) [756]; & JP-A-56 32 140 (Konishiroku Shashini Kogyo K.K.) 01-04-1981—*Abstract*.

Patent Abstracts of Japan, vol. 6, No. 30 (p-103) [908], Feb. 23, 1982; & JP-A-56 149 030 (Konishiroku Shashin Kogyo K.K.) 18-11-1981—*Formulae (1), (3)*.

Patents Abstracts of Japan, vol. 6, No. 225 (P-154) [1103], Nov. 10, 1982; & JP-A-57 125 939 (Fuji Film K.K.) 05-08-1982—*Formulae (i02),(67)*.

Patent Abstracts of Japan, vol. 9, No. 105 (P-354) [1828], May 9, 1985; & JP-A-59 228 248 (Konishiroku Shashin Kogyo K.K.) 21-12-1984—*Formulae (6),(a),(f)*.

Patent Abstracts of Japan, vol. 9, No. 232 (P-389) [1955], Sep. 18, 1985; page 43 P 389; & JP-A-60 86 544 (Konishiroku Shashin Kogyo K.K.) 16-05-1985 *Formulae (I-6), (I-7), (I-13)*.

Patent Abstracts of Japan, vol. 10; No. 19 (P-423) [2076], Jan. 24, 1986; & JP-A-60 173 546 (Fuji Shashin Film K.K.) 06-09-1985 *Formulae (II-1), (II-3), (II-4), (II-6)-(II-27)*.

*Primary Examiner*—Hoa Van Le

*Attorney, Agent, or Firm*—Frishauf, Holtz, Goodman & Woodward

[57] ABSTRACT

Disclosed is a method of processing a light-sensitive silver halide color photographic material comprising; subjecting to exposure a light-sensitive silver halide color photographic material comprising a support; a light-sensitive silver halide emulsion layer containing at least one of a core/shell silver halide grain containing 3.0 mole % or more of silver iodide and a tabular silver halide grain containing 3.0 mole % or more of silver iodide; and a compound capable of releasing at a developing processing a restrainer or restrainer precursor which forms silver salt having the solubility product with a silver ion, of $1\times10^{-9}$ or less, and thereafter; carrying out a color developing processing by using a color developing solution containing an aromatic primary amine type color developing agent, for a period of 120 seconds or less and so as to have a value of (developed silver amount at the maximum density portion) / (total silver amount), of 0.5 or less.

The method of processing a light-sensitive silver halide color photographic material according to this invention can accomplish improvements of graininess and sharpness, and also prevention of surface-peeling of the light-sensitive silver halide color photographic material and scratch of an emulsion surface during the processing.

17 Claims, No Drawings

METHOD OF PROCESSING LIGHT-SENSITIVE SILVER HALIDE COLOR PHOTOGRAPHIC MATERIAL HAVING HTREE MOLE % SILVER IODINE CORE/SHELL OR TABULAR HALIDE GRAINS

This application is a continuation of application Ser. No. 07/233,841, filed Aug. 17, 1988, now abandoned which is a continuation of application Ser. No. 06/934,014 filed Dec. 22, 1986 (abandoned).

BACKGROUND OF THE INVENTION

This invention relates to a method of processing a light-sensitive silver halide color photographic material, and, more particularly, it relates to a method of processing a light-sensitive silver halide color photographic material, that can reduce graininess, can improve sharpness, and also can prevent the light-sensitive silver halide color photographic material from being surface-peeled and the emulsion surface from being scratched during the processing.

In general, light-sensitive silver halide color photographic materials comprise a substrate provided by coating on its surface with three kinds of photographic silver halide emulsion layers selectively subjected to spectral sensitization so as to have sensitivities to blue light, green light and red light. For example, light-sensitive silver halide photographic materials for color negative are generally provided by coating with a blue-sensitive silver halide emulsion layer, a green-sensitive silver halide sensitive layer and a red-sensitive silver halide emulsion layer in this order from the side to be exposed, and, between the blue-sensitive silver halide emulsion layer and the green-sensitive silver halide emulsion layer, a yellow filter is usually provided in order to absorb the blue light transmitting through the blue-sensitive silver halide emulsion layer. It is further practiced to provide intermediate layers between the respective emulsion layers for special purposes, and also a protective layer as an outermost layer. It is also known that these respective light-sensitive silver halide emulsion layers can be provided in the order other than the above-mentioned, and it is further known that two or more layers of light-sensitive silver halide emulsion layers having sensitivity to the light of each color in substantially the same wavelength regions and having different sensitivities can be used as the respective silver halide emulsion layers. In these light-sensitive silver halide color photographic materials, an aromatic primary amine type color developing agent, for example, is used as a color developing agent to develop exposed silver halide grains, to form dye images by the reaction of an oxidized product of the color developing agent with a dye forming coupler. In such a method, usually, phenol or naphthol type couplers, 5-pyrazolone type, pyrazolinobenzimidazole type, pyrazolotriazole type, indazolone type or cyanoacetyl type magenta couplers, and acylacetamide type yellow couplers are respectively used for the formation of the cyan, magenta and yellow dye images. These dye forming couplers are contained in light-sensitive silver halide emulsion layers or in a developing solution. This invention is suitable as a method of processing a light-sensitive silver halide color photographic material containing the couplers in silver halide emulsion layers in the previously non-dispersed form.

Recent years, it has been practiced to miniaturize the image size of films and hence miniaturize a camera to enhance the portability, but, as well known, this may cause poorness of print images. Namely, as a picture size of a light-sensitive color photographic material is made smaller, the enlargement magnification becomes larger when a print is produced in a same size, and therefore, in proportion thereto, the graininess or the sharpness of printed images becomes poor. Accordingly, it is required to improve the graininess, resolution and sharpness of films in order to obtain good prints even when a camera has been miniaturized.

Of these, as techniques for improving the graininess, techniques improved almost only by light-sensitive materials have been hitherto known and practically used, such as a method in which a high speed reactive coupler is used as described in Japanese Unexamined Patent Publication No. 62454/1980, a method in which the number of silver halide grains is increased as described in T. H. James "The Theory of the Photographic Process", 4th Ed. pp.620–621; a method in which used is a non-diffusible coupler capable of forming a diffusible dye wherein a dye spreads in the desired degree by reacting with an oxidized product of a color developing agent; a method in which the silver iodide content is made to be 8 mole % or more as described in Japanese Unexamined Patent Publication No. 128443/1985; and other methods described in Japanese Unexamined Patent Publications No. 191036/1984, No. 3628/1985, No. 128440/1985, etc.

On the other hand, core/shell emulsions have been recently developed as a silver halide emulsion having a high sensitivity, whose grains have been made finer and silver is so effectively utilized as to meet the requirement of resource protection. One of them is monodispersed core/shell emulsion prepared by utilizing a preliminary silver halide emulsion as a seed of crystal, and laminating successive precipitates on it one and another while controlling intentionally the formulation of the respective precipitates or the progress environment. Including a core/shell type high sensitivity emulsion wherein the core contains silver iodide, these core/shell emulsions are found to have very desirable high sensitivity and other photographic performances.

In particular, as a result of studies made by the present inventors, a light-sensitive color photographic material containing a core/shell silver halide grains containing 3.0 mole % or more of silver iodide is found to have insufficient graininess. Especially, the graininess to be achieved when the size has been small-formatted is a technical subject for an improvement to be made a great deal.

Similarly, as an emulsion having a high sensitivity and useful for eliminating the defects conventionally involved, there have been developed a technique employing tabular silver halide grains as described in Japanese Unexamined Patent Publications No. 113930/1983, No. 113934/1983, No. 127921/1983, No. 108532/1983, etc.

According to this tabular grains technique, even if the number of light quantum captured by silver halide grains increases, the amount of silver to be used does not increase and also no poorness of images is caused. However, even when these tabular grains are used, the light-sensitive color photographic material containing a tabular silver halide grains containing 3.0 mole % or more of silver iodide can not have sufficient graininess. Especially, the graininess to be achieved when the size has been small-formatted is a performance to be improved. In particular, the defect in the graininess of a light-sensitive silver halide color photographic material having been extremely small-formatted as in the case of a so-called disk film obstructs the spread of the same.

The technique to improve graininess is generally carried out by designing the layer constitution of a light-sensitive silver halide color photographic material as described in Japanese Patent Publication No. 15495/1974, Japanese Unexamined Patent Publications No. 7230/1978, etc., but it is not sufficient and required to be further improved.

SUMMARY OF THE INVENTION

Accordingly, the present inventors have made intensive studies on a processing method that can attain both the protection of silver resource and the high sensitivity and can improve the graininess of a high sensitivity grain type high sensitive light-sensitive silver halide color photographic material. As a result, they found that the improvement can be achieved by a technique comprising;

subjecting to exposure a light-sensitive silver halide color photographic material comprising a support; a light-sensitive silver halide emulsion layer containing at least one of a core/shell silver halide grain containing 3.0 mole % or more of silver iodide and a tabular silver halide grain containing 3.0 mole % or more of silver iodide; and a compound capable of releasing at a developing processing a restrainer or restrainer precursor which forms silver salt having the solubility product with a silver ion, of $1\times10^{-9}$ or less, and thereafter;

carrying out a color developing processing by using a color developing solution containing an aromatic primary amine type color developing agent, for a period of 120 seconds or less and so as to have a value of (developed silver amount at the maximum density portion)/(total silver amount), of 0.5 or less.

The present inventors have made further studies on the above technique. As a result, they found that, while retaining the graininess improvement effect in the above technique, the surface-peeling and scratching of a photographic constituent layer can be prevented when a processing solution immersion time of said material in processing solutions from said color developing step to a processing step with a final processing solution is 540 seconds or less.

The present inventors further found that the sharpness after development can be improved by providing the above light-sensitive silver halide color photographic material with a red light-sensitive silver halide emulsion layer containing a phenol type cyan coupler having a ureido group.

DESCRIPTION OF THE PREFERRED EMBODIMENTS

Preferred embodiments of this invention are;

(1) that the compound capable of releasing a restrainer (hereinafter often "restrainer releasing compound") according to this invention is a DIR compound;

(2) that the color developing processing is carried out at a temperature of 43° C. or more, preferably 48° C. or more;

(3) that the core/shell emulsion used in this invention is constituted of a core substantially comprising silver halide including silver iodide, and a shell substantially comprising silver bromide, silver chloride, silver chlorobromide or silver iodobromide or a mixture of these and also having a thickness of 0.01 to 0.5 μm;

(4) that a processing step following the color developing is carried out by using an aqueous solution having a specific gravity of 1.1 or more;

(5) that a processing step following the color developing is carried out by using a bleach-fixing solution;

(6) that a step of washing with water is substantially not included;

(7) that a processing by a water washing substitutive stabilizing solution is included; and (8) that the phenol type cyan coupler having a ureido group (hereinafter called "the cyan coupler of this invention" ) is a compound represented by Formula (I) or Formula (II) shown herein later.

Formula (I)

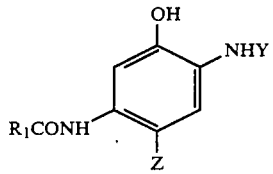

Formula (II)

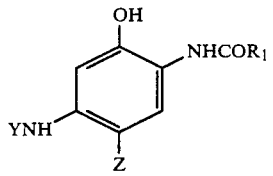

wherein $R_1$ represents an alkyl group, an alkenyl group, a cycloalkyl group, an aryl group or a heterocyclic group; Y represents a group represented by;

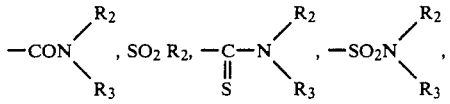

$-CONHCOR_2$ or $-CONHSO_2R_2$, wherein $R_2$ represents an alkyl group, an alkenyl group, a cycloalkyl group, an aryl group or a heterocyclic group, and $R_3$ represents a hydrogen atom or the group represented by $R_2$, and $R_2$ and $R_3$ may be the same or different and may be linked to each other to form a 5- or 6-membered hetero ring; and Z represents a hydrogen atom or a group eliminable at the coupling reaction with an oxidized product of an aromatic primary amine type color developing agent.

As a result of studies on the processing method that can solve the above-mentioned technical subjects, the present inventors found that the graininess of the light-sensitive silver halide color photographic material can be improved, in a method of processing a light-sensitive silver halide color photographic material containing the core/shell silver halide grains of the invention and/or the tabular silver halide grains of the invention, by having the light-sensitive silver halide color photographic material incorporated with a compound capable of releasing a restrainer, and at the same time carrying out a color developing processing for a period of 120 seconds or less and so as to have a value of (developed silver amount at the maximum density portion) (total silver amount), of 0.5 or less, preferably 0.1 to 0.3. This value is a value concerning the silver halide layer containing core/shell silver halide grain of this invention. In order to maintain the value 0.5 or less, there are used many conventional methods which controls, for example, a constitution of silver halide in the emulsion, a thickness of coated light-sensitive material, developing time, developing temperature, a constitution of the developing solution, and the like.

Moreover, they found that the surface-peeling and scratching of a photographic constituent layer can be prevented when an immersion time of said material in processing solutions from the color developing step to a processing step with a final processing solution is 540 seconds or less. They also found a surprising fact that, more preferably, the sharpness can be improved by processing the material with processing solutions in 540 seconds or less of an immersion time starting from the color developing processing and ending with a processing with a final processing solution, or by incorporating the cyan coupler of this invention into a red-sensitive silver halide emulsion layer. This invention is particularly advantageous when used for light-sensitive color photographic materials having been small-formatted as in the case of disc films.

The cyan coupler of this invention is known as disclosed in, for example, U.S. Pat. Nos. 3,222,176, 3,446,622 and 3,996,253, British Patent No. 1,011,940; Japanese Unexamined Patent Publications No. 21139/1972, No. 65134/1981, No. 20454/1982, No. 204544/1982, No. 24547/1985, No. 35731/1985 and No. 37557/1985; etc., but it has not been known at all and was surprising that the sharpness can be improved in association with a developing processing time.

A most preferred embodiment of the photographic material to be processed according to this invention is that the red-sensitive silver halide emulsion layer containing the cyan coupler of this invention contains the core/shell silver halide grains and/or the tabular silver halide grains, and said red-sensitive silver halide emulsion layer and/or an adjacent layer thereto contains the restrainer releasing compound.

When the red-sensitive silver halide emulsion layer comprises layers separated into two or more layers (a non-light-sensitive intermediate layer or layers may be present between the thus separated red-sensitive silver halide emulsion layers), for example, when it is constituted of two or more red-sensitive silver halide emulsion layers having different sensitivities from each other, at least one of the red-sensitive silver halide emulsion layers may contain the cyan coupler of this invention, but, preferably, all of the red-sensitive silver halide emulsion layers should contain the cyan coupler of this invention.

In the present specification, the developed silver amount at the maximum density portion is meant to be the developed silver amount determined when a color developing is carried out with an exposure amount of 16 CMS (candela meter second) according to the method described on page 337 in "Basic Photographic Engineering" (Volume for Silver Salts, edited by Japan Photographic Society).

In the above, $CMS = \frac{Cd \times S \times T}{M^2}$ wherein Cd: Luminous intensity of an electric lamp (Candela);

S: Exposure time (second);

T: Transmittance of a filter; and

M: Distance (m).

In the light-sensitive emulsion layers of the light-sensitive silver halide color photographic material to be processed according to this invention, at least one layer thereof may contain the core/shell silver halide grains of the invention and/or the tabular silver halide grains of the invention.

The color developing processing is carried out in 120 seconds or less, but preferably carried out at 43° C. or more in 120 seconds or less, more preferably at 48° C. or more in 90 seconds or less, most preferably at 55° C. or more in 60 seconds or less. Processing for more than 120 seconds may result in no improvement effect of the graininess. In this invention, the developing processing is usually carried out in 120 seconds or less, preferably in 10 seconds or more, and more preferably in 20 seconds or more. Particularly, the processing time is more important than the temperature.

In the present specification, "an immersion time of said material in processing solutions from the color developing step to a processing step with a final processing solution is 540 seconds or less" means that the photographic material is processed in 540 seconds or less of the time starting when a light-sensitive silver halide color photographic material to be processed is immersed in a color developing solution, and, after being successively processed, finishing when the photographic material is taken out of a final processing using a processing solution (including water for washing with water or a rinsing solution). Usually, in the case of developing processing by using a so-called automatic processing machine, it refers to the time starting from color developing and ending at a step previous to a drying step. The final processing using a processing solution may be any of washing with water, processing with substitutive stabilizing solution, and final stabilizing. In this invention, however, it is preferable to carry out processing with substitutive stabilizing solution.

The light-sensitive material used in the processing according to this invention contains the core/shell silver halide grains and/or the tabular silver halide grains in at least one layer of the light-sensitive emulsion layers. There is no particular limitation for the core/shell silver halide grains used, but the following ones are particularly preferably used in the case of a high sensitivity light-sensitive color negative materials.

Namely, the light-sensitive material to which this invention can be advantageously applied is a light-sensitive material having an emulsion layer containing core/shell type grains containing 3.0 mole % or more of silver iodide and having the halogen formulation substantially comprising silver iodobromide.

The core/shell emulsion preferably used in this invention is described in detail in, for example, Japanese Unexamined Patent Publication No. 154232/1982, but preferable core/shell silver halide grains comprise a core having silver halide formulation comprising 0.1 to 40 mole %, more preferably 5 to 40 mole %, most preferably 8 to 35 mole % of silver iodide, and a shell comprising silver bromide, silver chloride, silver iodobromide or silver chlorobromide or a mixture of these.

Particularly preferably, the silver halide emulsion comprises a shell mainly comprised of 95 mole % or more of silver bromide. In this invention, preferable effects can be attained when the core comprises monodispersed silver halide grains and the shell has a thickness of 0.01 to 2.0 μm.

The light-sensitive silver halide color photographic material preferably used in the processing according to this invention comprises silver halide grains containing 3.0 mole % or more, preferably 3 to 40 mole %, more preferably 4 to 15 mole %, still preferably 5 to 10 mole % of silver iodide as a whole. Particularly, silver halide grains containing silver iodide as a core is used, and the silver halide grains comprising silver bromide, silver chloride, silver chlorobromide or silver iodobromide or a mixture of these are covered with use of the above shell having the prescribed thickness, to conceal the core, thereby making the most of the high sensitivity character of the silver halide grains containing silver iodide, and concealing disadvantageous characters of the grains. Speaking more specifically, the silver halide containing silver iodide is used in the core, and only the desirable characters inherent to the core is effectively exhibited, and also the shell having the strictly controlled range for the wall thickness necessary for concealing the undesirable behaviors is provided on the core. The system in which a core is covered with a shell having an absolute thickness necessary and minimum for effectively exhibiting the characters inherent to the core, is very advantageous in that it can be amplifyingly utilized also for the purpose, for example, of improving preservativity or improving adsorption rate of a sensitizing dye, if the purposes are changed and, accordingly, the materials for the core/shell emulsion are changed.

Preferably, the chief constituent silver iodide may be contained in the silver halide grains (core) in an amount ranging between 0.1 and 20 mole % corresponding to the range of from a solid solution to a mixed crystal, and more preferably in an amount ranging between 0.5 to 10 mole %. Also, the silver iodide contained may be distributed either unevenly or homogeneously in the core, but preferably the silver iodide may be partially present at the central portion.

The silver halide emulsion of this invention, having the core/shell silver halide grains, can be prepared by covering silver halide grains serving as cores, contained in the monodispersed emulsion, with shells. Here, the ratio of silver iodide to silver bromide in the case where the shell comprises silver iodobromide is preferably controlled to be 10 mole % or less.

When the core is comprised of the monodispersed silver halide grains, grains having desired size can be obtained by a double jet method while keeping constant the pAg. Also, in producing a highly monodispersed silver halide emulsion, the method described in Japanese Unexamined Patent Publication No. 48521/1979 can be used. In the method, a preferred embodiment is that the emulsion is produced by adding an aqueous solution of potassium iodobromide and gelatin and an ammoniacal aqueous solution of silver nitrate to an aqueous gelatin solution containing silver halide grains while varying the addition rate as a function of the time. In this occasion, the time function of the addition rate, pH, pAg, temperature and so forth can be arbitrarily selected to obtain the highly monodispersed silver halide emulsion.

Since the grain distribution in the monodispersed emulsion is in the state of almost regular distribution, the standard deviation thereof can be readily determined. Thus, when the width of distribution (%) is defined by the relation formula:

$$\frac{\text{Standard deviation}}{\text{Average grain size}} \times 100 = \text{Distribution width (\%)},$$

the emulsion may preferably have a monodispersity such that the distribution width fitted for meaningfully controlling the absolute thickness of the shell is 20% or less, preferably 10% or less.

Referring to the thickness of the shell which covers the core, it should be a thickness by which the desirable characters of the core may not be concealed, and on the contrary a thickness which is sufficient for concealing the undesirable characters of the core. In other words, the thickness is preferably controlled within such a narrow range defined by such an upper limit and lower limit. Such a shell can be formed by depositing a soluble halogen compound solution and a soluble silver solution on the monodispersed core according to a double jet method.

On the other hand, overly thin shell thickness may cause partial denudation of a ground containing silver iodide of the core, and may result in loss of the effect obtained by covering a shell on the surface, namely, the effect by chemical sensitization, and the performances such as rapid developing ability and fixing ability. Minimum limit of the thickness should preferably be 0.01 μm.

Upon confirmation by a highly monodispersed core having the distribution width of 10% or less, the shell thickness is preferably 0.01 to 0.4 μm, and most preferably it is 0.01 to 0.2 μm.

The increase in optical density due to sufficient formation of developed silver filaments, the sensitization effect resulted from utilization of the high sensitivity character of the core, and also the rapid developing ability and the fixing ability are attributed to a cooperative effect between the shell whose thickness has been controlled as described above and the silver halide formulation for the core and the shell. Accordingly, if the controlling of the shell thickness can be satisfied, there can be used silver iodobromide, silver bromide, silver chloride or silver chlorobromide or a mixture of these as the silver halide constituting the shell. Of these, in view of the fitness to the core, the performance stability or the storability, preferred is silver bromide, silver iodobromide or a mixture of these.

The light-sensitive material in this invention may include the light-sensitive material as described below. Namely, it is a light-sensitive material comprising negative type silver halide grains contained in at least one layer of light-sensitive silver halide emulsion layers, and having an inner nucleus substantially comprising silver bromide and/or silver iodobromide and a plurality of outer shells provided on the outer face of said inner nucleus and substantially comprising silver bromide and/or silver iodobromide; wherein an outermost shell of said silver halide grains has an iodine content of 10 mole % or less; a high iodine content shell having an iodine content 6 mole % or more higher than said outermost shell (hereinafter called "highly iodic shell") is provided at an inner side of said outermost shell; an intermediate shell having an iodine content intermediate between that in said outermost shell and that in said highly iodic shell is provided between these both shells; and said intermediate shell has an iodine content 3 mole or more higher than said outermost shell and said highly iodic shell has an iodine content 3% or more higher than said intermediate layer.

In the above, the terms "substantially comprising . . . " means that silver halides other than the silver iodobromide, such as silver chloride may be contained. Specifically speaking, in the case of silver chloride, it may be contained in the proportion of 1 mole % or less.

This light-sensitive material has characteristic features (1) to (4) below:

(1) An emulsion containing core/shell type silver halide grains having an highly iodic shell in the inside is used.

(2) An intermediate shell having an intermediate iodine content is provided between the highly iodic shell and a low iodic shell on the surface (i.e., the outermost shell).

(3) The highly iodic shell has an iodine content of 6 to 40 mole %, which is made 6 mole % or more higher than the outermost shell. (4) Difference between the iodine content of the intermediate layer and that of the outermost layer or the highly iodic shell is 3 mole % or more.

A triple layered core/shell emulsions described in Japanese Unexamined Patent Publication No. 35726/1985 can be also used in this invention. Further, core/shell emulsions described in Japanese Unexamined Patent Publications No. 177535/1984, No. 86659/1985, No. 138538/1985 can be also used in this invention.

The light-sensitive silver halide emulsion used in this invention may be doped with various metal salts or metal complex salts at the stage of forming the silver halide precipitates for the core and the shell, during the course of the growth of grains, or after completion of the growth of grains. For example, there can be used metal salts or metal complex salts of gold, platinum, palladium, iridium, rhodium, bismuth, cadmium, copper, etc. and a combination of any of these.

Excessive halogen compounds which may be produced at the preparation of the emulsion of this invention, or salts and compounds such as nitrate and ammonium which are by-produced or became unnecessary may be removed. Removing method that can be appropriately used may include a Nudel washing method, a dializing method or a dializing precipitation method which are conventionally used in usual emulsions.

The emulsion of this invention can also be subjected to various chemical sensitization methods applied in usual emulsions. Namely, chemical sensitization can be carried out by using chemical sensitizers such as active gelatin; precious metal sensitizers such as water soluble gold salt, water soluble platinum salt, water soluble palladium salt, water soluble rhodium salt and water soluble iridium salt; sulfur sensitizers; selenium sensitizers; and reduction sensitizers such as polyamine and stannous chloride, which can be used alone or in combination. Also, this silver halide emulsion can be optically sensitized to have a desired wavelength region. There is no particular limitation in the method of optically sensitizing the emulsion of this invention, which can be optically sensitized (e.g. supersensitization) by using alone or in combination, optical sensitizers such as cyan dyes and merocyanine dyes including zeromethine dye, monomethine dye, trimethine dye, etc. Techniques for practicing these are described in U.S. Pat. Nos. 2,688,545, 2,912,329, 3,397,060, 3,615,635 and 3,628,964; British Patents No. 1,195,302, No. 1,242,588 and No. 1,293,862; West German laid-open Patent Publications (OLS) No. 20 30 326 and No. 21 21 780; Japanese Patent Publications No. 4936/1968 and No. 14030/1969; etc. They can be arbitrarily selected depending on the objects and uses of light-sensitive materials, such as wavelength region to which the emulsion is to be sensitized, and sensitivity.

In the silver halide emulsion used in this invention, for forming silver halide grains contained therein, the silver halide emulsion whose core grains comprise monodispered silver halide grains is used, whereby a monodispersed silver halide emulsion having substantially uniform shell thickness can be obtained. Such a monodispersed silver halide emulsion may be used as it is, with its given grain size distribution, or may be used as a mixture by blending two or more of monodispersed emulsions having different mean grain size at a desired stage after formation of grains to give a predetermined gradient.

The silver halide emulsion used in this invention preferably contains the silver halide grains of the invention in all of the silver halide grains contained in the emulsion, in the proportion equal to or larger than the emulsion obtained by covering a monodispersed core having a distribution width of 20% or less, with a shell. However, silver halide grains other than this invention may be also contained so far as the effect of this invention is not suppressed. Such silver halide grains other than this invention may be of either a core/shell type other than this invention or a type other than the core/shell type, or either monodispersed or polydispersed. In the silver halide emulsion used in this invention, it is preferred that at least 65% by weight of the silver halide grains contained in the emulsion may constitute the core/shell silver halide grains of this invention, and it is desired that almost all of them may constitute the core/shell silver halide grains of this invention.

This invention may include an embodiment wherein the silver halide emulsion in at least one layer of the light-sensitive layers is an emulsion containing the tabular silver halide grains of this invention. In other words, in the emulsion of this invention used in the silver halide emulsion layer of this invention, any of the following embodiments may be included in the scope of this invention, i.e., the embodiments wherein the silver halide grains of the emulsion are (i) the above-described core/shell silver halide grains of this invention, (ii) the tabular silver halide grains of this invention (the tabular silver halide grains of this invention may be of either a core/shell type or a type other than that), and (iii) a mixture of the above (i) and (ii).

The tabular silver halide grains of this invention will be described below.

The tabular silver halide grains of this invention are preferably those having a grain diameter 5 times or more larger than the thickness of a grain. The tabular silver halide grains can be synthesized by ordinary methods as described in Japanese Unexamined Patent Publications No. 113930/1983, No. 113934/1983, No. 127921/1983 and No. 108532/1983, etc. In this invention, those having a grain diameter 5 times or more, preferably 5 to 100 times, particularly preferably 7 to 30 times larger than the thickness of grain from the viewpoint of effects to color stain, image quality, etc.. There may be preferably used those having a grain diameter of 0.3 μm or more, and particularly preferably of 0.5 to 6 μm. The effect aimed at in this invention can be preferably exhibited when these tabular silver halide grains are contained in the silver halide emulsion in at least one layer, in an amount of at least 50% by weight. Particularly preferable effect can be exhibited when almost all of them comprises the above tabular silver halide grains.

This invention is particularly useful when the tabular silver halide grains of this invention comprise core/shell grains. When they comprise the core/shell grains, they should preferably satisfy altogether the requirements set out for the above-described core and shell.

In general, the tabular silver halide grains are in the shape of a plate having two parallel faces, and accordingly the "thickness" referred to in this invention is represented by the distance between the two parallel faces constituting a tabular silver halide grain.

The halogen formulation of the tabular silver halide grains may preferably comprise silver bromide and silver iodobromide, particularly preferably silver iodobromide having a silver iodide content of 3 to 10 mole %.

A process for producing the tabular silver halide grains will be described below.

As the process for producing the tabular silver halide grains, it can be carried out by suitably combining the methods known in the present technical field.

For example, the tabular silver halide grains can be obtained by forming seed crystals comprising tabular silver halide grains present in an amount of 40% or more by weight, in an atmosphere of a relatively high pAg value of pBr 1.3 or less, and allowing the seed crystals to grow while simultaneously adding silver and a halogen solution, keeping the pBr value to an equal level.

During the course of grain growth, silver and halogen solution are preferably added so that any new crystal nucleus may not be produced.

The size of the tabular silver halide grains can be controlled by controlling temperature, selecting the kind or amount of a solvent, and controlling the addition rate of silver salt and halide used during the growth of grain, etc.

When the tabular silver halide grains are produced, a silver halide solvent can be optionally used to control grain size, grain shape (a diameter to thickness ratio, etc.), grain size distribution, and grain growth rate. The silver halide solvent may preferably used in an amount of $1\times10^{-3}$ to 1.0% by weight, particularly $1\times10^{-2}$ to $1\times10^{-1}$% by weight, of a reaction solution.

For example, it is possible to turn the silver halide grain size distribution into a monodispered state along with increase in the amount of the silver halide solvent used, whereby the growth rate can be accelerated. On the other hand, the thickness of a silver halide grain also tends to increase in proportion to the amount of the silver halide solvent used.

Usable silver halide solvent may include ammonia, thioethers and thioureas. With regard to thioethers, there can be made reference to U.S. Pat. Nos. 3,271,157, 3,790,387, 3,574,628, etc.

When producing the tabular silver halide grains of this invention, preferably employed is a process in which the addition rate, addition amount and addition concentration of a silver salt solution (for example, an aqueous $AgNO_3$ solution) and a halide solution (for example, an aqueous KBr solution), which are added for accelerating the growth of grains, are increased.

With regard to these procedures, there can be made reference to disclosures, for example, in British Patent No. 1,335,925, U.S. Pat. Nos. 3,672,900, 3,650,757 and 4,242,445; Japanese Unexamined Patent Publications No. 142329/1980 and No. 158124/1980; etc.

The tabular silver halide grains of this invention can be optionally subjected to chemical sensitization. As to the chemical sensitization method, there may be made reference to the description on the sensitization referred to in respect of the core/shell grains, but, particularly from a viewpoint of the save of silver, the tabular silver halide grains of this invention should be subjected to gold sensitization or sulfur sensitization, or combination of these.

In the layer containing the tabular silver halide grains of this invention, the tabular silver halide grains are preferably present in the proportion of 40% or more, particularly 60% or more, in weight ratio based on total silver halide grains in said layer.

The layer containing the tabular silver halide grains has preferably a thickness of 0.5 μm to 5.0 μm, particularly preferably 1.0 μm to 3.0 μm.

Coating weight (on one side) of the tabular silver halide grains may preferably be 0.5 $g/m^2$ to 6 $g/m^2$, particularly preferably 1 $g/m^2$ to 4 $g/m^2$.

There is no particular limitation for the other constituents, such as binders, hardeners, antifoggants, silver halide stabilizers, surface active agents, spectral sensitizing dyes, colors and ultraviolet absorbents, in the layer containing the tabular silver halide grains of this invention, and there may be made reference to, for example, the description in Research Disclosure, Vol. 176, pp.22–28 (December, 1978).

Constitution of a silver halide emulsion layer or layers present at an outer side (or surface side) of the layer containing the tabular silver halide grains of this invention (hereinafter referred to as an "upper silver halide emulsion layer") will be described below.

As silver halide grains used in the upper silver halide emulsion layer, there may be preferably used high sensitivity silver halide grains used in ordinary direct X-ray films.

The silver halide grains may preferably have a round shape or a polyhedral shape, or both of these in a mixed state. Particularly, it is preferred that polyhedral grains having a round grains and/or diameter/thickness ratio of 5 or less hold 60% or more (weight ratio) of the total.

The mean grain size may be preferably 0.1 μm to 3 μm, and can be enlarged optionally by using a solvent such as ammonia, thioethers and thioureas.

It is preferred that the silver halide grains have been made high sensitive according to gold sensitization or sensitization by other metals, reduction sensitization or sulfur sensitization, or, alternatively, sensitization by combination of two or more of these.

In respect of the other constituents in the upper emulsion layer, there is no particular limitation similarly to the layer containing the tabular silver halide grains, and there can be made reference to the description in the above Research Disclosure, Vol. 176.

The light-sensitive silver halide color photographic material to which the processing of this invention is applied may not be limited to the foregoing, and may contain light-sensitive materials containing tabular silver halide grains as shown below.

For example, there are disclosed in Japanese Unexamined Patent Publication No. 113930/1983 a multilayer light-sensitive color photographic material having dye forming units of two layer constitution comprising emulsion layers containing, in an upper layer, tabular silver halide grains having an aspect ratio of 8:1 or more; in Japanese Unexamined Patent Publication No. 113934/1983, a multi-layer light-sensitive color photographic material using in a green-sensitive layer and red-sensitive layer, a silver iodide or silver bromide emulsion containing tabular silver halide grains having an aspect ratio of 8:1 or more; and in Japanese Unexamined Patent Publication No. 113927/1983, a multi-layer color photographic material containing tabular silver halide grains having a lower silver iodide content in a central region than in a peripheral region and having an aspect ratio of 8:1 or more; further in Japanese Unexamined Patent Publication No. 55426/1984, a light-sensitive silver halide photographic material containing tabular silver halide grains having an aspect ratio of 3:1 or more and a specific sensitizing dye, which can be also used for color photography; and still further in Japanese Unexamined Patent Publication No. 111696/1985, a light-sensitive silver halide color photographic material containing tabular silver halide grains having an aspect ratio of 3:1 or more and chiefly comprising (111) face. The processing method of this invention can be applied also in respect of these light-sensitive silver halide color photographic materials.

It is also preferred that the emulsion of this invention contain epitaxy joined silver halide grains as described in Japanese Unexamined Patent Publication No. 103725/1978.

The restrainer releasing compound used in this invention will be described below.

The restrainer releasing compound of this invention may be contained in the layer which contains core/shell silver halide grain and/or tabular silver halide grain or in the other layers.

The restrainer releasing compound of this invention may be any of the compounds capable of releasing or dissolving out at a developing processing a restrainer which forms silver salt having the solubility product with a silver ion, of $1\times10^{-9}$ or less, but, in particular, preferably used are a DIR compound, a tetrazaindene derivative, and a 6-aminopurine derivative. Of these, particularly preferably used is the DIR compound as it particularly can give good results for achieving the objects of this invention. Besides the DIR compound, there may be also included in this invention the compounds capable of releasing the development restrainer accompanying with development; for example, those described in U.S. Pat. Nos. 3,297,445 and 3,379,529; West German laid-open Patent Publication (OLS) No. 24 17 914; Japanese Unexamined Patent Publications No. 15271/1977, No. 9116/1978, No. 123838/1984 and No. 127038/1984; etc.

The DIR compound used in this invention is a compound capable of releasing a development restrainer by reacting with an oxidized product of a color developing agent.

Such a DIR compound may typically include DIR couplers formed by introducing into an active site of a coupler a group capable of forming a compound having development restraining action when eliminated from the active site, and disclosed, for example, in British Patent No. 935,454, U.S. Pat. Nos. 3,227,554, 4,095,984 and 4,149,886, etc.

The above DIR couplers have a property that, when coupled with an oxidized product of a color developing agent, a mother nucleus of the coupler forms a dye and on the other hand releases a development restrainer. In this invention, there may be also included couplers that may release a development restrainer but do not form any dye when coupled with an oxidized product of a color developing agent, as disclosed in U.S. Pat. Nos. 3,652,345, 3,928,041, 3,958,993, 3,961,959 and 4,052,213; Japanese Unexamined Patent Publications No. 110529/1978, No. 13333/1979 and No. 161237/1980; etc.

Also included in this invention are so-called timing DIR compounds wherein a mother nuclei may form a dye or a colorless compound when reacted with an oxidized product of a color developing agent and on the other hand an eliminated timing group may release a development restrainer by an intramolecular nucleophilic substitution reaction or an elimination reaction, as described in Japanese Unexamined Patent Publications No. 145135/1979, No. 114946/1981 and No. 154234/1982.

There may be also included timing DIR compounds wherein the timing group as mentioned above is attached to a mother nucleus of coupler, forming a perfectly diffusible dye, when reacted with an oxidized product of a color developing agent, as described in Japanese Unexamined Patent Publications No. 160954/1983 and No.162949/1983.

According to this invention, more preferred DIR compounds can be represented by Formula (XI) and/or Formula (XII) shown below, and, among them, most preferred DIR compound is the compound represented by Formula (XII) shown below.

Formula (XI):

$$A_1\text{-}Z_1$$

In the formula, $A_1$ is a coupler component (compound) capable of being coupled with an oxidized product of an N-hydroxyalkyl substituted-p-phenylenediamine derivative color developing agent, including, for example, open chain ketomethylene compounds such as acylacetoanilides and acylacetic acid esters; dye forming couplers such as pyrazolones, pyrazolotriazoles, pyrazolinobenzimidazoles, indazolones, phenols and naphthols; and no dye forming coupling components such as acetophenones, indanones and oxazolones.

$Z_1$ in the above formula is a component (compound) eliminable by the reaction with the N-hydroxyalkyl substituted-p-phenylenediamine derivative color developing agent to restrain the development of silver halide, and preferred compounds may include heterocyclic compounds such as benztriazole and 3-octylthio-1,2,4-triazole, and heterocyclic mercapto compounds (wherein heterocyclic mercapto group may include an i-phenyltetrazolylthio group and the like).

The above heterocyclic group may include a tetrazolyl group, a thiadiazolyl group, an oxadiazolyl group, a thiazolyl group, an oxazolyl group, an imidazolyl group, a triazolyl group, etc. Specifically, it includes a 1-phenyltetrazolyl group, a 1-ethyltetrazolyl group, a 1-(4-hydroxyphenyl)tetrazolyl group, a 1,3,4-thiazolyl group, a 5-methyl-1,3,4-oxadiazolyl group, a benzthiazolyl group, a benzoxazolyl group, a benzimidazolyl group, a 4H-1,2,4-triazolyl group, etc.

In the above Formula (XI), $Z_1$ is attached to an active site of $A_1$.

Formula (XII):

$$A_2\text{-TIME-}Z_2$$

In the formula, $Z_2$ has the same meaning as defined for $Z_1$ in the above Formula (XI). $A_2$ also has the same meaning as defined for $A_1$ in Formula (XI), and may include coupler components forming perfectly diffusible dyes. TIME represents a timing group which, being reacted with an oxidized product of a color developing agent, is eliminable from the same compound represented by Formula (XII) together with $Z_2$ and thereafter can release $Z_2$. TIME is represented by Formulae (XIII), (XIV), (XV), (XVI) and (XVII), but by no means limited to these.

Formula (XIII)

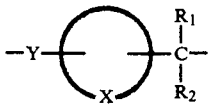

In the formula, X represents a group of atoms necessary for completion of a benzene ring or a naphthalene ring. Y represents

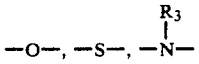

wherein $R_3$ represents a hydrogen atom, an alkyl group or an aryl group) and attached to the coupling position of $A_2$. $R_1$ and $R_2$ each represent the group having the same meaning as defined for the above $R_3$, provided, however, that the group

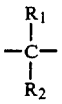

is substituted on the position ortho or para to Y, and attached to the hetero atom contained in the restrainer $Z_2$.

Formula (XIV)

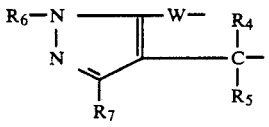

In the formula, W is a group having the same meaning as defined for Y in the above Formula (XIII), and $R_4$ and $R_5$ each are also a group having the same meaning as defined for $R_1$ and $R_2$ in Formula (XIII). $R_6$ represents a hydrogen atom, an alkyl group, an aryl group, an acyl group, a sulfo group, an alkoxycarbonyl group, a heterocyclic residual group; and $R_7$ represents a hydrogen atom, an alkyl group, an aryl group, a heterocyclic residual group, an alkoxy group, an amino group, an acylamido group, a sulfonamide group, a carboxyl group, an alkoxycarbonyl group, a carbamoyl group or a cyan group. The timing group is attached to the coupling position of $A_2$ through W, and attached to the hetero atom in the restrainer $Z_2$ through the group

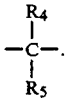

An example of the timing group capable of releasing the restrainer $Z_2$ by the intramolecular nucleophilic substitution reaction is shown below by Formula (XV).

Formula (XV)

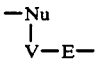

In the formula, Nu represents a nucleophilic group having an oxygen, sulfur or nitrogen atom rich in electrons, and is attached to the coupling position of $A_2$. E represents an electrophilic group having a carbonyl, thiocarbonyl, phosphinyl or thiophosphinyl group insufficient in electrons, and is attached to the hetero atom of the restrainer $Z_2$. V is a coupling agent which connects Nu and E in a steric fashion, and, after elimination of Nu from $A_2$, undergoes an intramolecular nucleophilic substitution reaction accompanied with the formation of a 3-membered ring to 7-membered ring, and thereby capable of releasing the restrainer $Z_2$.

Formula (XVI)

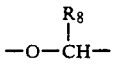

In the formula, $R_8$ represents a hydrogen atom, an alkyl group or an aryl group; the oxygen atom is attached to the coupling position of the coupler $A_2$; and the carbon atom is attached to a nitrogen atom of $Z_2$.

Formula (XVII)

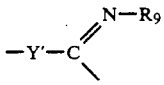

In the formula, Y' represents a group having the same meaning as defined for Y in the above Formula (XIII); $R_9$ represents an alkyl group, an aralkyl group, an aryl group or a hetero ring, and is attached to the coupling position of the coupler $A_2$ through Y' and also attached to the hetero atom of the restrainer $Z_2$ through the carbon atom.

Typical examples of the DIR compounds according to this invention are shown below, but this invention is by no means limited by these.

[Exemplary Compounds]

(D-1)

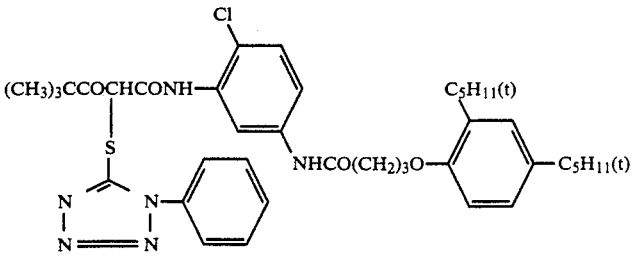

-continued
(D-2)
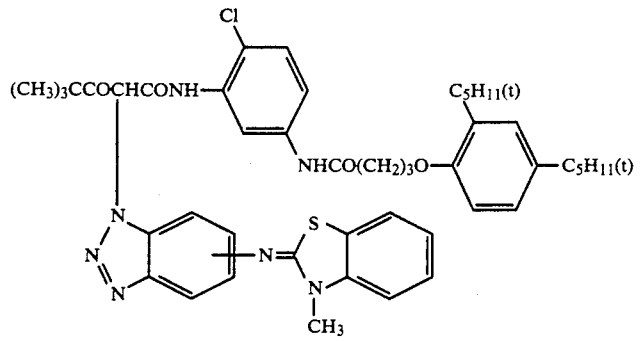
(D-3)
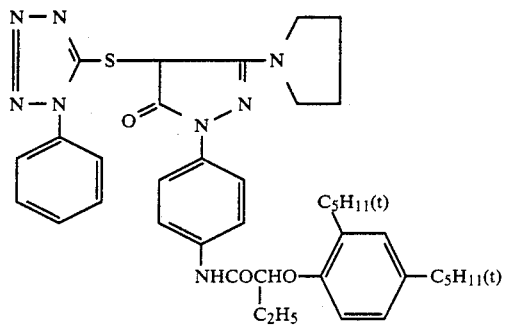
(D-4)
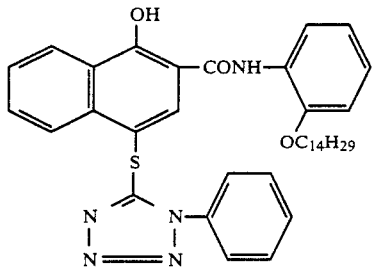
(D-5)
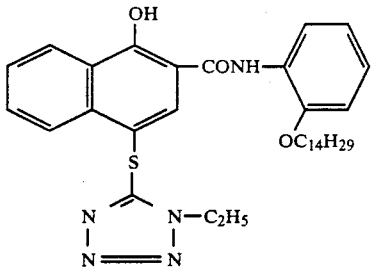
(D-6)
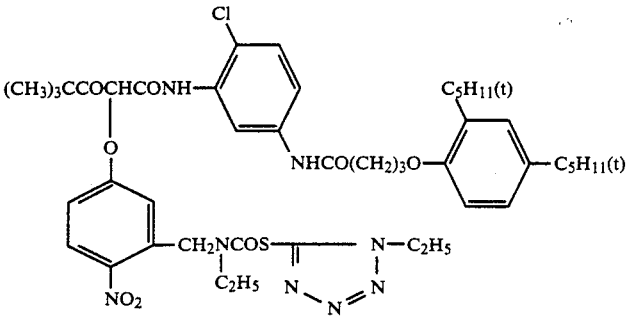

-continued
(D-7)
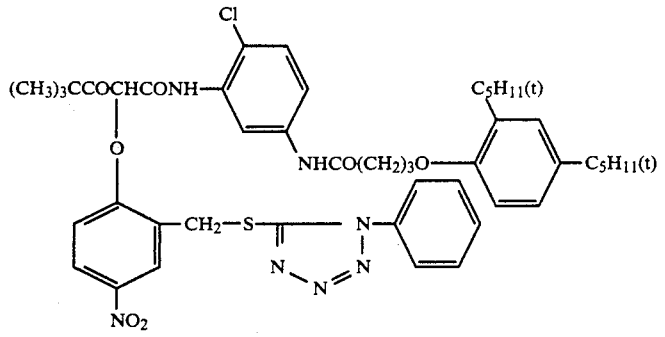
(D-8)
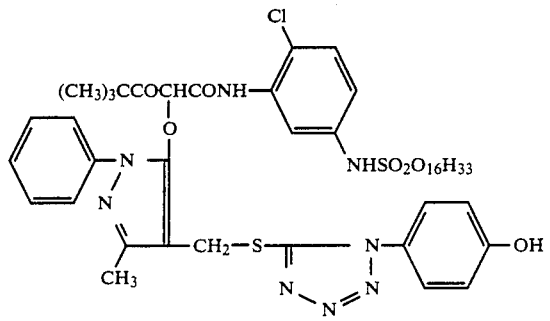
(D-9)
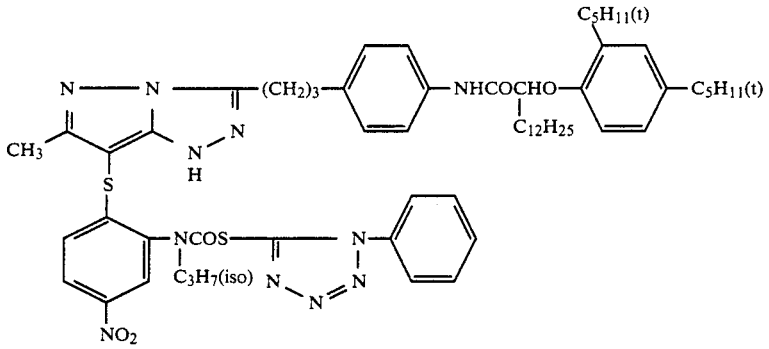
(D-10)
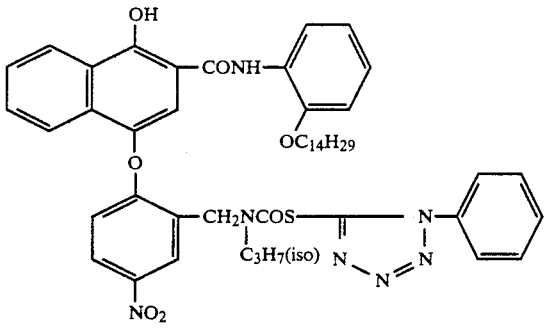
(D-11)
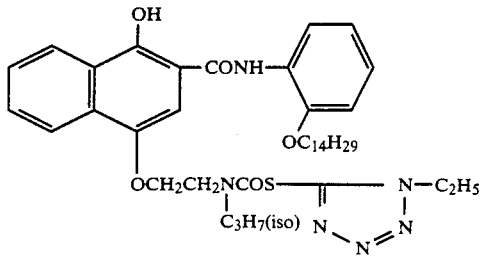

-continued
(D-12)
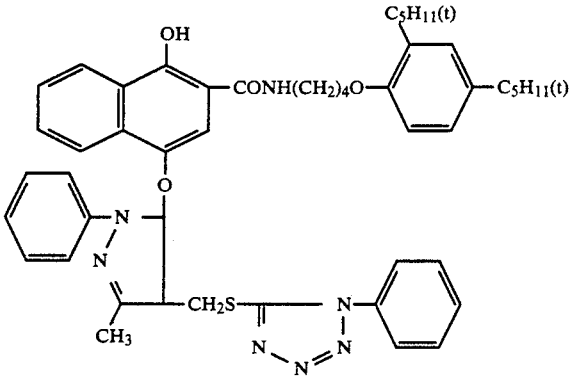
(D-13)
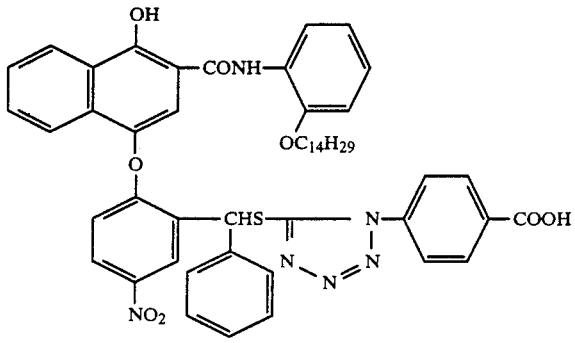
(D-14)
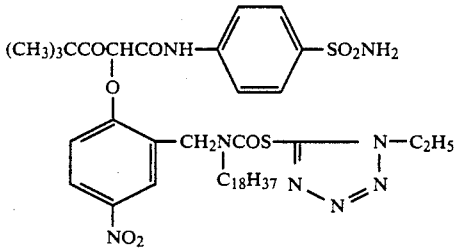
(D-15)
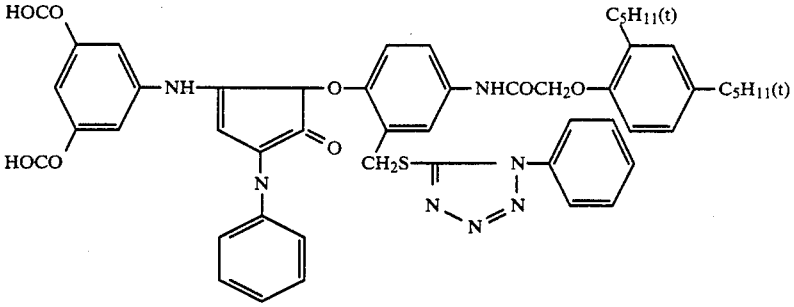
(D-16)
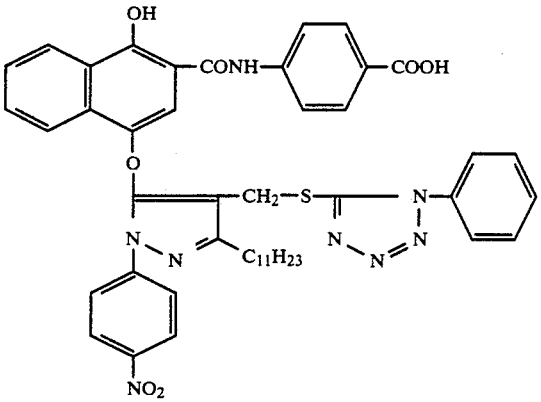

-continued
(D-17)
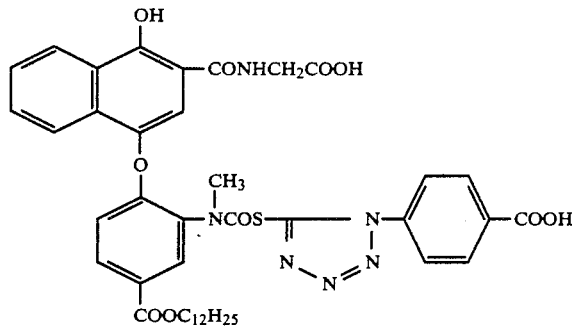
(D-18)
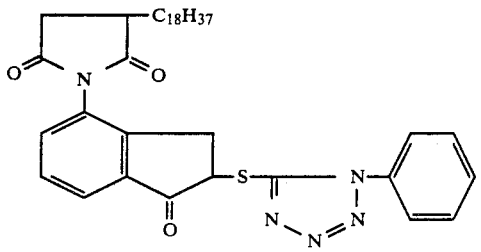
(D-19)
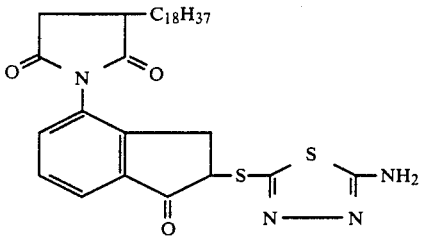
(D-20)
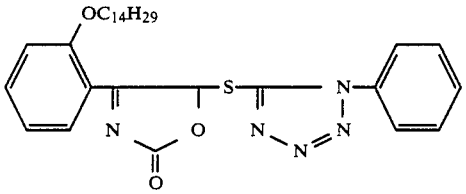
(D-21)
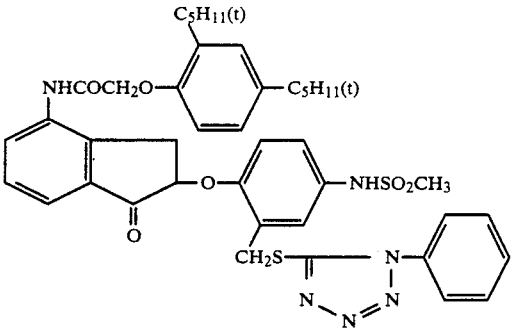
(D-22)
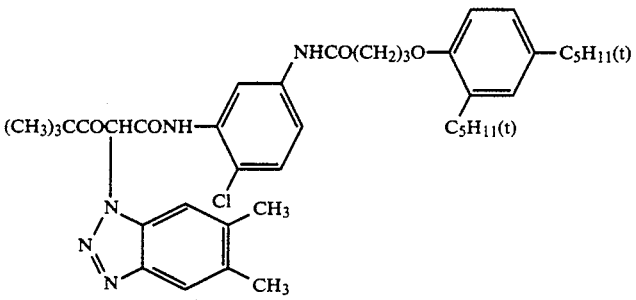

-continued
(D-23)
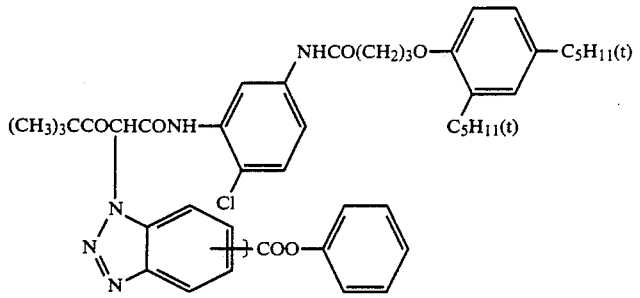
(D-24)
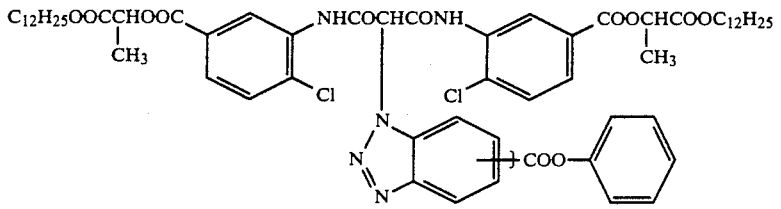
(D-25)
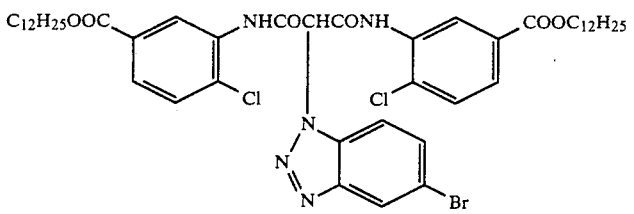
(D-26)
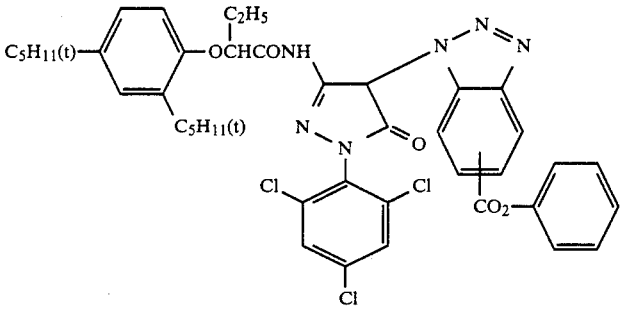
(D-27)
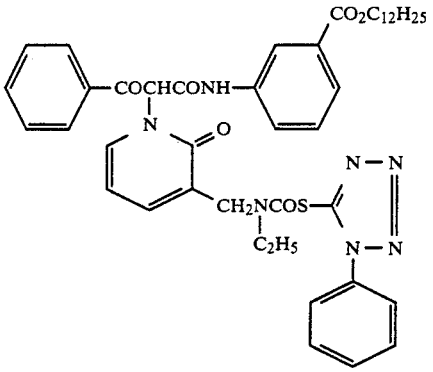
(D-28)
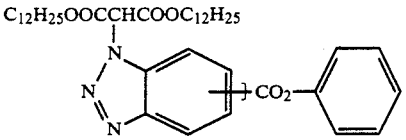

-continued
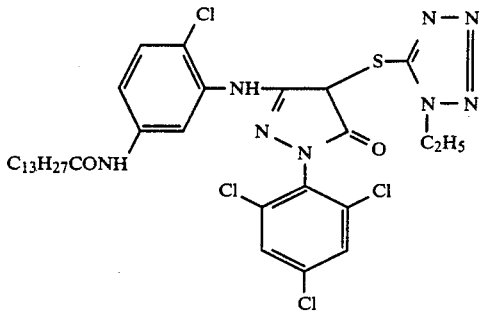
(D-29)
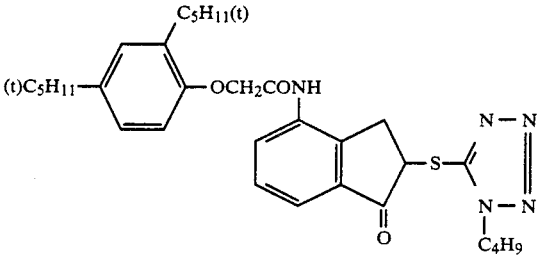
(D-30)
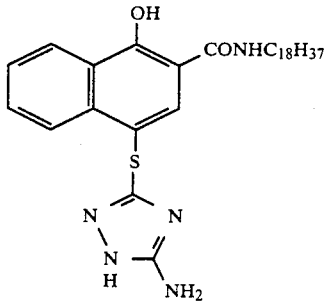
(D-31)
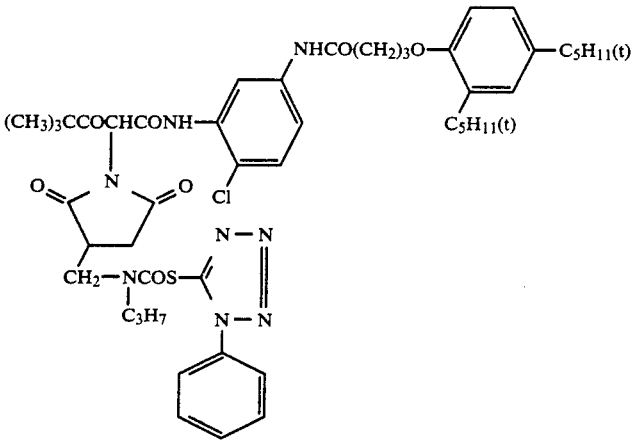
(D-32)

-continued
(D-33)
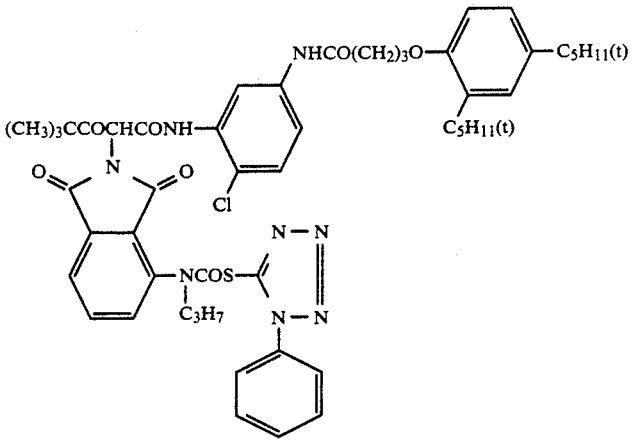
(D-34)
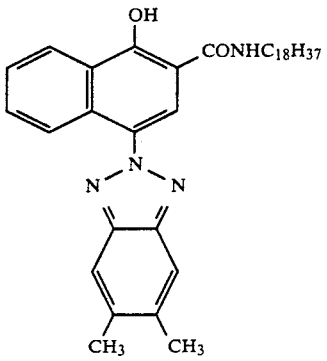
(D-35)
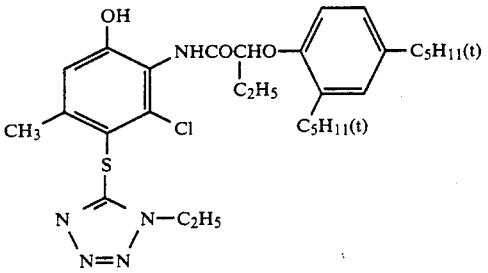
(D-36)
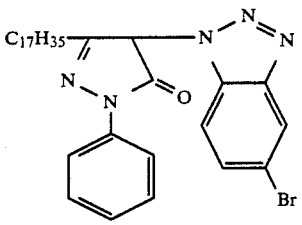
(D-37)
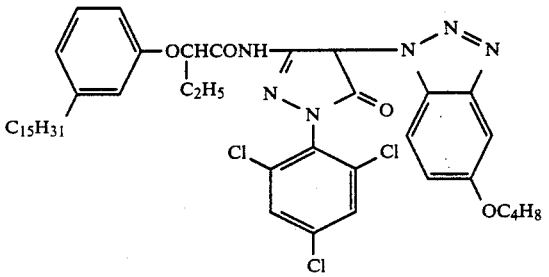

-continued
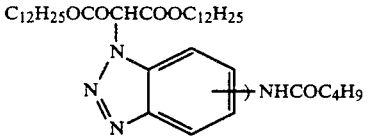
(D-38)
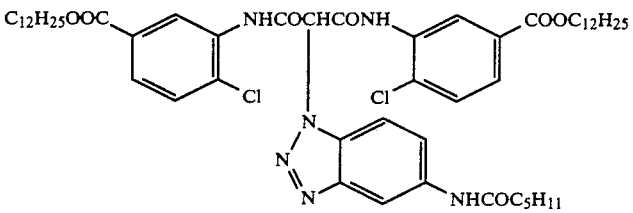
(D-39)
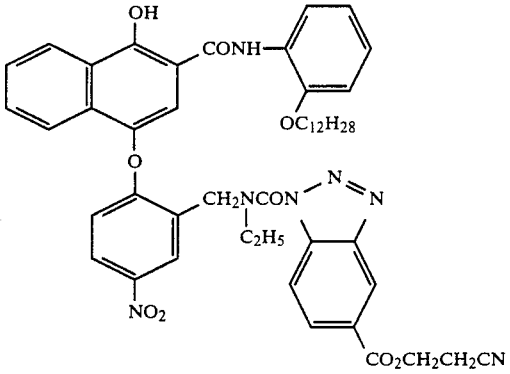
(D-40)
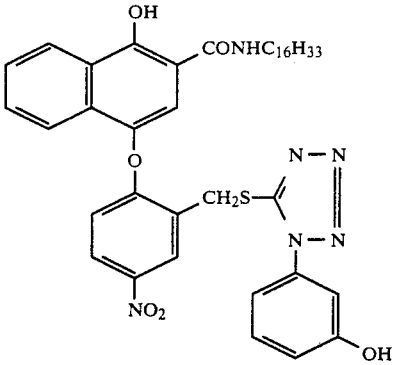
(D-41)
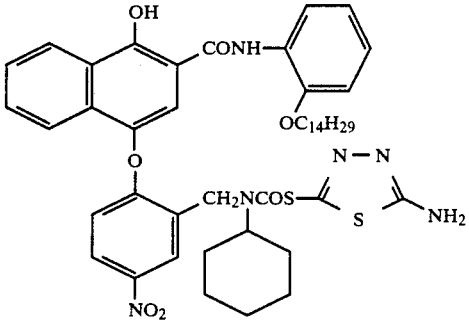
(D-42)

-continued
(D-43)
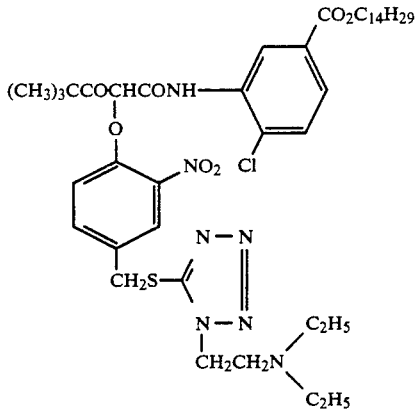
(D-44)
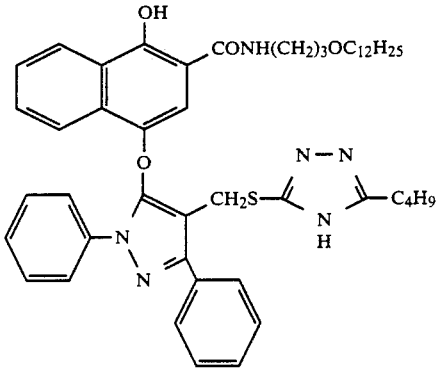
(D-45)
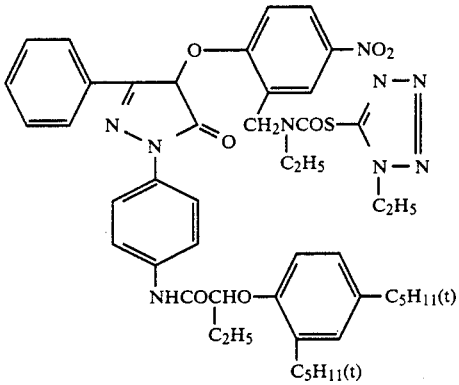
(D-46)
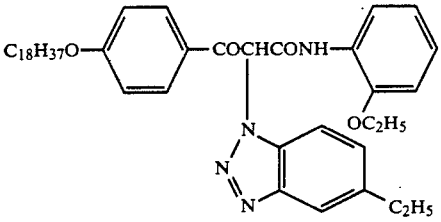
(D-47)
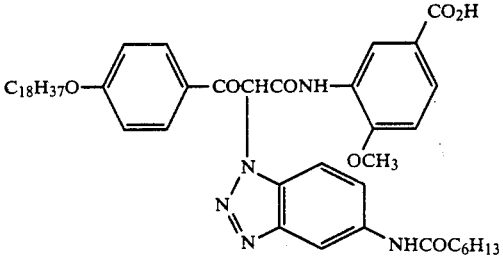

-continued
(D-48)
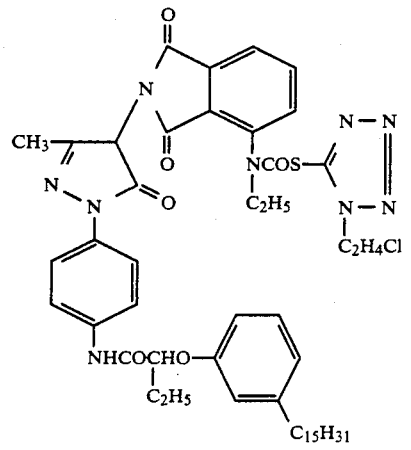
(D-49)
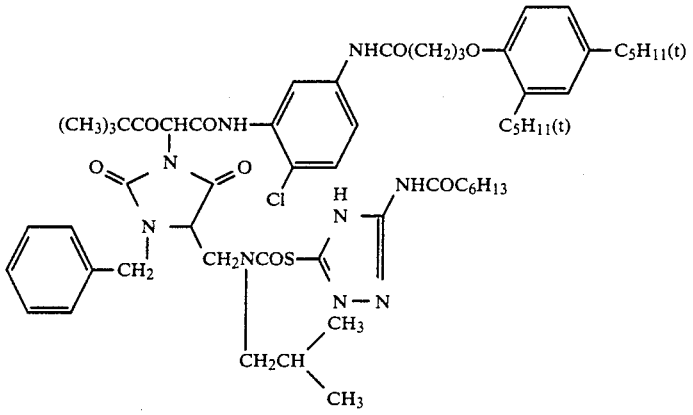
(D-50)
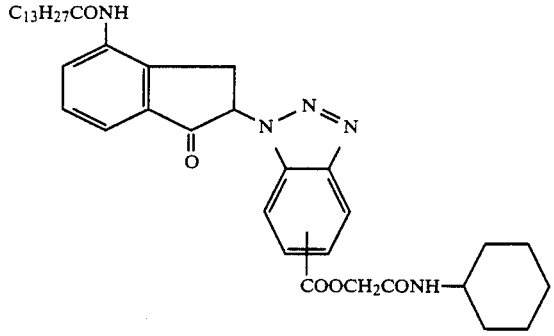
(D-51)
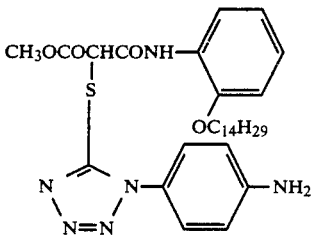

-continued
(D-52)
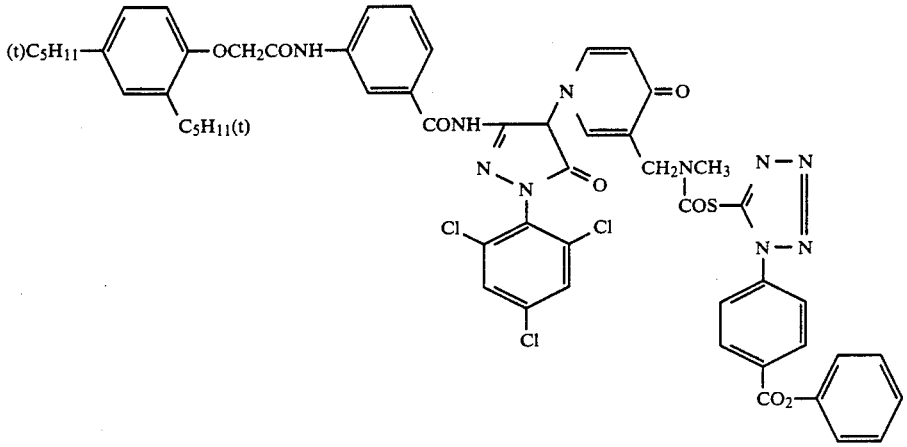
(D-53)
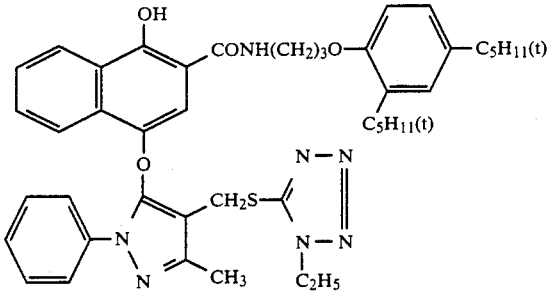
(D-54)
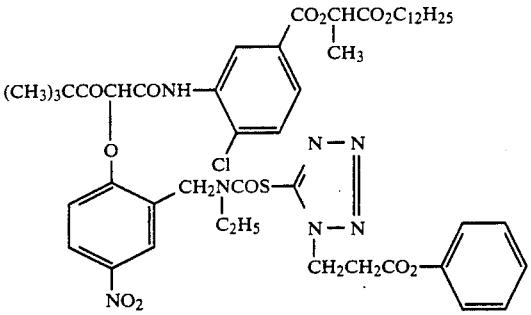
(D-55)
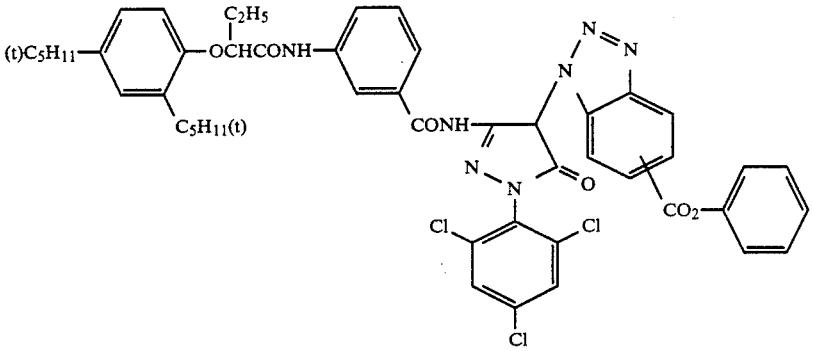

-continued
(D-56)
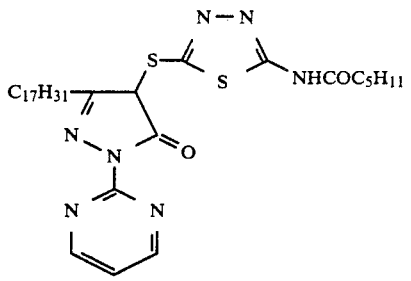
(D-57)
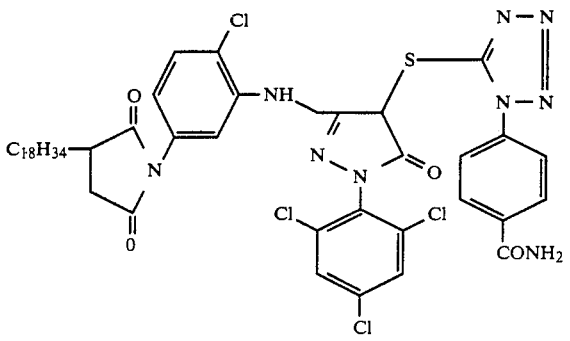
(D-58)
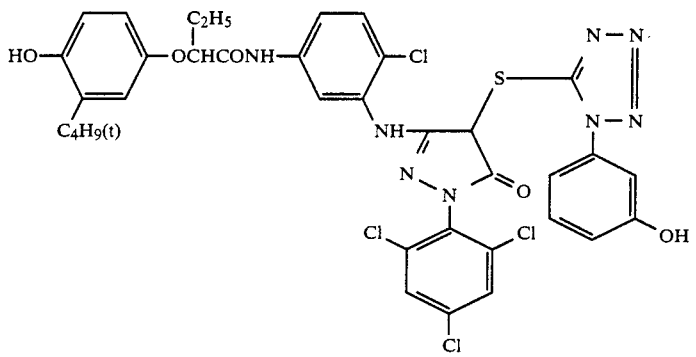
(D-59)
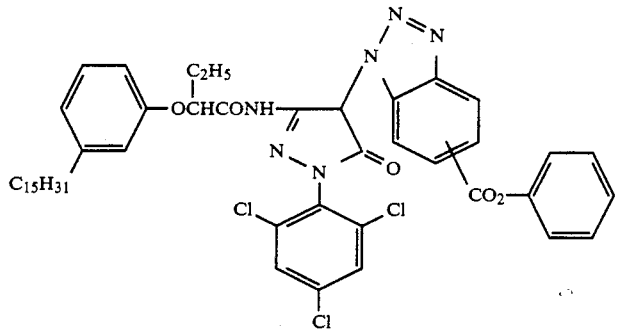
(D-60)
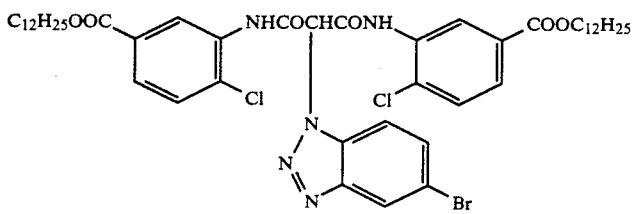

-continued
(D-61)
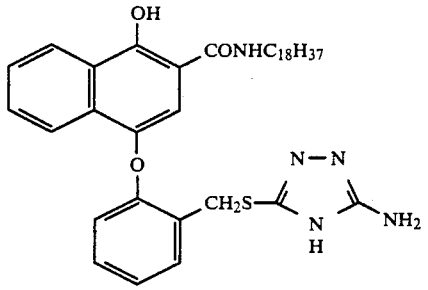
(D-62)
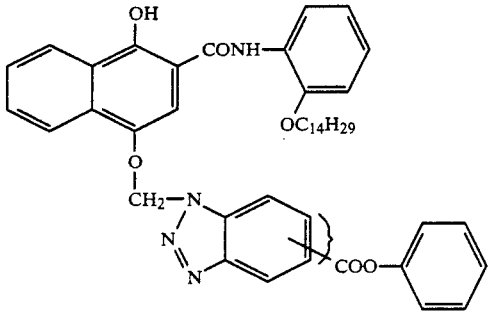
(D-63)
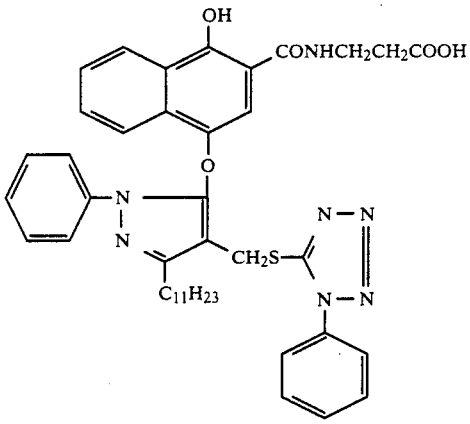
(D-64)
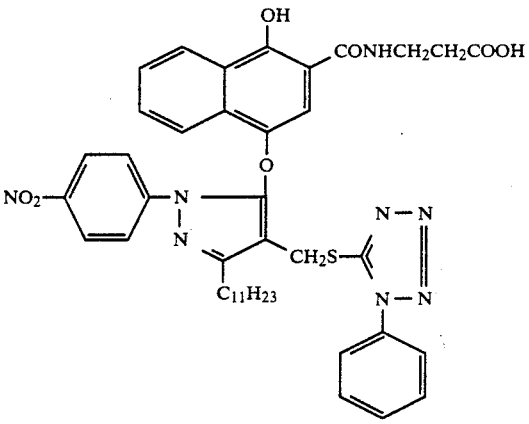

-continued
(D-65)
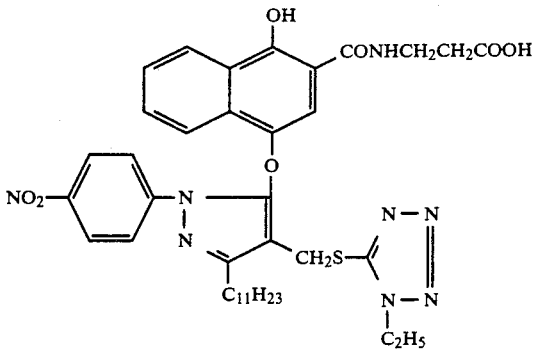
(D-66)
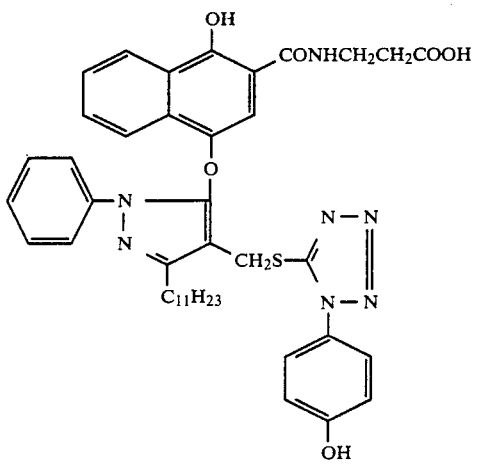
(D-67)
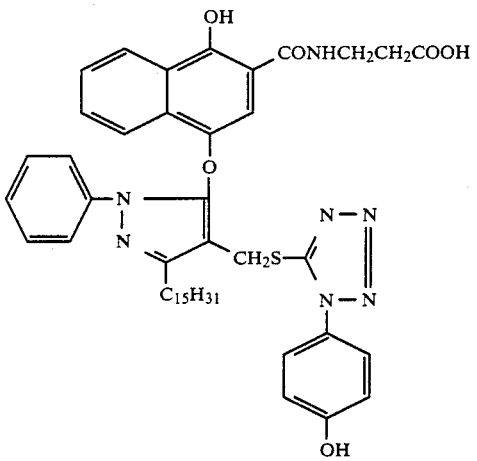
(D-68)
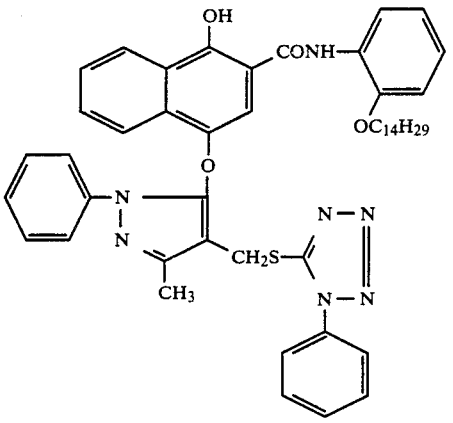

-continued
(D-69)
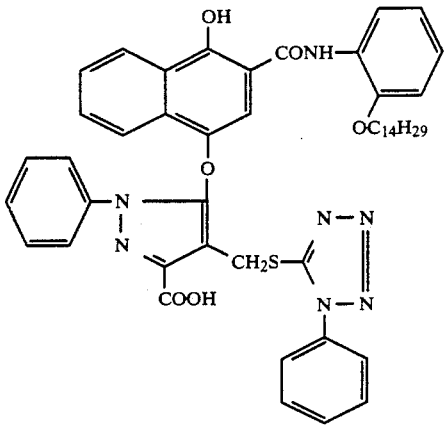
(D-70)
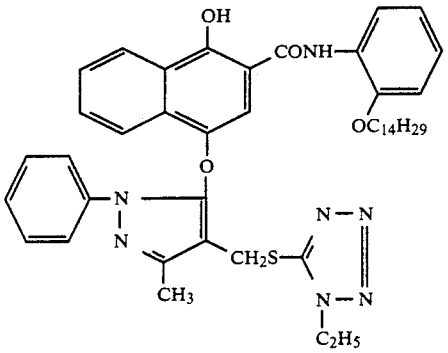
(D-71)
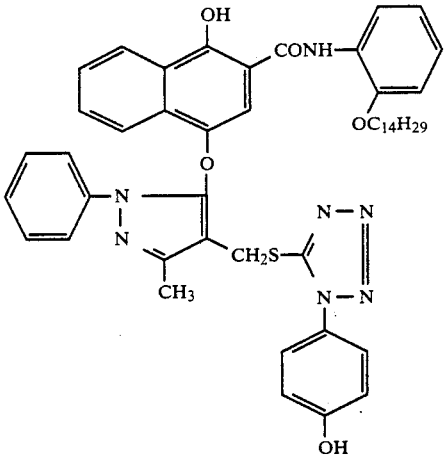
(D-72)
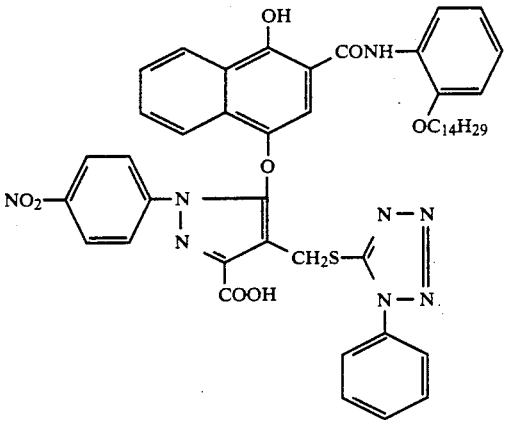

-continued
(D-73)
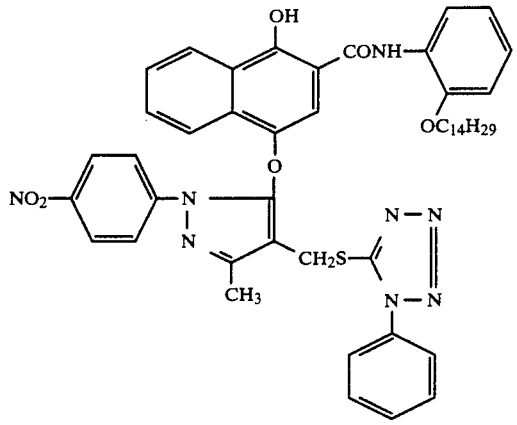
(D-74)
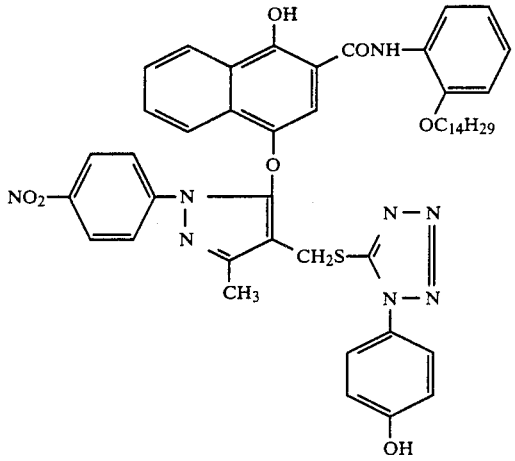
(D-75)
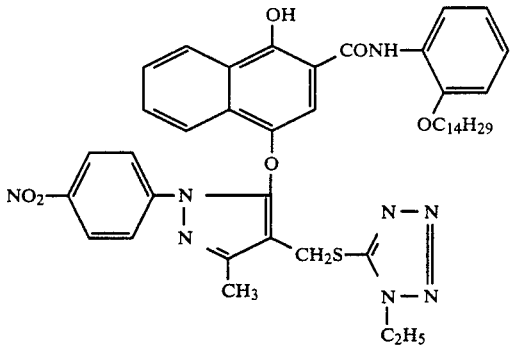
(D-76)
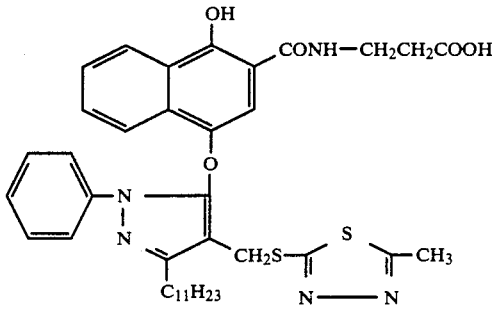

-continued
(D-77)
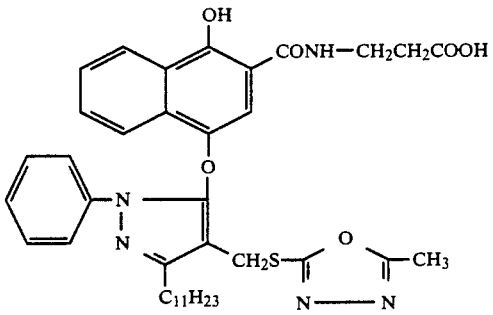
(D-78)
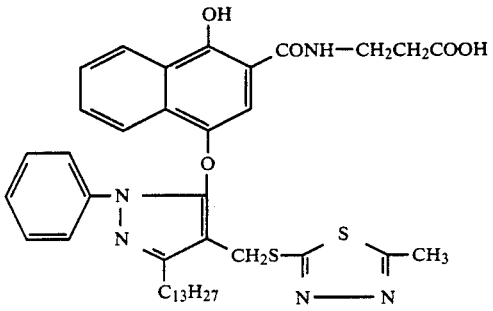
(D-79)
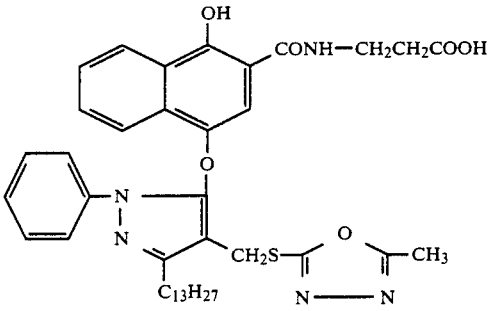
(D-80)
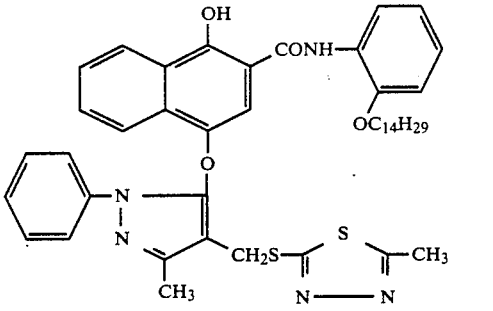
(D-81)
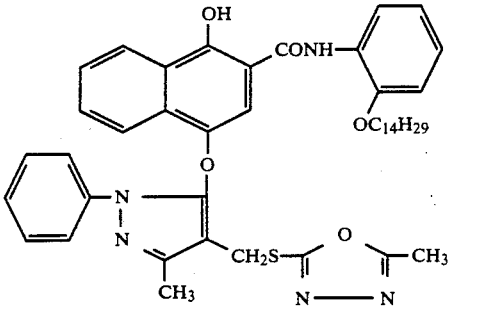

-continued
(D-82)
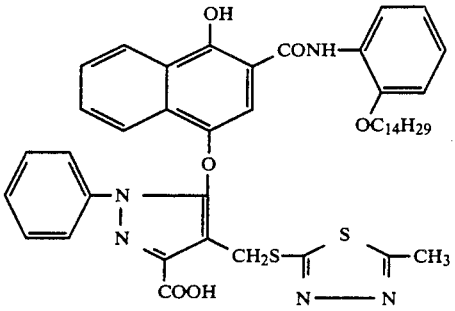
(D-83)
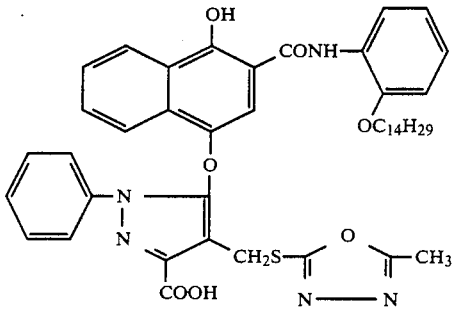
(D-84)
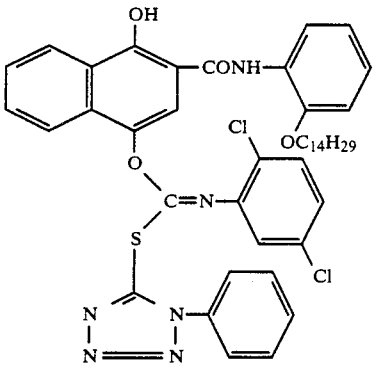
(D-85)
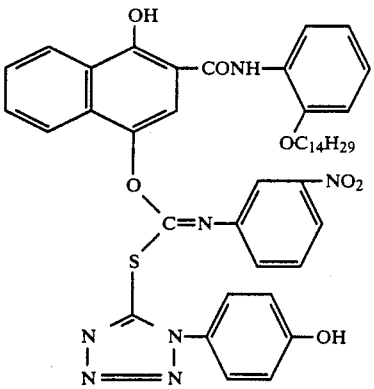

-continued
(D-86)
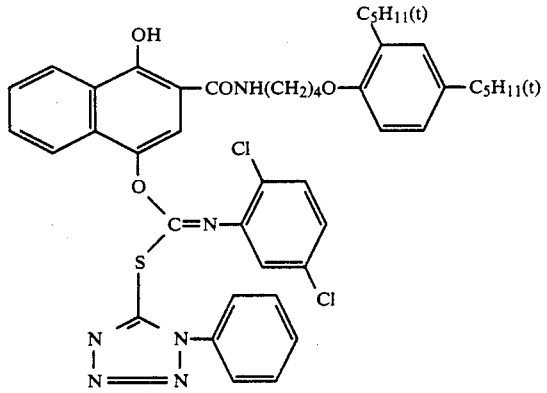
(D-87)
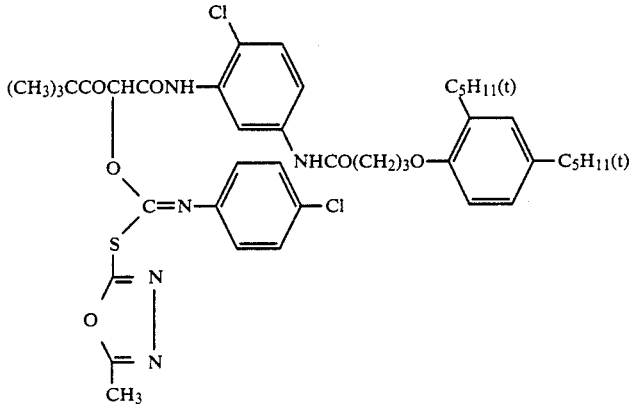
(D-88)
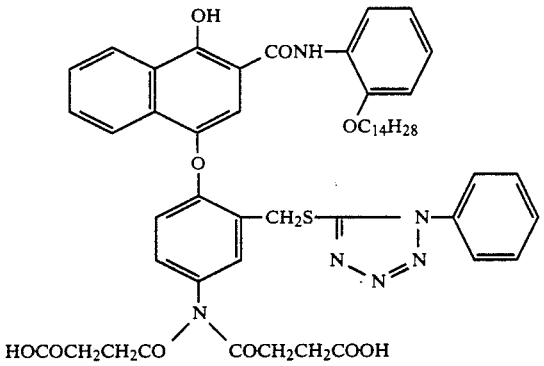
(D-89)
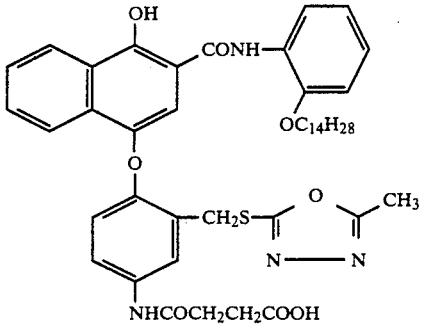

-continued
(D-90)
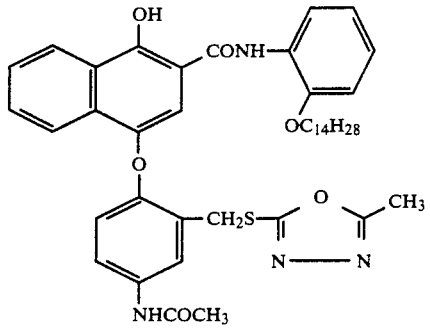
(D-91)
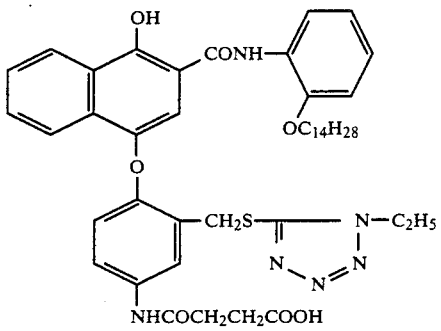
(D-92)
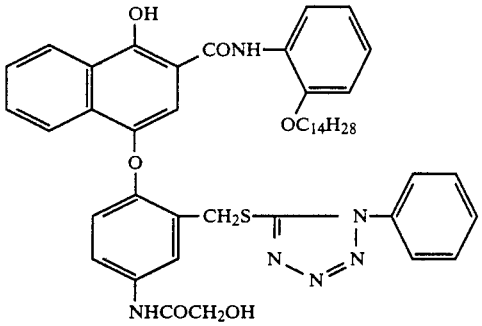
(D-93)
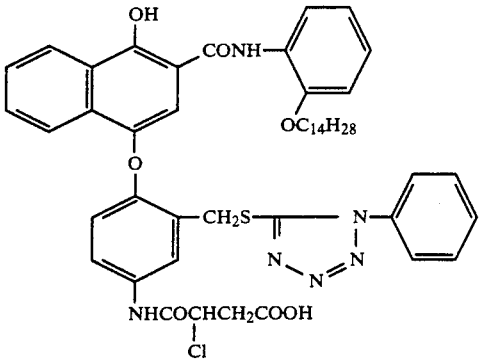

-continued (D-94)

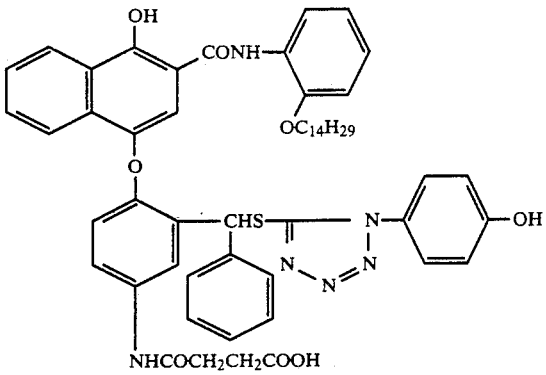

(D-95)

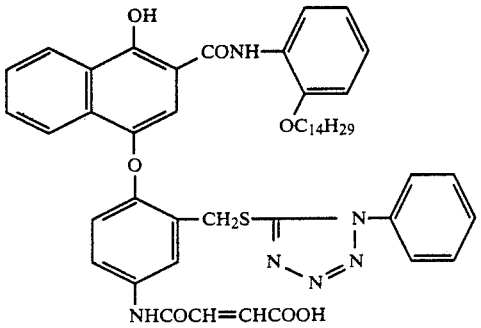

(D-96)

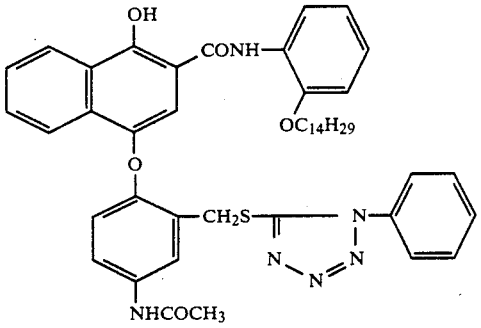

(D-97)

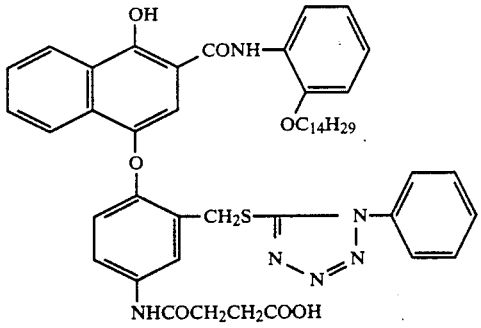

The DIR compounds of this invention can be added to a light-sensitive silver halide emulsion layer and/or a non-light-sensitive photographic constituent layer, but they are preferably added to the light-sensitive silver halide emulsion layer. Particularly, they are preferably added to a red-sensitive silver halide emulsion layer containing the cyan coupler of this invention, or a layer adjacent thereto.

The DIR compounds of this invention may be contained in the same layer in two or more kinds. Also, the same DIR compounds may be contained in different two or more layers.

In general, these DIR compounds may be used preferably in amount of $2\times1^{-5}$ to $5\times10^{-1}$ mole, more preferably $1\times10^{-4}$ to $1\times10^{-1}$ mole, per 1 mole of silver in the emulsion layer.

To incorporate these DIR compounds into a silver halide emulsion of this invention or into other photographic constituent layer-coating solutions, the DIR compounds may be added as an alkaline solution when they are alkali soluble, and, when they are oil soluble, the DIR compounds are preferably dissolved in a high boiling solvent optionally using together a low boiling solvent, dispersed in the finely particulate form, and added to the silver halide emulsion according to the methods described in U.S. Pat. Nos. 2,322,027, 2,801,170, 2,801,171, 2,272,191 and 2,304,940. In this occasion, if necessary, two or more DIR compounds may be used as a mixture. To describe in detail a method preferable in this invention, for addition of the DIR compounds, one or two or more of the DIR compounds may be dissolved in a high boiling solvent including organic amides, carbamates, esters, ketones, urea derivatives, ethers, hydrocarbons, etc., particularly, di-n-butyl phthalate, tricresyl phosphate, triphenyl phosphate, diisooctyl azelate, di-n-butyl sebacate, tri-n-hexyl phosphate, N,N-diethylcapryl amidobutyl, N,N-diethyl laurylamide, n-pentadecyl phenylether, dioctyl phthalate, n-nonyl phenol, 3-pentadecyl phenyl ethyl ether, 2,5-di-sec-amyl phenyl butyl ether, monophenyl-di-o-chlorophenyl phosphate, or fluorine paraffin, etc. and/or a low boiling solvent including methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl alcohol, acetonitrile, dimethylformamide, dioxane, methyl ethyl ketone, etc.; the resulting solution is mixed with an aqueous solution containing an anionic surface active agent such as alkylbenzenesulfonic acid and alkylnaphthalenesulfonic acid, and/or nonionic surface active agent such as sorbitan sesquioleic acid ester and sorbitan monolauric acid ester, and/or a hydrophilic binder such as gelatin; and the resulting mixture is dispersed by emulsification, using a high speed mixer, a colloid mill or an ultrasonic dispersing apparatus; followed by adding the dispersion to the silver halide emulsion.

Besides the above, the DIR compounds may be dispersed using a latex dispersing method. The latex dispersing method and its effects are described in Japanese Unexamined Patent Publications No. 74538/1974, No. 59943/1976 and No.32552/1979, or Research Disclosure, August 1976, No. 14850, pp.77–79.

Suitable latex may include, for example, homopolymers, copolymers and terpolymers of monomers such as styrene, acrylate, n-butyl acrylate, n-butyl methacrylate, 2-acetoacetoxyethyl methacrylate, 2-(methacryloyloxy)ethyltrimethylammonium methylsulfate, sodium 3-(methacryloyloxy)propane-1-sulfonate, N-isopropylacrylamide, N-[2-(2-methyl-4-oxopentyl)]acrylamide, 2-acrylamido-2-methylpropanesulfonic acid, and the like.

The above DIR compounds can be synthesized by the methods described in U.S. Pat. Nos. 3,227,554, 3,615,506, 3,617,291, 3,632,345, 3,928,041, 3,933,500, 3,938,996, 3,958,993, 3,961,959, 4,046,574, 4,052,213, 4,063,950, 4,095,984, 4,149,886 and 4,234,678; British Patents No. 2,072,363 and No. 2,070,266; Research Disclosure No. 21228 (1981); Japanese Unexamined Patent Publications No. 81144/1975, No. 81145/1975, No. 13239/1976, No. 64927/1976, No. 104825/1976, No. 105819/1976, No. 65433/1977, No. 82423/1977, No. 117627/1977, No. 130327/1977, No. 154631/1977, No. 7232/1978, No. 9116/1978, No. 29717/1978, No. 70821/1978, No. 103472/1978, No. 110529/1978, No. 135333/1978, No. 143223/1978, No. 13333/1979, No. 49138/1979, No. 114241/1979, No. 35858/1982, No. 145135/1979, No. 161237/1980, No. 114946/1981, No. 154234/1982 and No. 56837/1982; Japanese Unexamined Patent Publications No. 160954/1983 and No. 162949/1983; etc.

The DIR compound of this invention can be added to a light-sensitive silver halide emulsion layer and/or a non-light-sensitive photographic constituent layer as mentioned above, but preferably it is contained at least one layer of silver halide emulsion layers. For example, when applied in a ordinary multi-layer color photographic material comprising a blue-sensitive silver halide emulsion layer, a green-sensitive silver halide emulsion layer and a red-sensitive silver halide emulsion layer, the compound may be added to one layer or two or more layers of these.

The tetrazaindene derivative used in this invention is known as a stabilizer for silver halide emulsions of light-sensitive color photographic materials, and particularly the compound represented by Formula (XVIII) shown below can exhibit desirable effects.

Formula (XVIII)

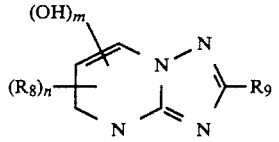

In the formula, m and n each are an integer of 2 or 3; $R_8$ and $R_9$ each represent a hydrogen atom, an alkenyl group having 1 to 4 carbon atoms, which may have a substituent, an alkyl group, or an aryl group which may have a substituent.

As the tetrazaindene derivative, the one represented by Formula (XVIII) is particularly effective. Examples of the tetrazaindene derivative that can be further effectively used are shown below, but by no means limited to these.

| | [Exemplary Compounds] |
|---|---|
| A-1 | 4-Hydroxy-1,3,3a,7-tetrazaindene |
| A-2 | 4-Hydroxy-6-methyl-1,3,3a,7-tetrazaindene |
| A-3 | 4-Hydroxy-6-hydroxy-1,3,3a,7-tetrazaindene |
| A-4 | 4-Hydroxy-6-butyl-1,3,3a,7-tetrazaindene |
| A-5 | 4-Hydroxy-5,6-dimethyl-1,3,3a,7-tetrazaindene |
| A-6 | 2-Ethyl-4-hydroxy-6-propyl-1,3,3a,7-tetrazaindene |
| A-7 | 2-Allyl-4-hydroxy-1,3,3a,7-tetrazaindene |
| A-8 | 4-Hydroxy-6-phenyl-1,3,3a,7-tetrazaindene |

These compounds can be synthesized by making reference to the descriptions in Japanese Patent Publications No. 18102/1971 and No. 2533/1969. Of these compounds, preferred are those having a hydroxyl group at the 4-position, and more preferred are those having a hydroxyl group at the 4-position and an alkyl group or an aryl group at the 6-position.

The 6-aminopurine derivative used in this invention includes the compound known as a stabilizer for silver halide emulsions of light-sensitive photographic materials, but particularly the compound represented by Formula (XIX) shown below can exhibit desirable effects.

Formula (XIX):

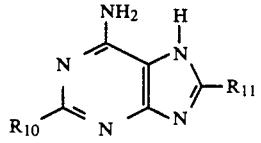

In the formula, $R_{10}$ represents a hydrogen atom or an alkyl group having 1 to 4 carbon atoms, which may have a substituent; $R_{11}$ represents a hydrogen atom, an alkyl group having 1 to 4 carbon atoms, which may have a substituent, or an aryl group which may have a substituent.

As the 6-aminopurine derivative in this invention, the one represented by Formula (XVIII) is particularly effective. Examples of the 6-aminopurine derivative that can be further effectively used are shown below, but by no means limited to these.

| | [Exemplary Compounds] |
|---|---|
| B-1 | 6-Aminopurine |
| B-2 | 2-Hydroxy-6-aminopurine |
| B-3 | 2-Methyl-6-aminopurine |
| B-4 | 6-Amino-8-methylpurine |
| B-5 | 6-Amino-8-phenylpurine |
| B-6 | 2-Hydroxy-6-amino-8-phenylpurine |
| B-7 | 2-Hydroxymethyl-6-aminopurine |

These tetrazaindene derivative and 6-aminopurine derivative can exhibit good effects for the objects of this invention when they are used by being added preferably in the range of 5 mg to 18 g each per 1 mole of silver halide.

Further, among the compounds which form silver salt having the solubility product with a silver ion, of $1\times10^{-9}$ or less, particularly those of the solubility product of $1\times10^{-11}$ or less can exhibit the effects of this invention more preferably.

However, although the DIR compounds or the tetrazaindene derivatives and the 6-aminopurine derivatives are known to be added to ordinary silver halide emulsions to improve image quality or restrain digestion fog generating at the production of emulsions, it has been quite unknown that they can achieve an effect of improvement in the graininess when used in combination with the processing according to this invention.

The aromatic primary amine color developing agent used in this invention may include the known developing agents widely used in a variety of color photographic processings. These developing agents may include aminophenol type and p-phenylenediamine type derivatives. These compounds are generally used in the form of a salt, for example, in the form of a hydrochloride or a sulfate, as being more stable than in a free state. Also, these compounds are generally used in a concentration of about 0.1 g to about 30 g, more preferably in a concentration of about 1 g to about 15 g, per 1 liter of a color developing solution.

The aminophenol type developing agent may include, for example, o-aminophenol, p-aminophenol, 5-amino-2-oxytoluene, 2-amino-3-oxy-toluene, 2-oxy-3-amino-1,4-dimethyl-benzene, etc.

Particularly useful aromatic primary amine color developing agent is an aromatic primary amine color developing agent containing an amino group having at least one water soluble group, and particularly preferably the compound represented by Formula (XX) shown below.

Formula (XX):

-continued

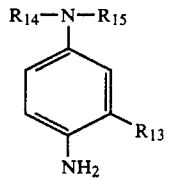

In the formula, $R_{13}$ represents a hydrogen atom, a halogen atom or an alkyl group, which alkyl group represents a straight chain or branched alkyl group having 1 to 5 carbon atoms and may have a substituent. $R_{14}$ and $R_{15}$ each represent a hydrogen atom, an alkyl group or an aryl group, each of which may have a substituent, and, when it is an alkyl group, preferred is an alkyl group substituted with an aryl group. At least one of $R_{14}$ and $R_{15}$ is an alkyl group substituted with a water-soluble group such as a hydroxyl group, a carbonic acid group, a sulfonic acid group, an amino group and a sulfonamide group, or a group of $(CH_2)_qO_pR_{16}$. This alkyl group may further have a substituent.

$R_{16}$ represents a hydrogen atom or an alkyl group, which alkyl group represents a straight chain or branched alkyl group having 1 to 5 carbon atoms; and p and q represents an integer of 1 to 5.

Examples of the compound represented by Formula (XX) are shown below, but by no means limited to these.

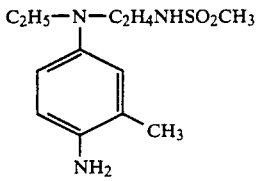

(E-1)

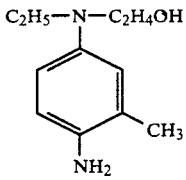

(E-2)

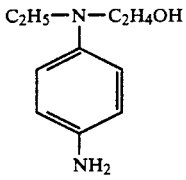

(E-3)

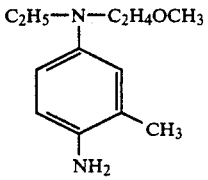

(E-4)

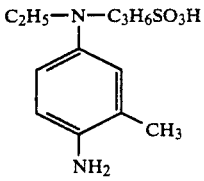

(E-5)

-continued (E-6)

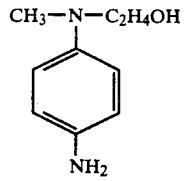

(E-7)

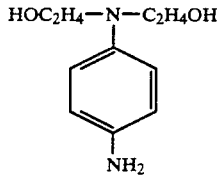

(E-8)

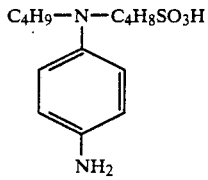

(E-9)

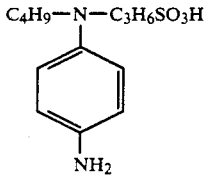

(E-10)

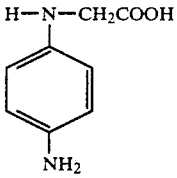

(E-11)

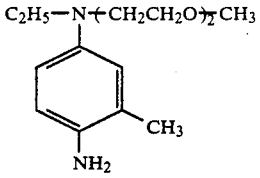

(E-12)

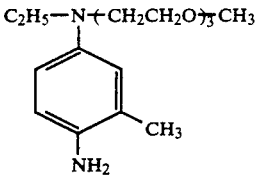

(E-13)

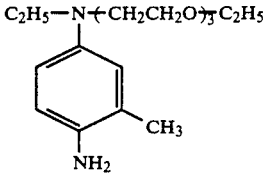

-continued (E-14)

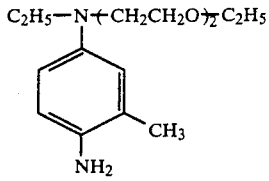

(E-15)

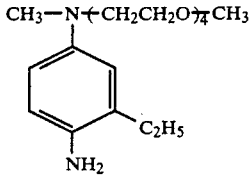

(E-16)

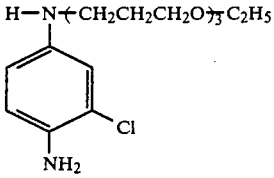

These p-phenylenediamine derivatives represented by Formula (XX) can be used as a salt of an organic acid and an inorganic acid, and there can be used hydrochloride, sulfate, phosphate, p-toluene sulfonate, sulfite, oxalate, benzenedisulfonate, etc.

In this invention, among these p-phenylenediamine derivatives represented by Formula (XX), the effect of the invention can be particularly desirably exhibited when $R_{14}$ and/or $R_{15}$ is/are represented by $(CH_2)_1O_pR_{16}$ (wherein p, q and $R_{16}$ have the same meaning as defined above).

In this invention, it is particularly preferable to use Compound (E-2).

Compounds preferably usable in the color developing agent of this invention may include a sulfite, hydroxylamine, and a development restrainer.

The sulfite may include sodium sulfite, sodium hydrogensulfite, potassium sulfite, potassium hydrogensulfite, etc., and preferably used in the range of 0.1 to 40 g/lit., more preferably used in the range of 0.5 to 10 g/lit.

The hydroxylamine is used as a counter salt to hydrochloride, sulfate and so forth, and preferably used in the range of 0.1 to 40 g/lit., and more preferably used in the range of 0.5 to 10 g/lit.

The restrainer may include halides such as sodium bromide, potassium bromide, sodium iodide and potassium iodide, and organic restrainer may include the compounds described below, which may be added in an amount of ranging between 0.005 and 20 g/lit., preferably between 0.01 and 5 g/lit.

In this invention, the following organic restrainer is employed for inhibiting effectively fog without reduction of the maximum density and improving image quality or graininess when it is used in the color developing solution.

The organic restrainer in this invention may include a nitrogen-containing heterocyclic compound, a compound having a mercapto group, an aromatic compound, an onium compound, a compound having an iodine atom at a substituent, etc., and preferably may include compounds represented by Formula (R-I), (R-II) and (R-III) shown below.

The compound represented by Formula (R-I) includes more preferably a compound represented by Formula (R-IV) or (R-V), and most preferably compounds represented by Formulas (R-VI) to (R-XI).

On the other hand, the compound represented by Formula (R-II) includes most preferably a compound represented by Formula (R-XII) or (R-XIII).

Formula (R-I):

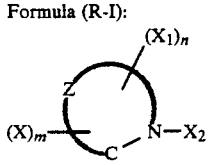

In the formula, X and $X_1$ each represent halogen atom, an alkyl group, an aryl group, an amino group, a hydroxyl group, a nitro group, a carboxyl group or a sulfonyl group; and $X_2$ represents a hydrogen atom, an alkyl group, an aryl group or a double bond for the formation of a ring. Z represents a group consisting of a carbon atom, an oxygen atom, a nitrogen atom, a sulfur atom necessary for the formation of a ring. Each of m and n is 0, 1 or 2.

Formula (R-II):

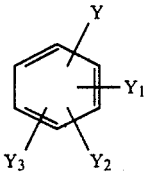

In the formula, Y, $Y_1$, $Y_2$ and $Y_3$ each represent a hydrogen atom, a halogen atom, an alkyl group, an amino group, a hydroxyl group, a nitro group, a carboxyl group or a sulfonyl group.

Formula (R-III):

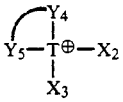

In the formula, T represents a nitrogen atom or a phosphorous atom; $X_2$ and $X_3$ each represent a hydrogen atom, an alkyl group, an aryl group or a halogen atom; and $Y_4$ and $Y_5$ each represent an alkyl group or an aryl group, and $Y_4$ and $Y_5$ may be ring-closed and form a hetero ring.

Formula (R-IV):

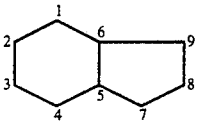

which is a compound wherein 2 to 5 carbon atoms in the positions 1 to 9 have been substituted with nitrogen atoms, or a derivative thereof.

Formula (R-V):

-continued

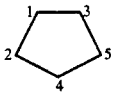

which is a compound wherein 2 to 4 carbon atoms in the positions 1 to 5 have been substituted with nitrogen atoms, or a derivative thereof.

Formula (R-VI):

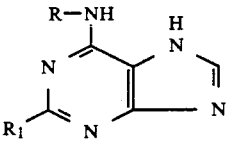

Formula (R-VII):

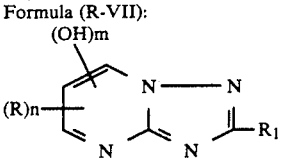

Formula (R-VIII):

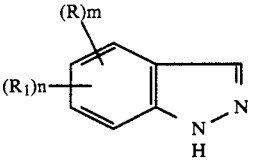

Formula (R-IX):

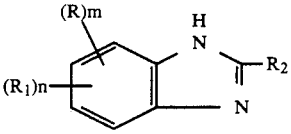

Formula (R-X):

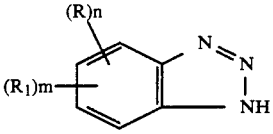

Formula (R-XI):

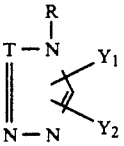

(wherein T is carbon or nitrogen)

Formula (R-XII):

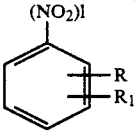

Formula (R-XIII):

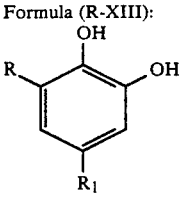

In each of the formulas, $Y_1$ and $Y_2$, each have the same meaning as defined for Y, $Y_1$, $Y_2$ and $Y_3$ in the description for the above (R-II); and R, $R_1$ and $R_2$ represent a hydrogen atom, an alkyl group or an aryl group. Each of m and n is 0, 1 or 2. l is 1 or 2.
[Exemplary Organic Restrainer]
Z1
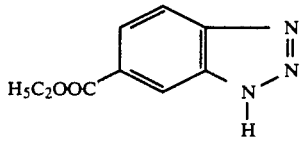
Z2
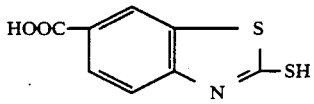
Z3
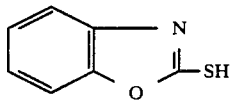
Z4
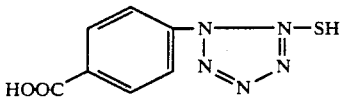
Z5
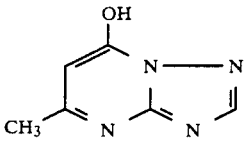
Z6
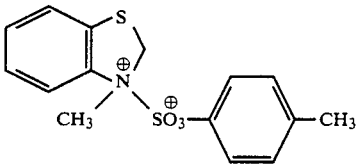
Z7
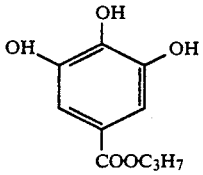
Z8
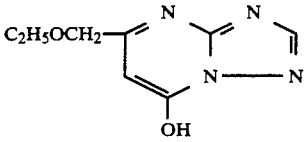
Z9
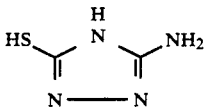
-continued
[Exemplary Organic Restrainer]
Z10
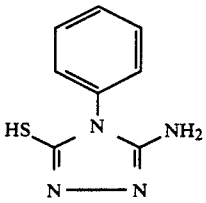
Z11
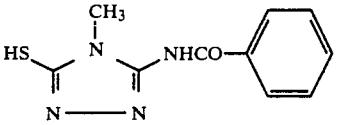
Z12
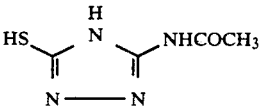
Z13
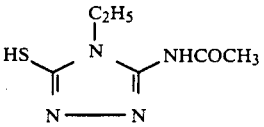
Z14
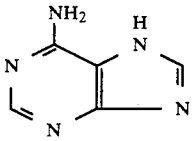
Z15
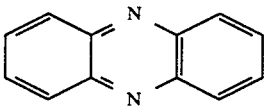
Z16
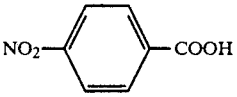
Z17
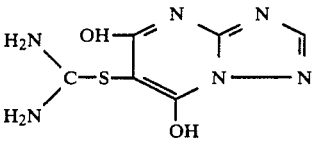
Z18
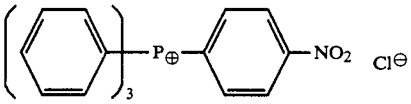
Z19
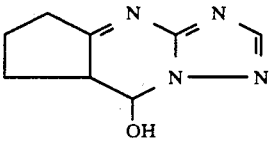
Z20
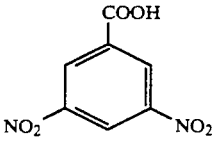

-continued
[Exemplary Organic Restrainer]
Z21
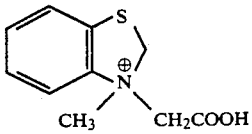
Z22
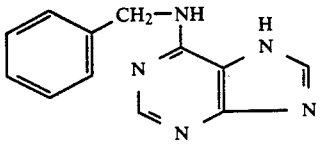
Z23
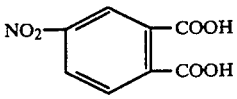
Z24
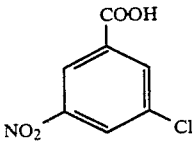
Z25
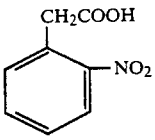
Z26
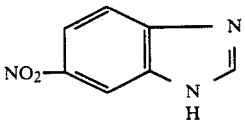
Z27
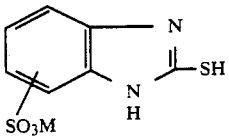
Z28
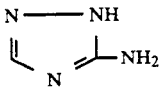
Z29
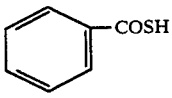
Z30
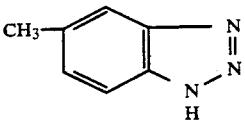
Z31
$HSC_2H_4O_2\text{-}(C_2H_4O)_n\text{-}COC_2H_4SH$
(n = 35~45)
Z32
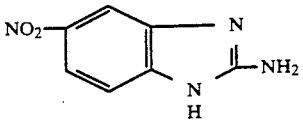
Z33
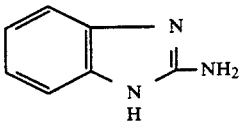
Z34
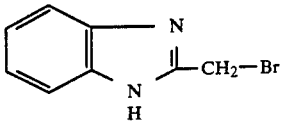
Z35
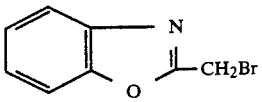
Z36
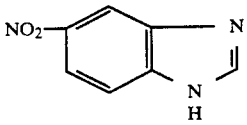
Z37
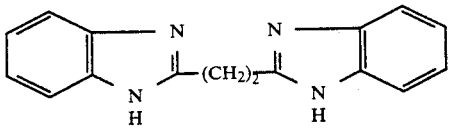
Z38
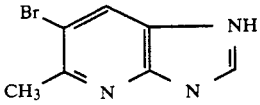
Z39
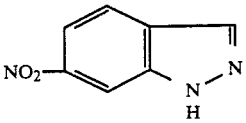
Z40
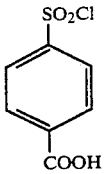
Z41
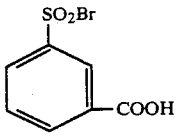
Z42
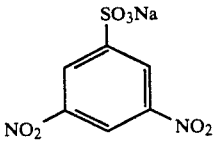
Z43
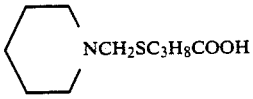

-continued
[Exemplary Organic Restrainer]
Z44
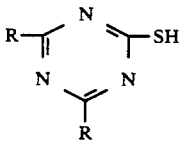
Z45
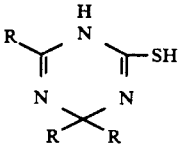
Z46
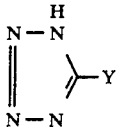
(wherein Y: an alkyl group,
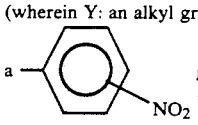
group, a
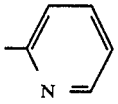
group)
Z47
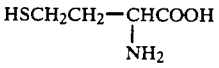
Z48
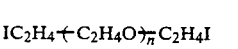
Z49
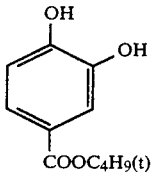
Z50
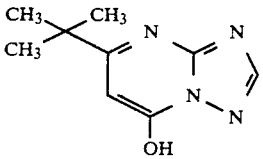
Z51
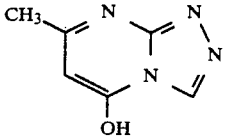
Z52
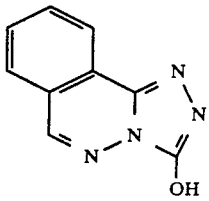
Z53
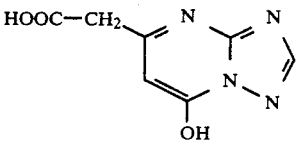
-continued
[Exemplary Organic Restrainer]
Z54
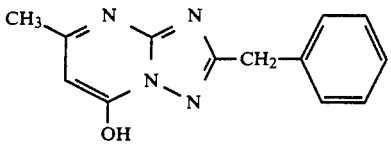
Z55
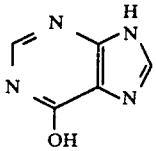
Z56
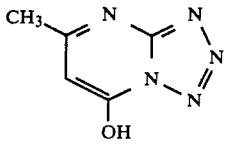
Z57
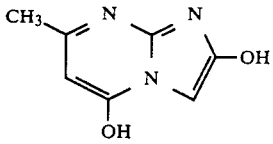
Z58
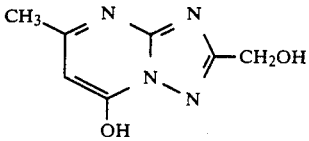
Z59
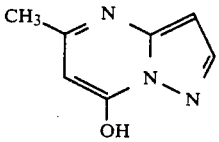
Z60
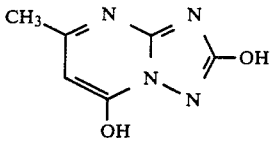
Z61
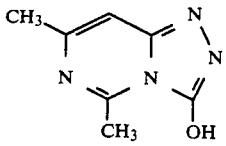
62
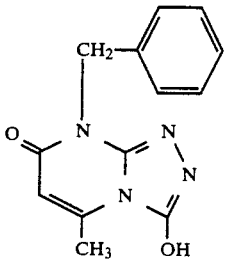

-continued

[Exemplary Organic Restrainer]

Z63

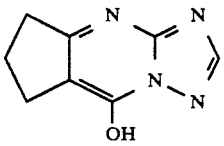

Z64

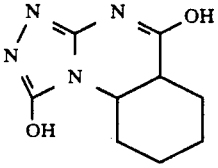

Z65

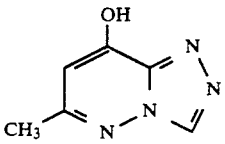

Z66

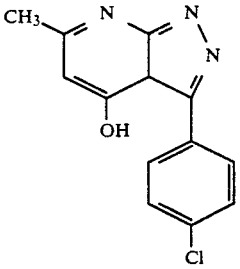

Z67

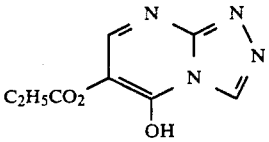

Z68

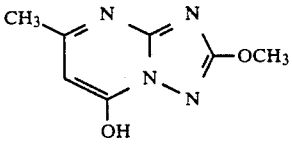

Z69

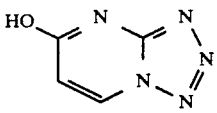

Z70

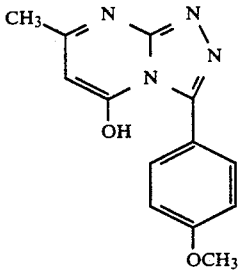

Z71

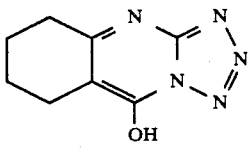

-continued

[Exemplary Organic Restrainer]

Z72

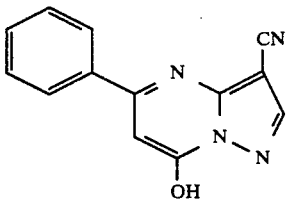

Z73

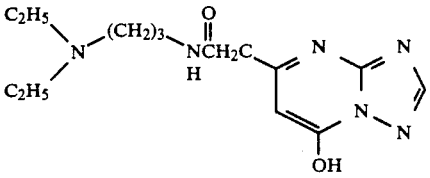

The cyan coupler used in the red-sensitive silver halide emulsion layer according to this invention will be described below.

The cyan coupler of this invention can be represented by Formula (I) or Formula (II) shown below.

Formula (I)

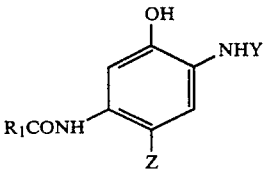

Formula (II)

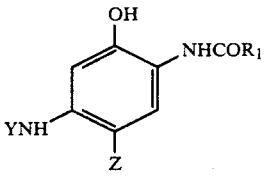

In formula (I) and Formula (II) shown above, Y is a group represented by;

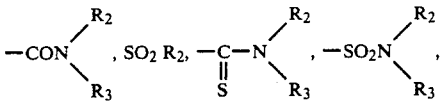

$-CONHCOR_2$ or $-CONHSO_2R_2$.

Herein, $R_1$ and $R_2$ each represent an alkyl group, preferably an alkyl group having 1 to 20 carbon atoms (for example, each group of methyl, ethyl, t-butyl, dodecyl, etc.), an alkenyl group, preferably an alkenyl group having 2 to 20 carbon atoms (such as an allyl group and a heptadecenyl group), a cycloalkyl group, preferably 5- to 7-membered one (for example, cyclohexyl, etc.), an aryl group (for example, a phenyl group, a tolyl group, a naphthyl group, etc.), a heterocyclic group, preferably a group of 5- or 6-membered ring containing 1 to 4 nitrogen atom(s), oxygen atom(s) or sulfur atom(s) (for example, a furyl group, a thienyl group, a benzothiazolyl group, etc.). $R_3$ represents a hydrogen atom or the group represented by $R_2$. $R_2$ and $R_3$ may be linked to each other to form a 5- or 6-membered hetero ring. Into $R_1$ and $R_2$, a desirable substituent may be introduced, for example, an alkyl group having 1 to 10 carbon atoms (for example, methyl, i-propyl, i-butyl, t-butyl, t-octyl, etc.), an aryl group (for example, phenyl, naphthyl, etc.), a halogen atom (such as fluorine, chlorine and bromine), cyano, nitro, a sulfonamide group (for example, methanesulfonamide, butanesulfonamide, p-toluenesulfonamide, etc.), a sulfamoyl group (such as methylsulfamoyl and phenylsulfamoyl) a sulfonyl group (for example, methanesulfonyl, p-toluenesulfonyl, etc.), a fluorosulfonyl group, a carbamoyl group (for example, dimethyl carbamoyl group, phenyl carbamoyl, etc.), an oxycarbonyl group (for example, ethoxycarbonyl, phenoxycarbonyl, etc.), an acyl group (for example, acetyl, benzoyl, etc.) a hetero ring (for example, a pyridyl group, a pyrazolyl, etc.), an alkoxy group, an aryloxy group, an acyloxy group, etc.

In Formula (I) and Formula (II), $R_1$ represents a ballast group necessary for imparting diffusion resistance, to the cyan coupler represented by Formula (I) and Formula (II) and a cyan dye to be formed from said cyan coupler. Preferably, it is an alkyl group having 4 to 30 carbon atoms, an aryl group, an alkenyl group, a cycloalkyl group or a hetero ring. For example, it may include a straight chain or branched alkyl group (for example, t-butyl, n-octyl, t-octyl, n-dodecyl, etc.), a 5- or 6-membered heterocyclic group, etc.

In Formula (I) and Formula (II), Z represents a hydrogen atom or a group eliminable at the coupling reaction with an oxidized product of the N-hydroxyalkyl substituted-p-phenylenediamine derivative color developing agent. For example, it may include a halogen atom (for example, chlorine, bromine, fluorine, etc.), a substituted or unsubstituted alkoxy group, an aryloxy group, a heterocyclic oxy group, an acyloxy group, a carbamoyloxyl group, a sulfonyloxy group, an alkylthio group, an arylthio group, a heterocyclic thio group, a sulfonamide group, etc., and more specific examples may include those described in U.S. Pat. No. 3,741,563, Japanese Unexamined Patent Publication No. 37425/1972, Japanese Patent Publication No. 36894/1973, Japanese Unexamined Patent Publications No. 10135/1975, No. 117422/1975, No. 130441/1975, No. 108841/1976, No. 120343/1975, No. 18315/1977, No. 105226/1978, No. 14736/1979, No. 48237/1979, No. 32071/1980, No. 65957/1980, No. 1938/1981, No. 12643/1981, No. 27147/1981, No. 146050/1984, No. 166956/1984, No. 24547/1985, No. 35731/1985 and No. 37557/1985; etc.

In this invention, a cyan coupler represented by Formula (III) shown below is preferred.

Formula (III):

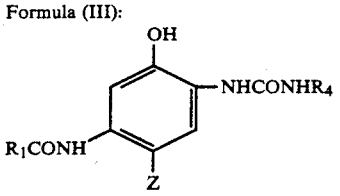

In Formula (III), $R_4$ represents a substituted or unsubstituted aryl group (particularly preferably a phenyl group). The substituent in the case when said aryl group have a substituent may include at least one of substituents selected from $SO_2$ $R_5$, a halogen atom (such as fluorine, chlorine, bromine, etc.), $-CF_3$, $-NO_2$, $-CN$, $-COR_5$, $-COOR_5$, $-SO_2$ $OR_5$,

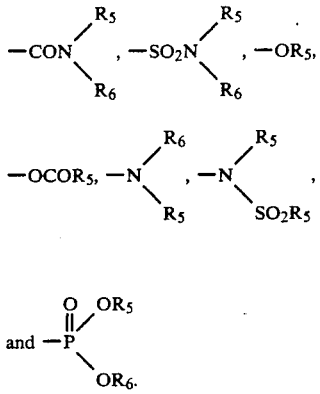

Herein, $R_5$ represents an alkyl group, preferably an alkyl group having 1 to 20 carbon atoms (for example, each group of methyl, ethyl, t-butyl and dodecyl), an alkenyl group, preferably an alkenyl group having 2 to 20 carbon atoms (such as an allyl group and heptadecenyl group), a cycloalkyl group, preferably 5- to 7-membered one (for example, cyclohexyl, etc.) an aryl group (for example, a phenyl group, a tolyl group, a naphtyl group, etc.); and $R_6$ represents a hydrogen atom or the group represented by $R_5$.

A preferable compound of the cyan coupler of this invention, represented by Formula (III), is a compound such that $R_4$ is a substituted or unsubstituted phenyl group, and the substituent for the phenyl group is cyano, nitro, $-SO_2$ $R_7$ ($R_7$ is an alkyl group), a halogen atom or trifluoromethyl.

In Formulas (I), (II) and (III), Z and $R_1$ each have the same meaning as defined in Formulas (I) and (II). Preferred examples of the ballast group represented by $R_1$ include a group represented by Formula (IV) shown below.

Formula (IV):

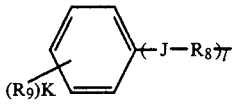

In the formula, J represents an oxygen atom or a sulfonyl group; K represents an integer of 0 to 4; l represents 0 or 1; and $R_9$ which is present in two or more numbers when K comprises two or more, may be the same or different; $R_8$ represents a straight or branched alkylene group having 1 to 20 carbon atoms and substituted with an aryl group, etc.; and $R_9$ represents a monovalent group, preferably, a hydrogen atom, a halogen atom (for example, chlorine, bromine, etc.), an alkyl group, preferably a straight or branched alkyl group having 1 to 20 carbon atoms (for example, each group of methyl, t-butyl, t-pentyl, t-octyl, dodecyl, pentadecyl, benzyl, phenetyl, etc.), an aryl group (for example, a phenyl group), a heterocyclic group (for example, a nitrogen-containing heterocyclic group), an alkoxy group, preferably a straight chain or branched alkoxy group having 1 to 20 carbon atoms (for example, each group of methoxy, ethoxy, t-butyloxy, octyloxy, decyloxy, dedecyloxy, etc.), an aryloxy group (for example, a phenoxy group), a hydroxyl group, an acyloxy group, preferably an alkylcarbonyloxy group, an arylcarbonyloxy group (for example, an acetoxy group and benzoyloxy group), carboxy, alkyloxycarbonyl group, preferably a straight or branched alkylcarbonyl group having 1 to 20 carbon atoms, more preferably a phenoxycarbonyl group, an alkylthio group, preferably an acyl group having 1 to 20 carbon atoms, more preferably a straight or branched alkylcarbonyl group having 1 to 20 carbon atoms, an acylamino group, preferably a straight chain or branched alkylcarbamide group having 1 to 20 carbon atoms, a benzenecarbamide group, a sulfonamide group, preferably a straight chain or branched alkylsulfonamide group having 1 to 20 carbon atoms or a benzenesulfonamide group, a carbamoyl group, preferably a straight chain or branched alkylaminocarbonyl group having 1 to 20 carbon atoms or a phenylaminocarbonyl group, sulfamoyl group, preferably a straight chain or branched alkylaminosulfonyl group having 1 to 20 carbon atoms or a phenylaminosulfonyl group, etc.

Specific exemplary compounds for the cyan coupler represented by Formula (I) or (II) of this invention are shown below, but by no means limited to these.

[Exemplary Compounds]

C-1

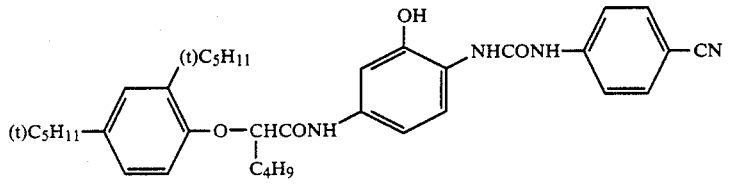

C-2

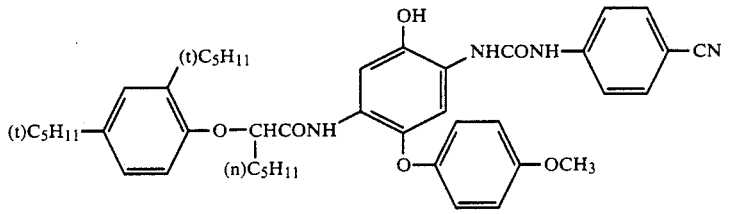

C-3

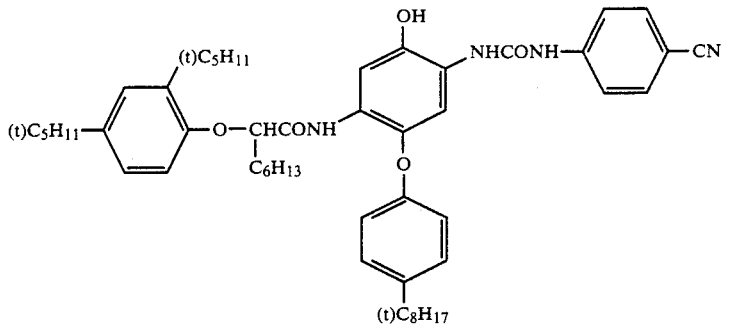

C-4

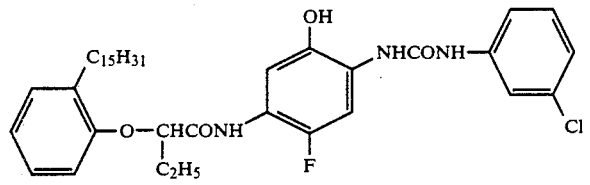

C-5

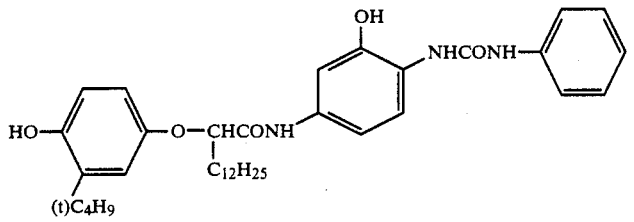

-continued
[Exemplary Compounds]
C-6
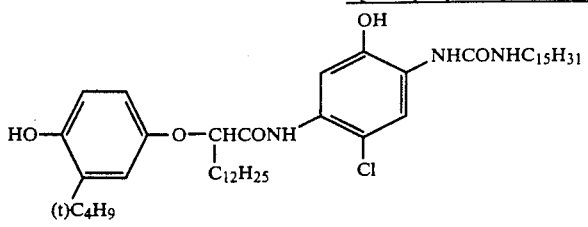
C-7
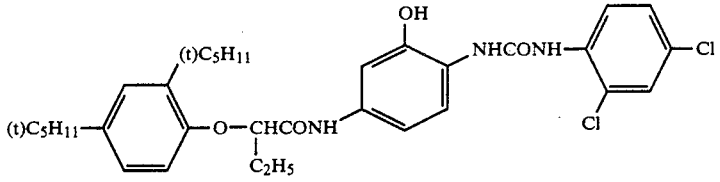
C-8
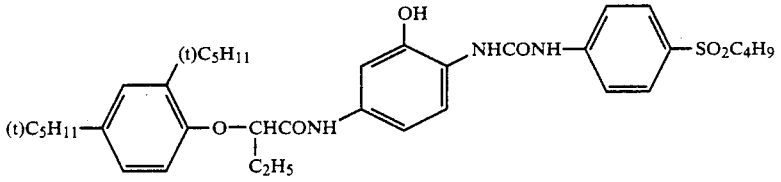
C-9
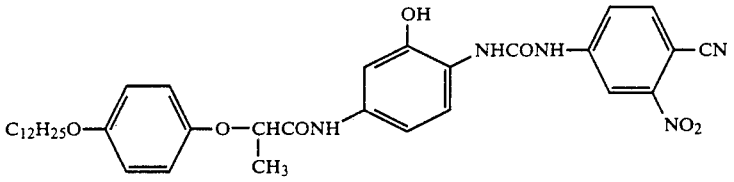
C-10
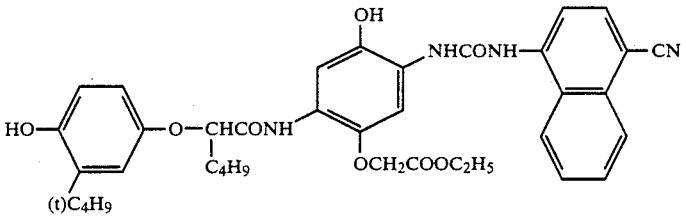
C-11
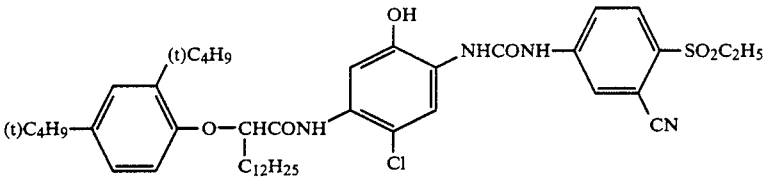
C-12
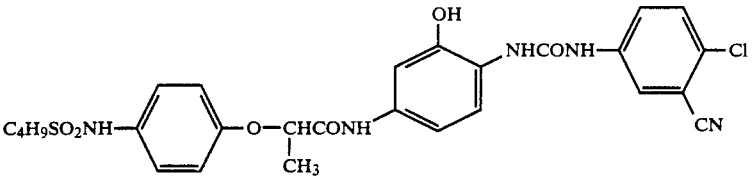
C-13
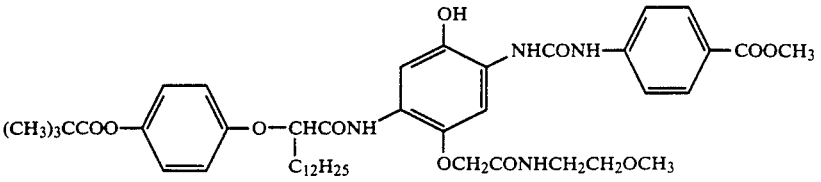

-continued
[Exemplary Compounds]
C-14
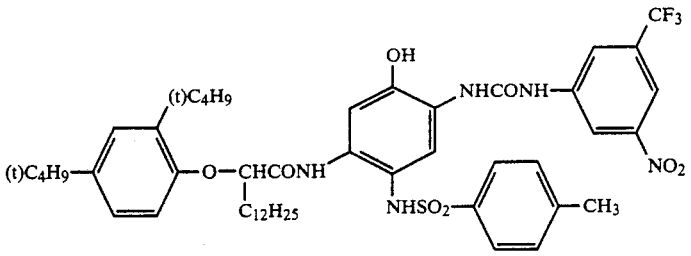
C-15
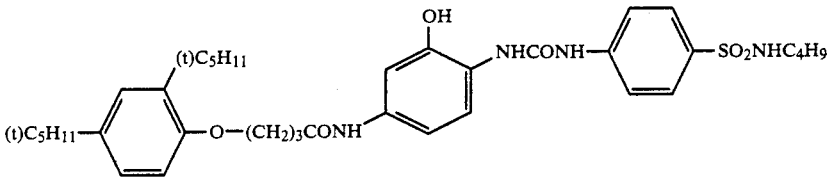
C-16
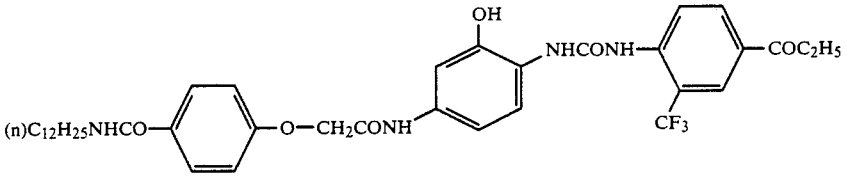
C-17
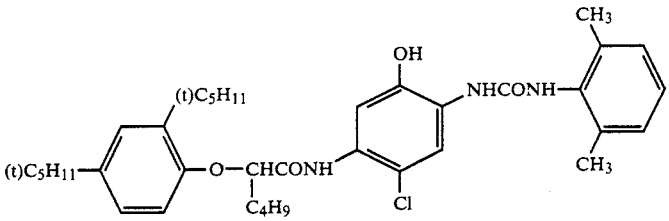
C-18
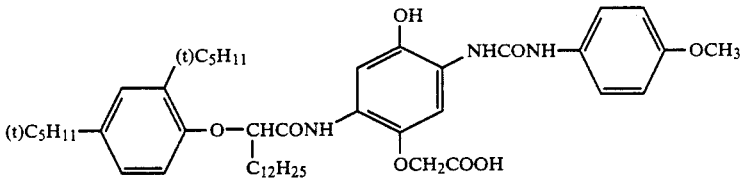
C-19
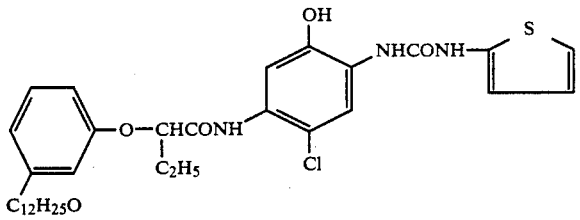
C-20
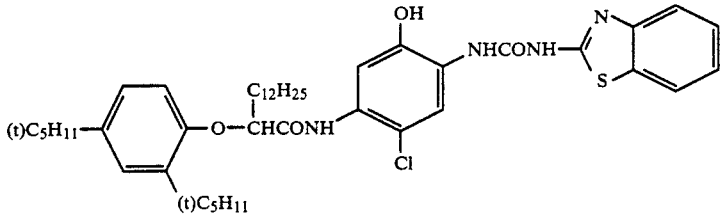

-continued
[Exemplary Compounds]
C-21
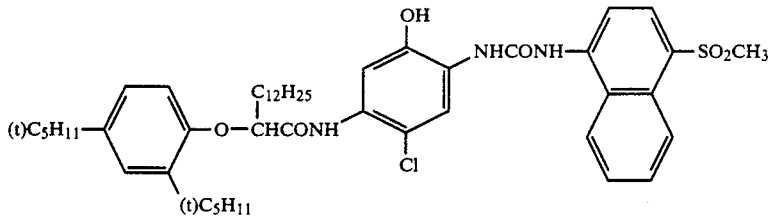
C-22
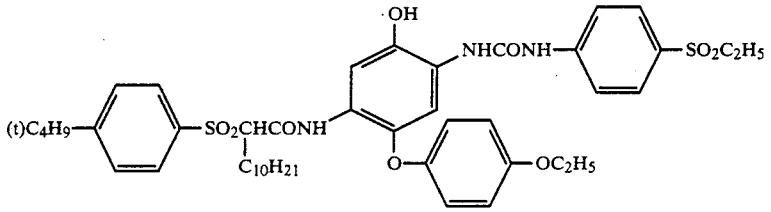
C-23
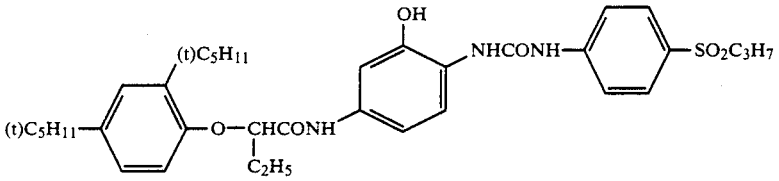
C-24
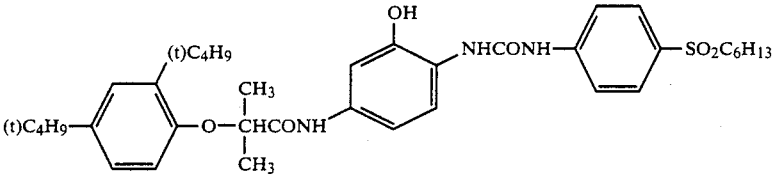
C-25
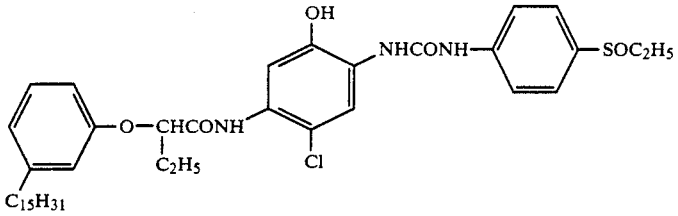
C-26
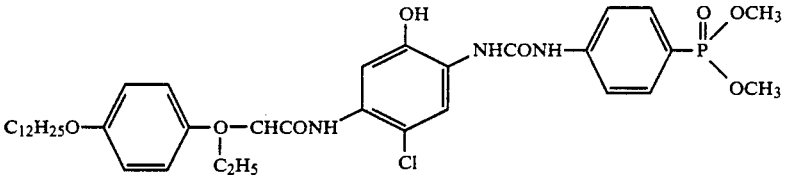
C-27
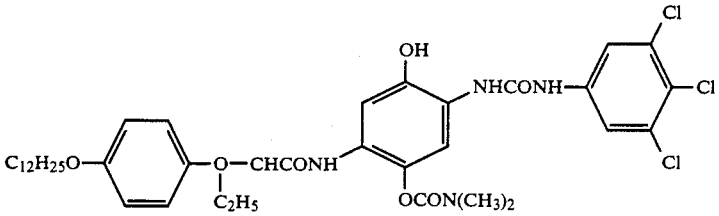

-continued
[Exemplary Compounds]
C-28
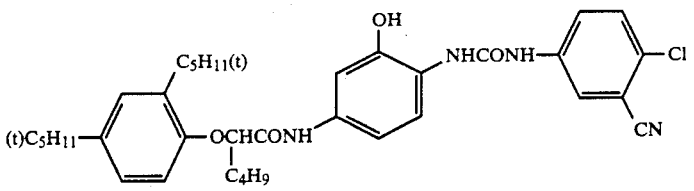
C-29
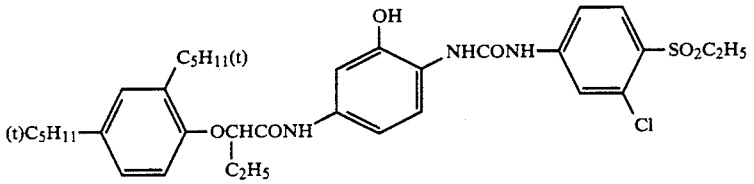
C-30
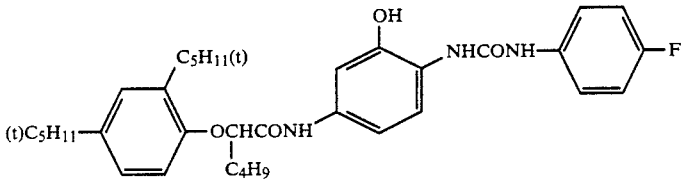
C-31
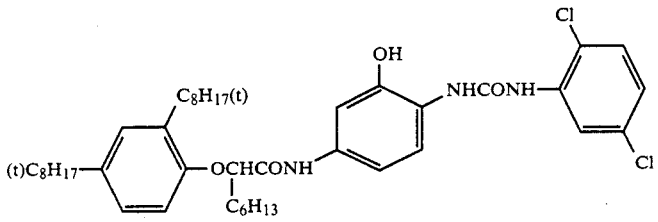
C-32
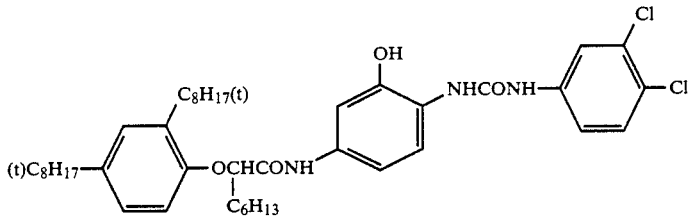
C-33
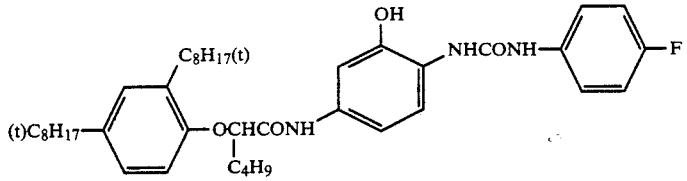
C-34
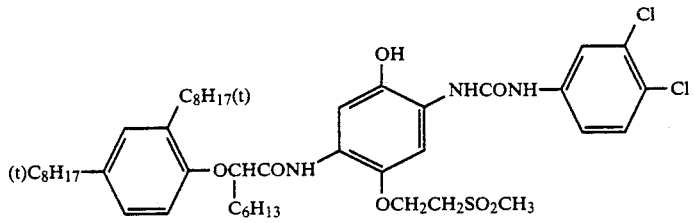

-continued
[Exemplary Compounds]
C-35
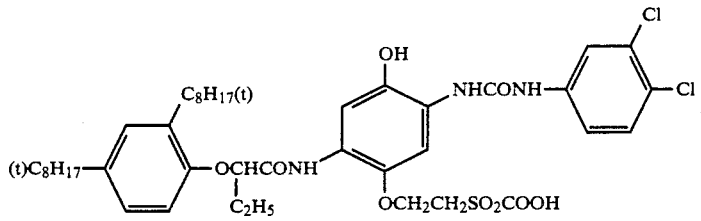
C-36
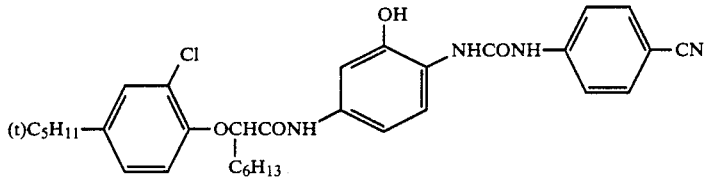
C-37
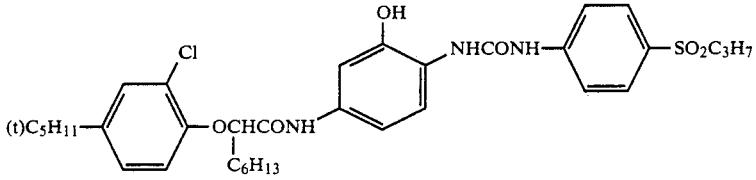
C-38
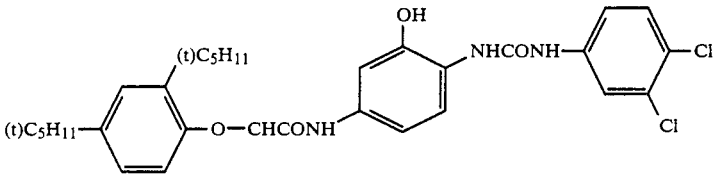
C-39
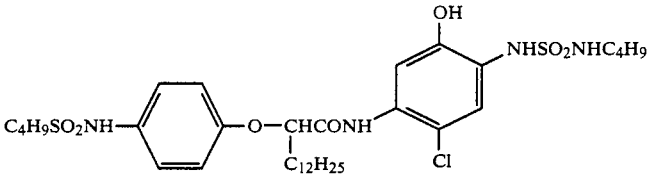
C-40
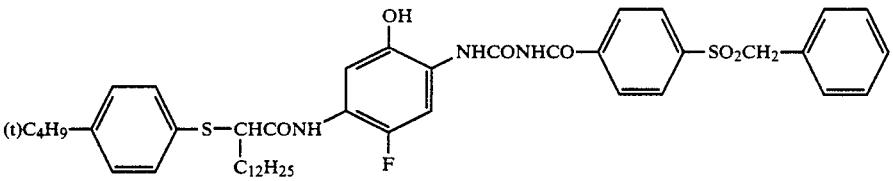
C-41
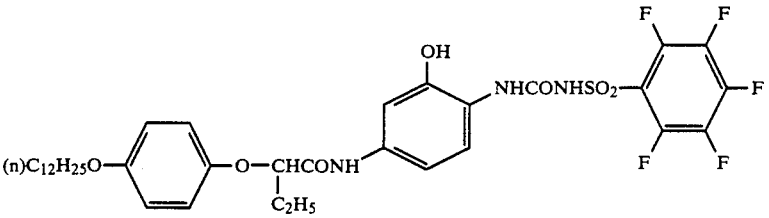

-continued
[Exemplary Compounds]
C-42
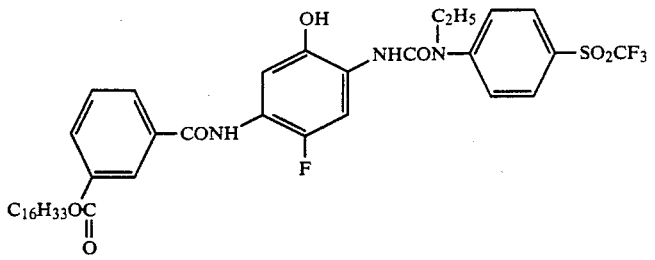
C-43
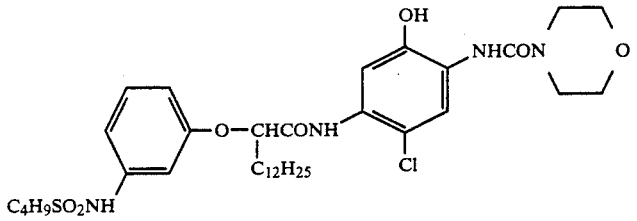
C-44
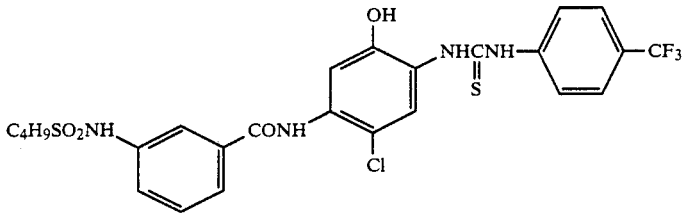
C-45
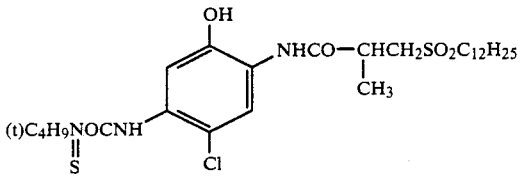
C-46
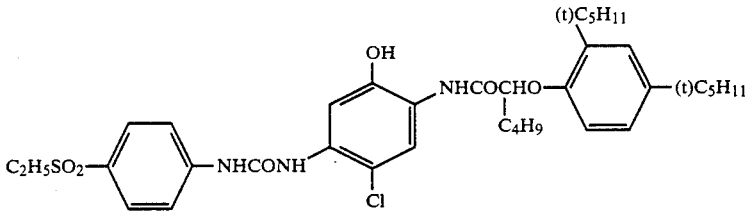
C-47
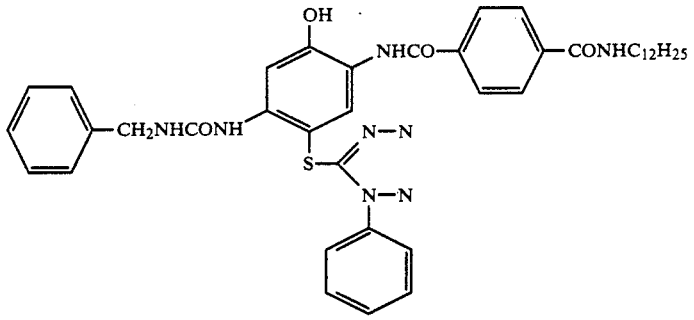
C-48
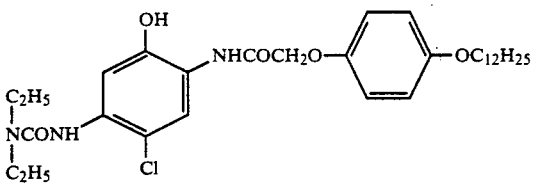

-continued
[Exemplary Compounds]
C-49
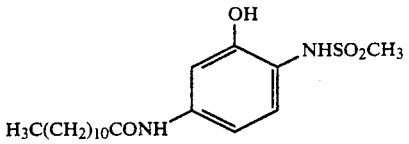
C-50
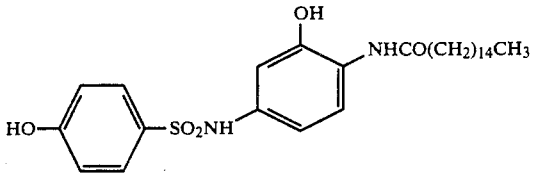
C-51
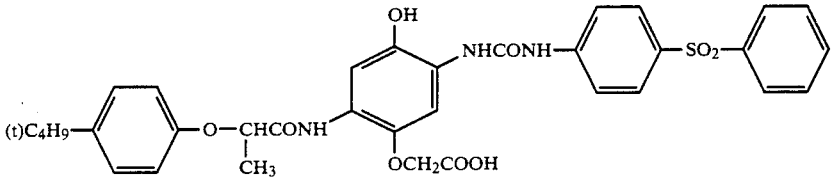
C-52
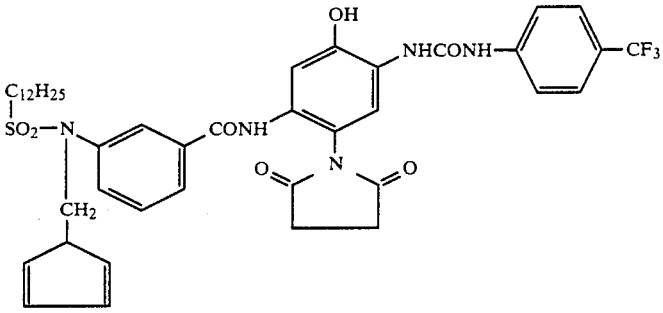
C-53
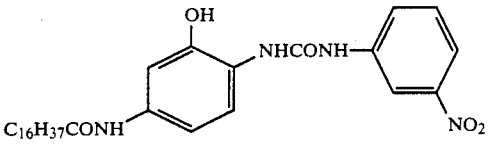
C-54
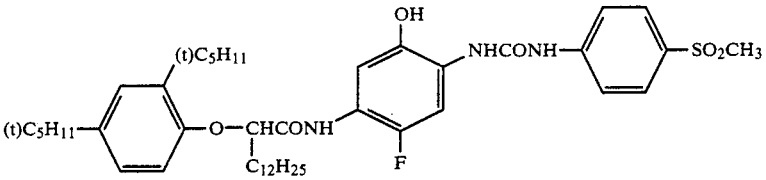
C-55
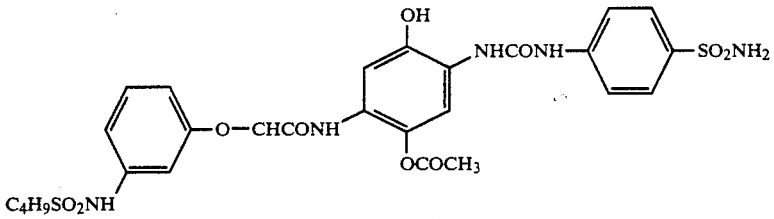
C-56
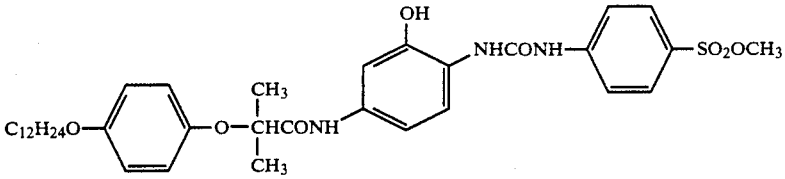

-continued

[Exemplary Compounds]

C-57

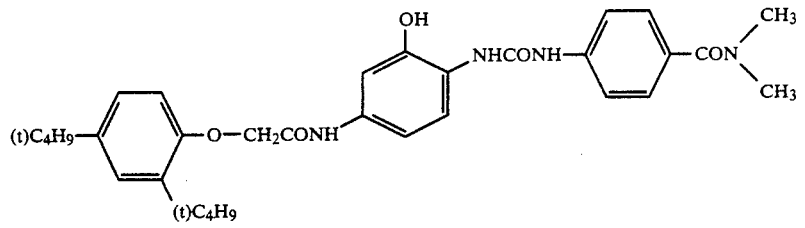

C-58

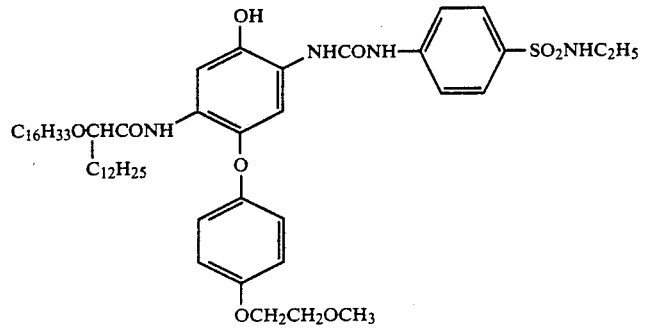

These cyan couplers of this invention can be synthesized by known methods, for example, synthesis methods as described in U.S. Pat. Nos. 3,222,176, 3,446,622 and 3,996,253; British Pat. No. 1,011,940; Japanese Unexamined Patent Publications No. 21139/1972, No. 65134/1981, No. 204543/1982 and No. 204544/1982; Japanese Unexamined Patent Publications No. 33250/1983, No. 33248/1983, No. 33249/1983, No. 33251/1983, No. 33252/1983 and No. 31334/1983; Japanese Unexamined Patent Publications No. 24547/1985, No. 35731/1985 and No. 37557/1985; etc.

The cyan couplers represented by Formula(s) (I) and/or (II) of this invention may be used along or in combination of two or more kinds. When the couplers of Formulas (I) and (II) are used in combination, they may be used in the ratio of [cyan coupler represented by Formula (I) of this invention]: [cyan coupler represented by Formula (II) of this invention] = 1:9 to 9:1. To incorporate the cyan couplers of this invention into the silver halide emulsion layers, conventional addition methods may be used, and they may be added usually in the range of about 0.005 mole to 2 moles, preferably 0.01 to 1 mole, per 1 mole of silver halide.

The color developing solution used in this invention may optionally contain various components usually added, for example, alkali agents such as sodium hydroxide and sodium carbonate, alkali metal thiocyanates, alkali metal halides, benzylalcohol, water softeners and thickeners, and development accelerators, etc.

Additives other than the above-mentioned, to be added to the above color developing solution, may include anti-stain agents, anti-sludge agents, preservatives, interlayer effect accelerators, chelating agents, etc.

The color developing solution of this invention is preferably used at pH 9 or more, particularly pH 9 to 13.

There is no particular limitation to the method of processing the light-sensitive photographic material of this invention, and any processing methods may be applied. For example, typical methods include (1) a method in which, after color developing, bleach-fixing processing is carried out and then water washing substitutive stabilizing processing or washing with water is carried out; (2) a method in which, after color developing, bleaching and fixing are separately carried out, and then water washing substitutive stabilizing processing or washing with water is carried out; (3) a method in which processing is carried out in the order of prehardening, neutralizing, color developing, stop fixing, water washing substitutive stabilizing processing (or washing with water), bleaching, fixing, water washing substitutive stabilizing processing (or washing with water), post-hardening, and water washing substitutive stabilizing processing (or washing with water); (4) a method in which processing is carried out in the order of color developing, water washing substitutive stabilizing processing (or washing with water), supplementary color developing, stopping, bleaching, fixing, water washing substitutive stabilizing processing (or washing with water), and stabilizing; and (5) a developing method in which developed silver produced by color developing is subjected to halogenation bleaching, and thereafter color developing is again carried out to increase the quantity of the dye to be formed; any of which may be used to carry out the processing. Among these, preferred are methods (1), (2) and (4).

In this invention, the processing may be carried out by use of a processing solution having a bleaching ability. This means that the processing is carried out using a bleaching solution or a combined bleach-fixing solution, and it is a case when the combined bleachfixing processing is carried out that desirable effects of this invention can be exhibited.

Bleaching agent used for the bleaching solution or the bleach-fixing solution in the bleaching processing is generally known to include a compound obtained by coordinating a metal ion such as iron, cobalt and copper with an aminopolycarboxylic acid or an organic acid such as oxalic acid and citric acid. Typical examples of the above aminopolycarboxylic acid may include the following:

Ethylenediaminetetraacetic acid

Diethylenetriaminepentaacetic acid

Propylenediamineteraacetic acid
Nitrilotriacetic acid
Iminodiacetic acid
Glycol ether diaminetetraacetic acid
Ethylenediaminetetrapropionic acid
Disodium ethylenediaminetetraacetate
Pentasodium diethylenetriaminepentaacetate
Sodium nitrilotriacetate The bleaching solution and bleach-fixing solution used in this invention can be used at pH 0.2 to 9.5, preferably 4.0 or more, and more preferably 5.0 or more. The processing may be carried out at a temperature of 20° C. to 80° C., desirably 40° C. or more.

The bleaching solution used in this invention may contain various additives together with the above bleaching agents (preferably an organic acid ferric complex salt). The additives to be particularly preferably contained include alkali halides or ammonium halides, for example, potassium bromide, sodium bromide, sodium chloride, ammonium bromide, potassium iodide, sodium iodide, ammonium iodide, etc. There can be also added pH buffering agents such as borate, oxalate, acetate, carbonate and phosphate; solubilizing agents such as triethanolamine; and those usually known as additives to a bleaching solution, such as acetylacetones, phosphonocarboxylic acids, polyphosphoric acids, organic phosphoric acids, oxycarboxylic acids, polycarboxylic acids, alkylamines, and polyethylene oxides.

As the bleach-fixing solution of this invention, there can be used a bleach-fixing solution comprising the formulation to which a small amount of a halogen compound such as potassium bromide has been added, or, on the contrary, a bleach-fixing solution comprising the formulation to which a large amount of a halogen compound such as potassium bromide and ammonium bromide has been added, also a bleach-fixing solution comprising a special formulation comprising the combination of the bleaching solution of this invention with a large amount of a halogen compound such as potassium bromide, or the like.

The above halogen compound that can be also used, besides potassium bromide, may include hydrochloric acid, hydrobromic acid, lithium bromide, sodium bromide, ammonium bromide, potassium iodide, sodium iodide, ammonium iodide, etc.

Typical examples of a silver halide fixing agent contained in the bleach-fixing solution or the fixing solution of this invention may include compounds capable of forming a water soluble complex salt by reacting with silver halide, which are used in ordinary fixing processing; for example, thiosulfates such as potassium thiosulfate, sodium thiosulfate and ammonium thiosulfate; thiocyanates such as potassium thiocyanate, sodium thiocyanate and ammonium thiocyanate; thioureas; thioethers; highly concentrated bromides or iodides; etc. These fixing agents can be used in an amount of the range in which they can be dissolved in amount of 5 g/lit or more, preferably 50 g/lit or more, and more preferably 70 g/lit or more.

As in the case of the bleaching solution, the bleach-fixing solution or the fixing solution used in this invention may also contain, alone or in combination of two or more kinds, pH buffuring agents comprising a variety of salts such as boric acid, borax, sodium hydroxide, potassium hydroxide, sodium carbonate, potassium carbonate, sodium bicarbonate, potassium bicarbonate, acetic acid, sodium acetate, and ammonium hydroxide. It can still also contain various brightening agents and anti-foaming agents, or surface active agents and anti-fungus agents. It can also appropriately contain preservatives such as hydroxyamine, hydrazine, sulfite, isomeric sulfite, and bisulfite addition products of aldehyde or ketone compounds; organic chelating agents such as acetylacetone, phosphonocarboxylic acid, polyphosphoric acid, organic phosphonic acid, oxycarboxylic acid, polycarboxylic acid, dicarboxylic acid, and aminopolycarboxylic acid; stabilizers such as nitroalcohol and nitrate; solubilizing agents such as alcanolamine; antistain agents such as organic amine; and other additives or organic solvents such as methanol, dimethylformamide, dimethylsulfoxide, etc.

In the processing method employing the processing solution of this invention, most preferable processing is to carry out bleaching or bleach-fixing immediately after color developing, and preferably a processing solution used in the step following the color developing has a specific gravity of 1.1 or more. However, bleaching or bleach-fixing may be carried out after washing with water or rinsing and stopping have been carried out after color developing, or a prebath containing a bleaching accelerating agent may be used as a processing solution preceeding the bleach-fixing.

Processing steps for the processing other than the color developing of light-sensitive silver halide color photographic material of this invention, for example, bleach-fixing (or bleaching and fixing), washing with water or water washing substitutive stabilizing which may be optionally carried out, processing by a final stabilizing solution containing formalin or an activator, etc., may be carried out preferably at a processing temperature of 20° C. to 80° C., more preferably 40° C. to 80° C.

In this invention, it is preferred to carry out a water washing substitutive stabilizing processing as disclosed in Japanese Unexamined Patent Publications No. 14834/1983, No. 105145/1983, No. 134634/1983 and No. 18631/1983; Japanese Unexamined Patent Publications No. 126533/1984 and 23365/1985; etc.

The silver halide emulsion layers according to this invention can each contain a coupler, namely a compound capable of forming a dye by reacting with an oxidized product of the color developing agent.

As the above coupler employed in this invention, various yellow couplers and magenta couplers can be used without any particular limitation. These couplers are of either the so-called two equivalent type or four equivalent type, and it is also possible to use a diffusible dye releasing type coupler in combination with these couplers.

As for the above yellow coupler, a closed ketomethylene compound, and also the so-called two equivalent type coupler including an active site o-aryl substituted coupler, an active site o-acyl substituted coupler, an active site hydantoin compound substituted coupler, an active site urazol compound substituted coupler, an active site succinimide compound substituted coupler, an active site fluorine substituted coupler, an active site chlorine or bromine substituted coupler, an active site o-sulfonyl substituted coupler, etc. can be used as effective yellow couplers. Examples of usable yellow couplers may include those described in U.S. Pat. Nos. 2,875,057, 3,265,506, 3,408,194, 3,551,155, 3,582,322, 3,725,072, 3,891,445; West German Patent No. 15 47 868; West German laid-open Patent Publications No. 22 19 917, No. 22 61 361 and No. 24 14 006; British Patent No. 1,425,020; Japanese Patent Publication No.

10783/1976; Japanese Unexamined Patent Publications No. 26133/1972, No. 73147/1973, No. 102636/1976, No. 6341/1975, No. 123342/1975, No. 130442/1975, No. 21827/1976, No. 87650/1975, No. 82424/1977, No. 115219/1977 and No. 95346/1983; etc.

The magenta coupler used in this invention may include compounds of pyrazolone type, pyrazolotriazole type, pyrazolinobenzimidazole type or indazolone type. Similar to the yellow coupler, these magenta couplers may include not only the four equivalent type couplers but also two equivalent type couplers. Example of the magenta couplers may include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and No. 3,891,445; West German Patent No. 18 10 464; West German laid-open Patent Publications (OLS) No. 24 08 665, No. 24 17 945, No. 24 18 959 and No. 24 24 467; Japanese Patent Publication No. 6031/1965; Japanese Unexamined Patent Publications No. 20826/1976, No. 58922/1977, No. 129538/1974, No. 74027/1974, No. 159336/1975, No. 42121/1977, No. 74028/1974, No. 60233/1975, No. 26541/1976 and No. 55122/1978; Japanese Patent Application No. 110943/1980; etc.

In this invention, a cyan coupler other than the cyan coupler of this invention may be used together, and such cyan coupler may include, for example, phenol type and naphthol type couplers outside of this invention. Similar to the yellow couplers, these cyan couplers may include not only the four equivalent type couplers but also two equivalent type couplers. Examples of the cyan couplers may include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494 and 4,004,929; West German laid-open Patent Publications (OLS) No. 24 14 830 and No. 24 54 329; Japanese Unexamined Patent Publications No. 59838/1973, No. 26034/1976, No. 5055/1973, No. 146827/1976, No. 69624/1977, No. 90932/1977 and No. 95346/1983; Japanese Patent Publication No. 11572/1974; etc.

In the silver halide emulsion layer of this invention and the other photographic constituent layer, couplers such as a colored magenta or cyan coupler and a polymer coupler may be used together. As to the colored magenta or cyan coupler, there can be made reference to the description in Japanese Patent Application No. 19361/1984 filed by the present applicant, and as to the polymer coupler, to Japanese Patent Application No. 172151/1984 filed by the present applicant, respectively.

The above couplers usable in this invention may be added to the photographic constituent layer according to a conventional method, and also may be added in an amount, though not limitative, preferably of $1\times10^{-3}$ mole to 5 moles, more preferably $1\times10^{-2}$ to $5\times10^{-1}$ mole, per 1 mole of silver.

The light-sensitive silver halide color photographic material of this invention can contain other various photographic additives. For example, there can be used antifoggants, stabilizers, ultraviolet absorbents, color stain preventing agents, brightening agents, color image fading preventing agents, antistatic agents, hardeners, surface active agents, plasticizers, wetting agents, etc. described in Research Disclosure No. 17643.

In the light-sensitive silver halide color photographic material of this invention, a hydrophilic colloid used for the preparation of an emulsion may discretionally include gelatin, a derivative gelatin, a graft polymer of gelatin with other macromolecule, proteins such as albumin and casein, cellulose derivatives such as a hydroxyethyl cellulose derivative and a carboxymethyl cellulose derivative, starch derivatives, synthetic hydrophilic macromolecules comprising homopolymers or copolymers such as polyvinyl alcohol, polyvinyl imidazole and polyacrylamide, etc.

The support used for the light-sensitive silver halide color photographic material of this invention may include, for example, glass plates, polyester films such as films made of cellulose acetate, cellulose nitrate or polyethylene terephthalate, polyamide films, polycarbonate films, polystyrene films, etc. These supports may be suitably selected according to use purposes of light-sensitive materials.

In the light-sensitive materials of this invention, an intermediate layer having a suitable thickness may be optionally provided depending on the purposes, and also various layers such as a filter layer, a curling preventing layer, a protective layer and an anti-halation layer can be used as constituent layers in appropriate combination. In these constituent layers, the hydrophilic colloid that can be used in emulsion layers as mentioned above can be similarly used as a binding material, and, in the layers, the various photographic additives that can be contained in emulsion layers as mentioned above can be also contained.

The processing method of this invention can be applied in light-sensitive silver halide color photographic materials such as color negative films, color positive films, color reversal films for slides, color reversal films for movies, and color reversal films for televisions.

EXAMPLES

Specific examples of this invention will be described below, but the working embodiments of this invention are by no means limited to these.

In the examples, graininess (RMS) is determined by comparing a 1,000 time value of standard deviation in the variation in density values caused when color images having a color image density of 1.0 are scanned by use of a microdensitometer having a round scanning aperture diameter of 25 μm.

Also, in the following examples, the amount of addition in the light-sensitive silver halide color photographic material is shown based on 1 m2, and silver halide and colloidal silver are shown in terms of silver.

EXAMPLE 1

Silver iodobromide emulsions shown in Table 1 were prepared according to the following production methods. Emulsion A was produced according to a usual double jet method. Emulsions B to D are core/shell type monodispersed emulsions produced according to a function addition method. Emulsion E is a tabular silver halide emulsion produced according to a double jet method while controlling pH and PAg.

TABLE 1

| | Mean grain size (μm) | Silver halide content in the range of r + 20% | Average iodide content (%) | Silver iodide content in core (%) | Silver iodide content in shell (%) | Volume ratio of shell (%) |
|---|---|---|---|---|---|---|
| A | 0.5 | 55 | 6 | Round grain emulsion | — | — |
| B | 0.5 | 87 | 7 | 10 | 4 | 50 |
| C | 0.5 | 83 | 6 | 10 | 2 | 50 |
| D | 0.5 | 82 | 8.5 | 15 | 2 | 50 |
| E | 0.6 | 70 | 6 | Tabular silver halide emulsion having grain diameter 10 times larger than grain thickness | | |

The following respective layers were successively applied on a cellulose triacetate support to produce samples of multi-layer color films.

First layer: Antihalation coating (HC layer)

An antihalation coating comprising 0.18 g of black colloid and 1.5 g of gelatin.

Second layer: Subbing layer (IG layer)

A subbing layer comprising 2.0 g of gelatin.

Third layer: Red-sensitive silver halide emulsion layer (R layer)

A red-sensitive silver halide emulsion layer containing dispersed matters formed by dissolving 4.0 g of each of the silver iodobromide emulsion shown in the above Table 1 and color sensitized to have red sensitivity, 0.08 mole/mole Ag of cyan coupler (C), 0.006 mole/mole Ag of colored cyan coupler (CC-1), and DIR compound shown in Table 2, in 0.5 g of tricrezylphosphate (hereinafter "TCP"), and dissolving a restrainer in methanol, followed by emulsification dispersion of the solutions in an aqueous solution containing 1.80 g of gelatin.

Fourth layer: Intermediate layer (2G layer)

An intermediate layer comprising 0.14 g of 2,5-di-t-butylhydroquinone and 0.07 g of dibutyl phthalate (hereinafter "DBP").

Fifth layer: Green-sensitive silver halide emulsion layer (G layer)

A green-sensitive silver halide emulsion layer containing dispersed matters formed by dissolving 4.0 g of each of the silver iodobromide shown in the above Table 1 and color sensitized to have green sensitivity, 0.07 mole/mole Ag of magenta coupler (M-1), 0.015 mole/mole Ag of colored magenta coupler (CM-1), and DIR compound shown in Table 2, in 0.64 g of TCP, followed by emulsification dispersion of the solution in an aqueous solution containing 1.4 g of gelatin. Sixth layer: Protective layer (3G layer) A protective layer containing 0.8 g of gelatin.

In each of the layers, besides the above, a gelatin hardener (1,2-bisvinylsulfonyl ethane) and a surface active agent were contained; the silver halide emulsion shown in Table 1 and the DIR compound shown in Table 2 or a restrainer were added to R layer of the third layer and G layer of the fifth layer; and the ratio of developed silver amount to coated silver amount was controlled to be within the range of this invention, thereby obtaining samples.

Cyan coupler (C):

2-(α,α,β,β,γ,γ, δ,δ-Octafluorohexanamido)-5-[2(2,4-di-t-amylphenoxy)hexanamido]phenol.

Colored cyan coupler (CC-1):

Disodium 1-hydroxy-4-[4-(1-hydroxy-8-acetamido3,6-disulfo-2-naphtylazo)phenoxy]-N-δ-(2,4-di-t-amylphenoxy)butyl]-2-naphtamide.

Magenta coupler (M-1):

1-(2,4-6-Trichlorophenyl)-3-([δ-(2.4,-di-t-amylphenoxy)-acetamido]benzamido)-3-pyrazolone, and -(2,4-6-trichlorophenyl)-3-([δ-(2,4-di-t-amylphenoxy)acetamido]benzamido)-4-(4-methoxyphenylazo)-5-pyrazolone.

Colored magenta coupler (CM-1):

1-(2,4-6-Trichlorophenyl)-4-d(1-naphthylazo)-3-(2-chloro-5-octadecenylsuccinimidoanilino)-5-pyrazolone.

Green light, red light and green light +red light (16 CMS) were irradiated to each sample through a wedge, and processing was carried out according to the following steps to obtain color images.

| Processing steps: | |
|---|---|
| Color developing | Time and temperature as shown in Table 2 |
| Bleaching | 6 min. 30 sec. (38° C.) |
| Fixing | 6 min. 30 sec. (30 to 38° C.) |
| Washing with water | 3 min. 15 sec. (20 to 33° C.) |
| Stabilizing | 3 min. 15 sec. (20 to 33° C.) |
| Drying | |

In each processing step, the processing solution used had the following formulation.

| | |
|---|---|
| [Color developing solution] | |
| Sulfate of the above Exemplary Compound (E-2) | 4.75 g |
| Sodium sulfurous anhydride | 4.25 g |
| Hydroxylamine.½ sulfate | 2.0 g |
| Potassium carbonic anhydride | 30.0 g |
| Sodium bromide | 1.3 g |
| Trisodium nitrilotriacetate (monohydrate) | 2.5 g |
| Potassium hydroxide | 1.0 g |
| Made up to 1 lit. by adding water. | |
| [Bleaching solution] | |
| Ethylenediaminetetraacetic acid iron ammonium salt | 100.0 g |
| Diammonium ethylenediaminetetraacetate | 10.0 g |
| Ammonium bromide | 150.0 g |
| Glacial acetic acid | 10.0 ml |
| Made up to 1 lit. by adding water, and adjusted to pH = 6.0 using ammonia water. | |
| [Fixing solution] | |
| Ammonium thiosulfate | 175.0 g |
| Sodium sulfurous anhydride | 8.5 g |
| Sodium metasulfite | 2.3 g |
| Made up to 1 lit. by adding water, and adjusted to pH = 6.0 using acetic acid. | |
| [Stabilizing solution] | |
| Formalin (37% aqueous solution) | 1.5 ml |
| Konidux (produced by Konishiroku Photo Industry, Co., Ltd.) | 7.5 ml |
| Made up to 1 lit. by adding water. | |

Graininess (RMS) obtained is shown in Table 2.

The amount of addition of the DIR compound to each color sensitive layer has been controlled so as to give desensitization and density fall substantially equal in each layer. Developed silver amount at a maximum density portion after each processing was also measured to find that, in all of Tests 1 to 15, it ranged between 15 and 25% based on coated silver amount.

TABLE 2

| Test No. | Green-sensitive silver halide emulsion layer: Emulsion | Compound | Amount ($\times 10^{-2}$ mol/molAg) | Red-sensitive silver halide emulsion layer: Emulsion | Compound | Amount ($\times 10^{-2}$ mol/molAg) | Color developing: Time (min.) | Temp. (°C.) | RMS G | RMS R |
|---|---|---|---|---|---|---|---|---|---|---|
| Comparative Example: | | | | | | | | | | |
| 1 | A | — | — | A | — | — | 1.0 | 55 | 45 | 39 |
| 2 | A | D-11 | 0.4 | A | D-11 | 0.5 | 1.0 | 55 | 41 | 34 |
| 3 | B | — | — | B | — | — | 1.0 | 55 | 43 | 35 |
| 4 | E | — | — | E | — | — | 1.0 | 55 | 42 | 35 |
| 5 | B | D-11 | 0.4 | B | D-11 | 0.5 | 3.5 | 37 | 41 | 34 |
| 6 | B | D-11 | 0.4 | B | D-11 | 0.5 | 2.5 | 40 | 40 | 33 |
| The invention: | | | | | | | | | | |
| 7 | B | D-11 | 0.4 | B | D-11 | 0.5 | 2.0 | 43 | 28 | 24 |
| 8 | B | D-11 | 0.4 | B | D-11 | 0.5 | 1.5 | 49 | 24 | 20 |
| 9 | B | D-11 | 0.4 | B | D-11 | 0.5 | 1.0 | 55 | 17 | 15 |
| 10 | C | D-14 | 0.4 | C | D-13 | 0.5 | 1.0 | 55 | 17 | 15 |
| 11 | D | D-58 | 0.4 | E | D-4 | 0.5 | 1.0 | 55 | 17 | 16 |
| 12 | E | D-13 | 0.4 | E | D-11 | 0.5 | 1.0 | 55 | 18 | 16 |
| 13 | B | A-1 | 2.0 | B | A-1 | 2.0 | 1.0 | 55 | 24 | 20 |
| 14 | B | B-1 | 0.05 | B | B-1 | 0.05 | 1.0 | 55 | 26 | 22 |
| 15 | D | B-1 | 0.05 | B | A-1 | 2.0 | 1.0 | 55 | 26 | 20 |

As will be clear from Table 2, as compared with the comparative Tests 1 to 6, Tests 7 to 15 according to this invention result in smaller graininess (RMS), and, even by visual observation, the graininess can be found to have been improved. The results are understood to be very desirable.

EXAMPLE 2

Similar to the core/shell type silver iodobromide emulsions B to D used in Example 1, emulsions were produced to have a shell thickness of 0.05 μm and to have a silver iodobromide content as shown in Table 3, and, in addition, similar to the tabular silver halide emulsion layer E, emulsions were produced to have a silver iodide content as shown in Table 3. The above core/shell type emulsions were used in green-sensitive layers and the tabular emulsions in red-sensitive layers to produce Samples No. 16 to No. 29 according to the procedures described in Example 1, with coated silver amounts varied as shown in Table 3. Also, $0.2\times10^{-2}$ mole/mole Ag of Exemplary Compound D-11 and $1.0\times10^{-2}$ mole/mole Ag of Exemplary Compound A-1 were added to green-sensitive layers, and $0.2\times10^{-2}$ mole/mole Ag of Exemplary Compound D-14 and $0.02\times10^{-2}$ mole/mole Ag of Exemplary Compound B-1 were added to red-sensitive layers.

After exposure of Samples No. 16 to No. 29, color developing processings were carried out for 3 minutes and 30 seconds at 38° C. and for 1 minute at 55° C,, respectively, using the same processing solution and processing steps as in Example 1.

The temperature that can attain substantially equal sensitivity in the respective processing was 38° C. when processed for 3 minutes and 30 seconds, while it was 55° C. when processed for 1 minutes.

Graininess (RMS) of the samples thus processed were measured. RMS improvement ratio was calculated according to the following formula to show the results in Table 3.

$$\text{RMS improvement ratio (\%)} = \frac{\text{3'30", 380° C. RMS value} - \text{1', 55° C. RMS value}}{\text{3'30", 38° C. RMS value}} \times 100$$

TABLE 3

| | Sample No. | Silver iodide content (mole %) | Coated silver amount (mg/dm²) | Developed silver/Coated silver (%): G | Developed silver/Coated silver (%): R | RMS improvement ratio (%): G | RMS improvement ratio (%): R |
|---|---|---|---|---|---|---|---|
| Comparative Example | 16 | 2.0 | 80 | 43 | 48 | 2 | 2 |
| The invention | 17 | 3.0 | 80 | 35 | 39 | 25 | 20 |
| The invention | 18 | 4.0 | 80 | 29 | 32 | 43 | 37 |
| The invention | 19 | 5.0 | 80 | 23 | 26 | 58 | 51 |
| The invention | 20 | 10.0 | 80 | 19 | 22 | 56 | 48 |
| The invention | 21 | 15.0 | 80 | 16 | 19 | 41 | 35 |
| The invention | 22 | 20.0 | 80 | 14 | 17 | 33 | 28 |
| Comparative Example | 23 | 7.0 | 10 | 75 | 83 | 3 | 2 |
| The invention | 24 | 7.0 | 12 | 50 | 58 | 17 | 3 |
| The invention | 25 | 7.0 | 25 | 30 | 36 | 49 | 34 |
| The invention | 26 | 7.0 | 70 | 21 | 25 | 61 | 55 |
| The invention | 27 | 7.0 | 130 | 15 | 18 | 62 | 55 |
| The invention | 28 | 7.0 | 160 | 10 | 13 | 54 | 48 |
| The invention | 29 | 7.0 | 250 | 7 | 9 | 43 | 40 |

As will be seen from Table 3, the value of [Developed silver amount at the maximum density portion]/[Total silver amount] becomes 0.5 or less to improve the graininess when the silver iodide content is 3 mole % or more in this invention. The results are under stood to be very desirable.

EXAMPLE 3

Using Sample No. 26 of Example 2, the effect to be achieved by the addition of a restrainer to a color developing solution was examined. Color developing processings were carried out under color developing of 1 minute and 55° C. using the processing solution and processing steps of Example 1 while adding the restrainer as shown in Table 4 to the developing solution, and graininess (RMS value) was measured.

TABLE 4

| Restrainer | | RMS | |
|---|---|---|---|
| Compound | Amount | G | R |
| None | — | 20 | 22 |
| Z-4 | 20 (mg/l) | 20 | 20 |
| Z-27 | 20 (mg/l) | 20 | 20 |
| Z-42 | 2.0 (g/l) | 18 | 20 |
| Z-20 | 2.0 (g/l) | 18 | 20 |
| Z-5 | 0.5 (g/l) | 15 | 18 |
| Z-14 | 50 (mg/l) | 15 | 18 |
| Z-26 | 50 (mg/l) | 15 | 18 |
| Z-18 | 100 (mg/l) | 18 | 20 |
| Z-21 | 100 (mg/l) | 18 | 20 |
| Z-28 | 2,000 (mg/l) | 18 | 20 |
| Z-7 | 50 (mg/l) | 18 | 20 |
| Z-30 | 20 (mg/l) | 16 | 20 |
| Z-39 | 20 (mg/l) | 18 | 20 |
| Z-65 | 500 (mg/l) | 19 | 20 |

As will be clear from Table 4, it can be found preferable to add an organic restrainer in the color developing solution.

EXAMPLE 4

Following the procedures for the production of light-sensitive materials in Example 1, a light-sensitive material having layers upper than the fifth layer, namely, layers of the sixth or upper layers, coated with emulsions to give the respective emulsion layers as shown below, was produced under the same silver iodobromide content and coated silver amount as those of Sample No. 26 in Example 2.

Sixth layer:

A yellow filter layer containing 0.11 g of DBP in which 0.3 g of yellow colloidal silver and 0.2 g of an antistaining agent (2,5-di-t-octylhydroquinone) were dissolved, and 2.1 g of gelatin were dissolved.

Seventh layer:

A low sensitivity blue-sensitive silver halide emulsion layer containing 0.93 g of DBP in which 1.02 g of low sensitivity blue-sensitive silver iodobromide (AgI: 4 mole %), 1.9 g of gelatin and 1.84 g of α-[4-(1-benzyl-2-phenyl-3,5-dioxo-1,2,4triazolidinyl)]-α-pivaloyl-2-chloro-5-[γ-(2,4-di-t-amylphenoxy)-butanamide]acetoanilide [hereinafter referred to as "yellow coupler (Y-1)"] were dissolved.

Eighth layer:

A high sensitivity blue-sensitive silver halide containing 0.23 g of DBP in which 1.6 g of high sensitivity monodispersed blue-sensitive silver iodobromide emulsion layer (AgI: 4 mole %), 2.0 g of gelatin and 0.46 g of yellow coupler (Y-1).

Ninth layer:

A protective layer comprising gelatin (which is the same as the sixth layer in Example 1).

On the above sample of light-sensitive material, an experiment was carried out in the same manner as in Example 2 to reveal that there were obtained substantially the same results as those for [Developed silver amount at the maximum density portion]/[Total silver amount](%) and RMS improvement ratio (%) of Sample 26 of Example 2.

EXAMPLE 5

Example 1 was repeated except that the processing steps were altered as shown below and a bleach-fixing solution having the formulation as shown below was used in place of the bleaching solution and the fixing solution, and tests for Test Nos. 30 to 44 corresponding to Test Nos. 1 to 15, respectively, in Table 2 were carried out to obtain substantially the same results as in Example 1.

| Processing steps: | |
|---|---|
| Color developing | Time and temperature as shown in Table 2 |
| Bleach-fixing | 4 min. (38° C.) |
| Washing with water | 1 min. (20 to 33° C.) |
| Stabilizing | 30 sec. (20 to 33° C.) |
| Drying | |
| [Bleach-fixing solution] | |
| Ethylenediaminetetraacetic acid iron ammonium salt | 200 g |
| Diammonium ethylenediaminetetraacetate | 2.0 g |
| Ammonia water (28% aqueous solution) | 20.0 g |
| Ammonium thiosulfate | 175.0 g |
| Sodium sulfurous anhydride | 8.5 g |
| Sodium metasulfite | 2.3 g |
| 2-Amino-5-mercapto-1,3,4-thiadiazole | 1.5 g |
| Made up to 1 lit. by adding water, and adjusted to pH = 6.6 using acetic acid and ammonia water. | |

EXAMPLE 6

Example 2 was repeated except that the bleach-fixing solution as shown in Example 5 was used and the processing steps as shown in Example 5 were followed, to carry out tests for Test Nos. 45 to 58 corresponding to Sample Nos. 16 to 29, respectively, in Table 3 were carried out to obtain substantially the same results as in Example 2.

EXAMPLE 7

Using Sample No. 55 of Example 6, the effect to be achieved by the addition of a restrainer to a color developing solution was examined. Color developing processings were carried out under color developing of 1 minute and 55° C. using the processing solution and processing steps of Example 1 while adding the restrainer as shown in Table 4 to the developing solution, and graininess (RMS value) was measured. As a result, there were obtained substantially the same results as in Example 3.

EXAMPLE 8

Following the procedures for the production of light-sensitive materials in Example 5, light-sensitive materials having layers upper than the fifth layer, namely, layers of the sixth or upper layers, coated with emulsions to give the respective emulsion layers as shown below, were produced under the same silver iodobromide content and coated silver amount as those of Sample No. 55 in Example 6.

Sixth layer:

A yellow filter layer containing 0.11 g of DBP in which 0.3 g of yellow colloidal silver and 0.2 g of an antistaining agent (2,5-di-t-octylhydroquinone) were dissolved, and 2.1 g of gelatin.

Seventh layer:

A low sensitivity blue-sensitive silver halide emulsion layer containing 0.93 g of DBP in which 1.02 g of low sensitivity blue-sensitive silver iodobromide (AgI: 4 mole %), 1.9 g of gelatin and 1.84 g of yellow coupler (Y-1) were dissolved.

Eighth layer:

A high sensitivity blue-sensitive silver halide emulsion layer containing 0.23 g of DBP in which 1.6 g of high sensitivity monodispersed silver iodobromide (AgI: 4 mole %), 2.0 g of gelatin and 0.46 g of yellow coupler (Y-1).

Ninth layer;

A protective layer comprising gelatin (which is the same as the sixth layer in Example 5).

Formulation of processing solutions used in this experiment is shown below.

| | |
|---|---|
| [Color developing solution (CD)] | |
| Potassium carbonate | 30.0 g |
| Sodium sulfite | 2.0 g |
| Hydroxylamine sulfate | 2.0 g |
| 1-Hydroxyethylidene-1,1-diphosphonic acid (60% aqueous solution) | 1.0 g |
| Potassium bromide | 1.2 g |
| Magnesium chloride | 0.6 g |
| Sodium hydroxide | 3.4 g |
| N-ethyl-N-β-hydroxyethyl-3-methyl-4-aminoaniline sulfate | 4.6 g |
| Hydroxyetyliminodiacetic acid | 3.0 g |
| Z-5 (organic restrainer) | 0.2 g |
| Made up to 1 lit. by adding water, and adjusted to pH = 10.2 using potassium hydroxide and sulfuric acid. | |
| [Bleach-fixing solution (BF)] | |
| Ethylenediaminetetraacetic acid iron diammonium salt | 7.5 g |
| Diethylenetriaminepentaacetic acid iron (II) ammonium complex salt | 150.0 g |
| Ammonium sulfite (50% aqueous solution) | 20.0 ml |
| Ammonium thiosulfate (70% aqueous solution) | 250.0 ml |
| 2-Amino-5-mercapto-1,3,4-thiadiazole | 1.5 g |
| Ammonia water (28% aqueous solution) | 20.0 g |
| Made up to 1 lit. by adding water, and adjusted to pH = 7.5 using acetic acid and ammonia water. | |
| [Bleaching solution (BL)] | |
| Ethylenediaminetetraacetic acid iron (II) ammonium complex salt | 200.0 g |
| Ammonium bromide | 180.0 g |
| Made up to 1 lit. by adding water, and adjusted to pH = 6.0 using ammonia water. | |
| [Fixing solution (Fix)] | |
| Ammonium thiosulfate (70% aqueous solution) | 250.0 ml |
| Ammonium sulfite (40% aqueous solution) | 25.0 ml |
| Made up to 1 lit. by adding water, and adjusted to pH = 7.0 using acetic acid and ammonia water. | |
| [Washing with flowing water (W)] | |
| Tap water | |
| [Water washing substitutive stabilizing solution (SS)] | |
| 1-Hydroxyethylidine-1,1-diphosphonic acid (60% aqueous solution) | 3.0 g |
| 5-Chloro-2-methyl-4-isothiazolin-3-on | 0.1 g |
| 2-Methyl-4-isothiazolin-3-on | 0.1 g |
| Ethylene glycol | 1.0 g |
| Made up to 1 lit. by adding water, and adjusted to pH = 7.1 using potassium hydroxide. | |
| [Final stabilizing solution (ST)] | |
| Formalin (37% aqueous solution) | 7.0 ml |
| 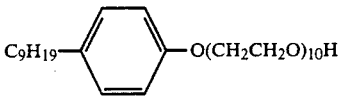 | 1.0 ml |
| Made up to 1 lit. by adding water. | |

Using the above processing solutions and following processing steps, Temperature and time for the respective Test Nos. 59 to 69 shown in Table 6, the processings of the light-sensitive materials produced in the above, made to have a width of 35 mm each, were carried out, and a half of the materials having been processed was passed through a roller conveyor type drying machine for drying. Samples of the other half of the materials were hung in a drying box and dried with hot air in the manner that they may not be in touch with each other, and thereafter passed twice through a negative printing frame of a color printer 5NS (produced by Konishiroku Photo Industry Co., Ltd.).

Number of scratches found on light-sensitive materials by visual observation of each of the samples, is shown in Table 6 as scratched portion(s) per 1 m of the sample measured. Meanwhile, the color development levels were controlled by varying temperature relative to time so that substantially the same sensitivities could be attained.

TABLE 6

| Test No. | Processing steps, temp. and time | Processing solution immersion time | Number of scratch caused by drying (Portion/m) | Number of scratch caused by printing frame (Portion/m) | Remarks |
|---|---|---|---|---|---|
| 59 | CD(39° C., 3 min 15 sec)-BF(38° C., 3 min)-W(30° C., 1 min)-ST(30° C., 45 sec) | 8 min | 1 | 3 | * |
| 60 | CD(40° C., 3 min)-BL(38° C., 6 min)-Fix(30° C., 4 min)-W(30° C., 1 min)-ST(30° C., 1 min) | 15 min | 2 | 3 | * |
| 61 | CD(55° C., 1 min)-BL(38° C., 6 min)-Fix(30° C., 4 min)-W(30° C., 2 min)-ST(30° C., 1 min) | 14 min | 28 | 58 | * |
| 62 | CD(48° C., 2 min)-BF(38° C., 4 min 45 sec)-W(30° C., 2 min)-ST(30° C., 1 min) | 9 min 45 sec | 23 | 44 | * |
| 63 | CD(55° C., 1 min)-BL(38° C., 3 min)-Fix(30° C., 3 min)-W(30° C., 1 min)-ST(30° C., 1 min) | 9 min | 15 | 21 | ** |
| 64 | CD(55° C., 1 min)-BF(38° C., 6 min)-W(30° C., 1 min)-ST(30° C., 1 min) | 9 min | 13 | 18 | ** |
| 65 | CD(55° C., 1 min)-BF(38° C., 6 min)-SS(30° C., 1 min)-ST(30° C., 1 min) | 9 min | 11 | 16 | ** |
| 66 | CD(55° C., 1 min)-BF(38° C., 4 min)-W(30° C., 1 min)- | 7 min | 7 | 10 | ** |

TABLE 6-continued

| Test No. | Processing steps, temp. and time | Processing solution immersion time | Number of scratch caused by drying (Portion/m) | Number of scratch caused by printing frame (Portion/m) | Remarks |
|---|---|---|---|---|---|
| | ST(30° C., 1 min) | | | | |
| 67 | CD(55° C., 1 min)-BF(38° C., 4 min)-SS(30° C., 1 min)-ST(30° C., 1 min) | 7 min | 5 | 7 | ** |
| 68 | CD(55° C., 1 min)-BF(38° C., 3 min)-ST(30° C., 1 min) | 5 min | 2 | 3 | ** |
| 69 | CD(48° C., 2 min)-BF(38° C., 3 min)-ST(30° C., 1 min) | 6 min | 2 | 3 | ** |

*Comparative Example,
**The invention

As will be seen from Table 6, in the cases where the color development is inactive and a color developing time is about 3 minutes or so as in Test Nos. 59 and 60, very a little scratch was produced in the light-sensitive materials without regard to the processing solution immersion time. However, it is seen that, in the cases where the color development is active and the developing time is two minutes or less, scratches on light-sensitive materials are produced in a large number when the processing solution immersion time is long as in, for example, in Test Nos. 61 and 62, and, on the other hand, the number of scratches of light-sensitive materials steeply decreases very desirably when the processing solution immersion time is 9 minutes or less as in Test Nos. 63 to 69 according to this invention.

EXAMPLE 9

Example 5 was repeated except that 0.08 mole/mole Ag of Exemplary Compound (C-1), a cyan coupler of this invention, was used in the third layer in place of cyan coupler (C), to carry out tests for Test Nos. 70 to 84 to obtain the results shown in Table 7.

TABLE 7

| Test | Green-sensitive silver halide emulsion layer: Emulsion | Compound | Amount ($\times 10^{-2}$ mol/molAg) | Red-sensitive silver halide emulsion layer: Emulsion | Compound | Amount ($\times 10^{-2}$ mol/molAg) | Color developing: Time (min.) | Temp. (°C.) | RMS G | RMS R |
|---|---|---|---|---|---|---|---|---|---|---|
| Comparative Example | | | | | | | | | | |
| 70 | A | — | — | A | — | — | 1.0 | 55 | 45 | 40 |
| 71 | A | D-11 | 0.4 | A | D-11 | 0.5 | 1.0 | 55 | 41 | 35 |
| 72 | B | — | — | B | — | — | 1.0 | 55 | 43 | 36 |
| 73 | E | — | — | E | — | — | 1.0 | 55 | 42 | 36 |
| 74 | B | D-11 | 0.4 | B | D-11 | 0.5 | 3.5 | 37 | 41 | 35 |
| 75 | B | D-11 | 0.4 | B | D-11 | 0.5 | 2.5 | 40 | 40 | 34 |
| The invention | | | | | | | | | | |
| 76 | B | D-11 | 0.4 | B | D-11 | 0.5 | 2.0 | 43 | 28 | 25 |
| 77 | B | D-11 | 0.4 | B | D-11 | 0.5 | 1.5 | 49 | 24 | 21 |
| 78 | B | D-11 | 0.4 | B | D-11 | 0.5 | 1.0 | 55 | 17 | 15 |
| 79 | C | D-14 | 0.4 | C | D-13 | 0.5 | 1.0 | 55 | 17 | 15 |
| 80 | D | D-58 | 0.4 | E | D-4 | 0.5 | 1.0 | 55 | 17 | 16 |
| 81 | E | D-13 | 0.4 | E | D-11 | 0.5 | 1.0 | 55 | 18 | 17 |
| 82 | B | A-1 | 2.0 | B | A-1 | 2.0 | 1.0 | 55 | 24 | 21 |
| 83 | B | B-1 | 0.05 | B | B-1 | 0.05 | 1.0 | 55 | 26 | 22 |
| 84 | D | B-1 | 0.05 | B | A-1 | 2.0 | 1.0 | 55 | 26 | 21 |

As will be clear from Table 7, the graininess (RMS) is small in Test Nos. 76 to 84 according to this invention as compared with the comparative Test Nos. 70 to 75, and the graininess was found to have been improved even by visual observation, very desirably.

EXAMPLE 10

Example 6 was repeated except that the cyan coupler (C-1) shown in Example 9 was used, to carry out tests for Test Nos. 85 to 98, and graininess (RMS) of the samples obtained after processing was measured. Results obtained are shown in Table 8.

TABLE 8

| | Sample No. | Silver iodide content (mole %) | Coated silver amount (mg/dm$^2$) | Developed silver/Coated silver (%): G | Developed silver/Coated silver (%): R | RMS improvement ratio (%): G | RMS improvement ratio (%): R |
|---|---|---|---|---|---|---|---|
| Comparative Example | 85 | 2.0 | 80 | 43 | 46 | 2 | 1 |
| The invention | 86 | 3.0 | 80 | 35 | 38 | 25 | 19 |
| The invention | 87 | 4.0 | 80 | 29 | 31 | 43 | 36 |
| The invention | 88 | 5.0 | 80 | 23 | 25 | 58 | 50 |
| The invention | 89 | 10.0 | 80 | 19 | 21 | 56 | 47 |
| The invention | 90 | 15.0 | 80 | 16 | 18 | 41 | 35 |

TABLE 8-continued

| | Sample No. | Silver iodide content (mole %) | Coated silver amount (mg/dm²) | Developed silver/ Coated silver (%) G | R | RMS improvement ratio (%) G | R |
|---|---|---|---|---|---|---|---|
| The invention | 91 | 20.0 | 80 | 14 | 16 | 33 | 27 |
| Comparative Example | 92 | 7.0 | 10 | 75 | 81 | 3 | 1 |
| The invention | 93 | 7.0 | 12 | 50 | 56 | 17 | 2 |
| The invention | 94 | 7.0 | 25 | 30 | 34 | 49 | 33 |
| The invention | 95 | 7.0 | 70 | 21 | 24 | 61 | 56 |
| The invention | 96 | 7.0 | 130 | 15 | 17 | 62 | 54 |
| The invention | 97 | 7.0 | 160 | 10 | 13 | 54 | 47 |
| The invention | 98 | 7.0 | 250 | 7 | 9 | 43 | 40 |

As will be seen from Table 8, the value of Developed silver amount at the maximum density portion]/[Total silver amount] becomes 0.5 or less to improve the graininess when the silver iodide content is 3 moles % or more in this invention. The results are under stood to be very desirable.

EXAMPLE 11

Using Sample No. 95 of Example 10, the effect to be achieved by the addition of a restrainer to a color developing solution was examined. Color developing processings were carried out under color developing of 1 minute and 55° C. using the processing solution and processing steps of Example 9 while adding the restrainer as shown in Table 9 to the developing solution, and graininess (RMS value) and yellow minimum density were measured. Results obtained are shown in Table 9.

TABLE 9

| Restrainer Compound | Amount | RMS G | R | Yellow minimum density |
|---|---|---|---|---|
| None | — | 20 | 23 | 0.75 |
| Z-4 | 20 (mg/l) | 20 | 21 | 0.67 |
| Z-27 | 20 (mg/l) | 20 | 21 | 0.67 |
| Z-42 | 2.0 (g/l) | 18 | 21 | 0.66 |
| Z-20 | 2.0 (g/l) | 18 | 21 | 0.65 |
| Z-5 | 0.5 (g/l) | 15 | 19 | 0.64 |
| Z-14 | 50 (mg/l) | 15 | 19 | 0.65 |
| Z-26 | 50 (mg/l) | 15 | 19 | 0.65 |
| Z-18 | 100 (mg/l) | 18 | 21 | 0.66 |
| Z-21 | 100 (mg/l) | 18 | 21 | 0.66 |
| Z-28 | 2,000 (mg/l) | 18 | 21 | 0.66 |
| Z-7 | 50 (mg/l) | 18 | 21 | 0.67 |
| Z-30 | 20 (mg/l) | 16 | 20 | 0.65 |
| Z-39 | 20 (mg/l) | 18 | 21 | 0.65 |
| Z-65 | 500 (mg/l) | 19 | 21 | 0.67 |

EXAMPLE 12

Following the procedures for the production of light-sensitive materials in Example 9, light-sensitive materials having layers upper than the fifth layer, namely, layers of the sixth or upper layers, coated with emulsions to give the respective emulsion layers as shown below, were produced under the same silver iodobromide content and coated silver amount as those of Sample No. 95 in Example 10.

Sixth layer:

A yellow filter layer containing 0.11 g of DBP in which 0.3 g of yellow colloidal silver and 0.2 g of an antistaining agent (2,5-di-t-octylhydroquinone) were dissolved, and 2.1 g of gelatin.

Seventh layer:

A low sensitivity blue-sensitive silver halide emulsion layer containing 0.93 g of DBP in which 1.02 g of low sensitivity blue-sensitive silver iodobromide (AgI: 4 mole %), 1.9 g of gelatin and 1.84 g of yellow coupler (Y-1) were dissolved.

Eighth layer:

A high sensitivity blue-sensitive silver halide emulsion layer containing 0.23 g of DBP in which 1.6 g of high sensitivity monodispersed silver iodobromide (AgI: 4 mole %), 2.0 g of gelatin and 0.46 g of yellow coupler (Y-1).

Ninth layer:

A protective layer comprising gelatin (which is the same as the sixth layer in Example 9).

The above samples of light-sensitive materials were subjected to exposure with use of an interference filter (cyan separation exposure: 690 nm), and, in the same manner as in Example 10, color developings were carried out for 3 minutes and 30 seconds at 38° C. and for 1 minute at 55° C., respectively, using the same processing solution and processing steps as in Example 9.

To detect the improvement effect in image sharpness, MTF (modilation transfer function) was determined to compare the magnitude of MTF at spatial frequencies of 10 cycle/mm and 30 cycle/mm.

Results obtained are shown in Table 10.

Cyan coupler set forth in Table 10:

TABLE 10

| Sample No. | Cyan coupler | MTF Value (%) 10 cycle/mm CD 55° C., 1 min | CD 38° C., 3 min 30 sec | 30 cycle/mm CD 55° C., 1 min | CD 38° C., 3 min 30 sec | Remarks |
|---|---|---|---|---|---|---|
| 99 | Comparative Coupler (1) | 65 | 71 | 37 | 42 | * |
| 100 | Comparative Coupler (2) | 64 | 71 | 35 | 42 | * |
| 101 | C-1 | 95 | 74 | 64 | 43 | ** |
| 102 | C-3 | 93 | 77 | 67 | 45 | ** |
| 103 | C-8 + C-23 in equimolar amount | 95 | 69 | 61 | 39 | ** |
| 104 | C-3 + Comparative Coupler (2) | 78 | 72 | 50 | 41 | ** |

TABLE 10-continued

| Sample No. | Cyan coupler | MTF Value (%) 10 cycle/mm CD 55° C., 1 min | 10 cycle/mm CD 38° C., 3 min 30 sec | 30 cycle/mm CD 55° C., 1 min | 30 cycle/mm CD 38° C., 3 min 30 sec | Remarks |
|---|---|---|---|---|---|---|
| | in equimolar amount | | | | | |

* = Comparative Example
** = The invention

Comparative Coupler (1)

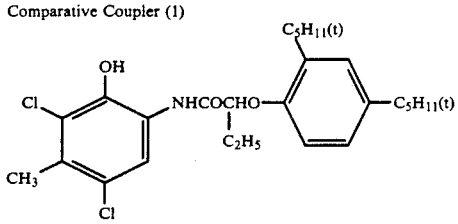

Comparative Coupler (2)

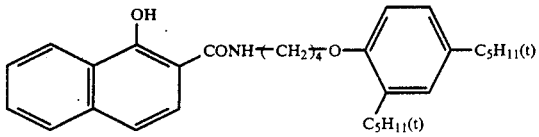

As will be clear from Table 10, in Sample Nos. 99 and 100 employing the comparative couplers, the MTF values representing the sharpness are undesirably lowered when the color developing is carried out in 1 minute as compared with a 3 minutes 30 seconds processing usually performed. Whereas, in Sample Nos. 101 to 104 employing the cyan coupler of this invention, the MFT values become large when the color developing is carried out in 1 minute, as compared with the 3 minutes 30 seconds processing.

What is claimed is:

1. A method of processing a light-sensitive silver halide photographic material, which comprises;

subjecting to exposure a light-sensitive silver halide color photographic material comprising a support; a light-sensitive silver halide emulsion layer containing at least one of a core/shell silver halide grain containing at least 3.0 mole % of silver iodide and a tabular silver halide grain containing at least 3.0 mole % of silver iodide; and a compound capable of releasing, during a developing processing, a restrainer or restrainer precursor which forms silver salt having the solubility product with a silver ion, of up to $1\times10^{-9}$, thereafter;

carrying out a color developing processing by using a color developing solution containing an aromatic primary amine type color developing agent, for a period of up to 120 seconds and so as to have a value of (developed silver amount at the maximum density portion)/(total silver amount), of up to 0.5; and thereafter carrying out a processing step with an aqueous solution having a specific gravity of at least 1.1.

2. The method of processing a light-sensitive silver halide color photographic material of claim 1, wherein the color developing processing is carried out at a temperature of 43° C. or more.

3. The method of processing a light-sensitive silver halide color photographic material according to claim 1, wherein the processing step with an aqueous solution having a specific gravity of at least 1.1 following the color developing is a processing by a bleach-fixing solution.

4. The method of processing a light-sensitive silver halide color photographic material of claim 1, wherein the method comprises a processing by a water washing substitutive stabilizing solution and does not comprise a step of washing with water.

5. The method of processing a light-sensitive silver halide color photographic material of claim 1, wherein the color developing processing is carried out at a temperature of 48° C. or more.

6. The method of processing a light-sensitive silver halide color photographic material of claim 1, wherein the light-sensitive silver halide color photographic material comprises a red-sensitive silver halide emulsion layer containing a phenol type cyan coupler having a ureido group.

7. The method of processing a light-sensitive silver halide color photographic material of claim 6, wherein said phenol type cyan coupler having a ureido group is a compound represented by Formula (I) or Formula (II) shown below.

Formula (I)

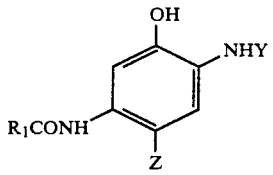

Formula (II)

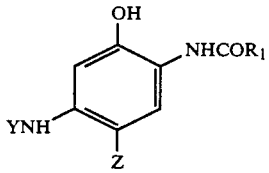

wherein $R_1$ represents an alkyl group, an alkenyl group, a cycloalkyl group, an aryl group or a heterocyclic group; Y represents a group represented by;

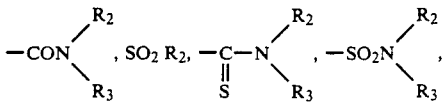

-continued $-CONHCOR_2$ or $-CONHSO_2R_2$, wherein $R_2$ represents an alkyl group, an alkenyl group, a cycloalkyl group, an aryl group or a heterocyclic group, and $R_3$ represents a hydrogen atom or the group represented by $R_2$, and $R_2$ and $R_3$ may be the same or different and may be linked to each other to form a 5- or 6-membered hetero ring; and Z represents a hydrogen atom or a group eliminable at the coupling reaction with an oxidized product of an aromatic primary amine type color developing agent.

8. The method of processing a light-sensitive silver halide color photographic material of claim 1, wherein a processing solution immersion time of said material in processing solutions from said color developing step to a processing step with a final processing solution is 540 seconds or less.

9. The method of processing a light-sensitive silver halide color photographic material of claim 7, wherein the light-sensitive silver halide color photographic material comprises a red-sensitive silver halide emulsion layer containing a phenol type cyan coupler having a ureido group.

10. The method of processing a light-sensitive silver halide color photographic material of claim 1, wherein said compound capable of releasing at a developing processing a restrainer or restrainer precursor is a DIR compound, a tetrazaindene derivative or a 6-aminopurine derivative.

11. The method of processing a light-sensitive silver halide color photographic material of claim 1, wherein said aromatic primary amine type color developing agent is a compound represented by Formula (XX) shown below:

Formula (XX)

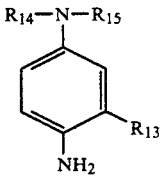

wherein, $R_{13}$ represents a hydrogen atom, a halogen atom or an alkyl group, which alkyl group represents a straight chain or branched alkyl group having 1 to 5 carbon atoms; and $R_{14}$ and $R_{15}$ each represent a hydrogen atom, an alkyl group or an aryl group, where at least one of $R_{14}$ and $R_{15}$ is an alkyl group substituted with a water-soluble group or a group of $[(CH_2)_qO]_pR_{16}$, where $R_{16}$ represents a hydrogen atom or an alkyl group, which alkyl group represents a straight chain or branched alkyl group having 1 to 5 carbon atoms, and p and q represent an integer of 1 to 5.

12. The method of processing a light-sensitive silver halide color photographic material of claim 1, wherein said color developing solution contains an organic restrainer represented by Formula (R-I):

-continued

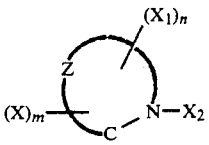

wherein, X and $X_1$ each represent halogen atom, an alkyl group, an aryl group, an amino group, a hydroxyl group, a nitro group, a carboxyl group or a sulfonyl group; $X_2$ represents a hydrogen atom, an alkyl group, an aryl group or a double bond for the formation of a ring; Z represents a group consisting of a carbon atom, an oxygen atom, a nitrogen atom, a sulfur atom necessary for the formation of a ring; and m and n each represent 0, 1 or 2, Formula (R-II):

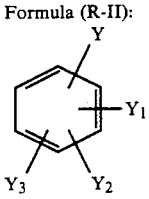

wherein, Y, $Y_1$, $Y_2$ and $Y_3$ each represent a hydrogen atom, a halogen atom, an alkyl group, an amino group, a hydroxyl group, a nitro group, a carboxyl group or a sulfonyl group, Formula (R-III):

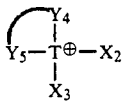

wherein, T represents a nitrogen atom or a phosphorous atom; $X_2$ and $X_3$ each represent a hydrogen atom, an alkyl group, an aryl group or a halogen atom; and $Y_4$ and $Y_5$ each represent an alkyl group or an aryl group, and $Y_4$ and $Y_5$ may be ring-closed and form a hetero ring, Formula (R-IV):

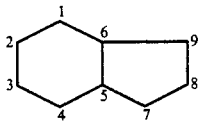

which is a compound wherein 2 to 5 carbon atoms in the positions 1 to 9 have been substituted with nitrogen atoms, or a derivative thereof, Formula (R-V):

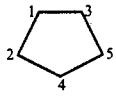

which is a compound wherein 2 to 4 carbon atoms in the positions 1 to 5 have been substituted with nitrogen atoms, or a derivative thereof, Formula (R-VI):

-continued

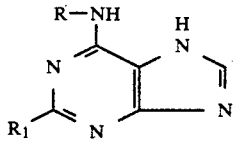

Formula (R-VII):

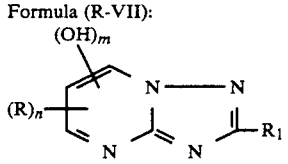

Formula (R-VIII):

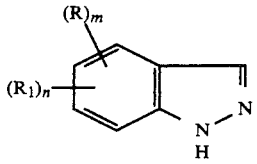

Formula (R-IX):

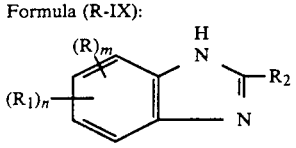

Formula (R-X):

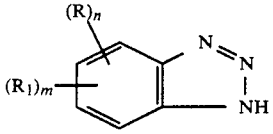

Formula (R-XI):

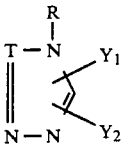

wherein T is carbon or nitrogen,

Formula (R-XII):

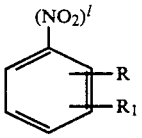

or

Formula (R-XIII):

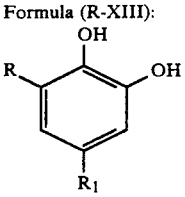

in each of the formulas, $Y_1$ and $Y_2$, each have the same meaning as defined for Y, $Y_1$, $Y_2$ and $Y_3$ in the description for the above (R-II); R, $R_1$ and $R_2$ represent a hydrogen atom, an alkyl group or an aryl group; m and n each represent 0, 1 or 2; and l represents 1 or 2.

13. The method of processing a light-sensitive silver halide color photographic material of claim 12, wherein said color developing solution contains an organic restrainer represented by:

Formula (R-VI):

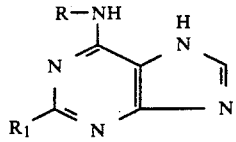

Formula (R-VII):

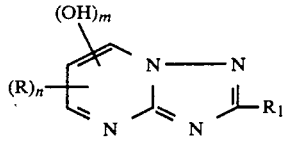

Formula (R-IX):

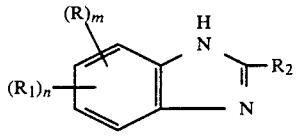

Formula (R-X):

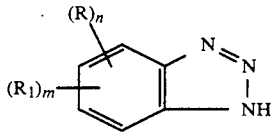

Formula (R-XII):

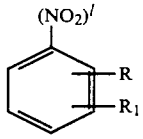

or

Formula (R-XIII):

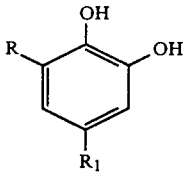

in each of the formulas, R, $R_1$ and $R_2$represents a hydrogen atom, an alkyl group or an aryl group; m and n each represent 0, 1 or 2; and l represents 1 or 2.

14. The method of processing a light-sensitive silver halide color photographic material of claim 13, wherein said color developing solution contains an organic restrainer represented by:

Formula (R-VI):

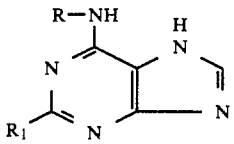

or

Formula (R-XII):

-continued

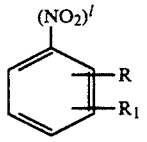

in each of the formulas, R and $R_1$ represent a hydrogen atom, an alkyl group or an aryl group; and l represents 1 or 2.

15. The method of claim 1 wherein the silver iodide content of said core/shell silver halide grain and of said tabular silver halide grain is in the range of 3 to 20 mole %.

16. The method of claim 15 wherein the core/shell silver halide grain contains the silver iodide content in the core.

17. The method of claim 1 wherein the core/shell silver halide grain contains the silver iodide content in the core.

* * * * *